US011672404B2

(12) United States Patent
Wolowicz et al.

(10) Patent No.: US 11,672,404 B2
(45) Date of Patent: Jun. 13, 2023

(54) DISH TREATING APPLIANCE WITH AN AIR SUPPLY CIRCUIT

(71) Applicant: Whirlpool Corporation, Benton Harbor, MI (US)

(72) Inventors: Mateusz Michal Wolowicz, Wroclaw (PL); Philip J. Czarnecki, Saugatuck, MI (US); Subhash Nivrutti Varvate, Maharashtra (IN); Pawel Krzysztof Kolodziej, Wroclaw (PL); Justyna Zuzanna Kepinska, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 9 days.

(21) Appl. No.: 17/065,217

(22) Filed: Oct. 7, 2020

(65) Prior Publication Data

US 2022/0104685 A1 Apr. 7, 2022

(51) Int. Cl.
*A47L 15/48* (2006.01)
*A47L 15/42* (2006.01)

(52) U.S. Cl.
CPC ..... *A47L 15/488* (2013.01); *A47L 15/4274* (2013.01); *A47L 15/486* (2013.01)

(58) Field of Classification Search
CPC ..... A47L 15/486; A47L 15/488; A47L 15/483
See application file for complete search history.

(56) References Cited

U.S. PATENT DOCUMENTS 7,604,014 B2 10/2009 Paintner
7,676,954 B2 3/2010 Classen et al.
8,307,839 B2 11/2012 Peukert et al.
8,671,587 B2 3/2014 Berends et al.
9,677,770 B2 6/2017 Lee et al.
9,888,829 B1 * 2/2018 Bongivengo ..... A47L 15/486
10,132,515 B2 11/2018 Smith
10,470,640 B2 11/2019 Kim et al.
2013/0008474 A1 * 1/2013 Thayyullathil ..... A47L 15/488 34/201
2013/0228202 A1 * 9/2013 Welch ..... A47L 15/4257 134/200

(Continued)

FOREIGN PATENT DOCUMENTS

DE 19813924 A1 9/1999
DE 102009049066 A1 4/2011

(Continued)

OTHER PUBLICATIONS

European Patent Office, Extended Search Report re Corresponding Application No. 21201551.5-1606, dated May 11, 2022, 7 pages, Munich, Germany.

*Primary Examiner* — Joseph L. Perrin
*Assistant Examiner* — Irina Graf
(74) *Attorney, Agent, or Firm* — McGarry Bair PC

(57) ABSTRACT

A dish treating appliance includes a tub at least partially defining a treating chamber with an access opening. A door is movable relative to the tub between closed and opened positions to selectively close and open the access opening. The dish treating appliance further includes an air supply circuit. The air supply circuit includes an air inlet and an air outlet facing an upper portion of the access opening. An air channel fluidly couples the air outlet to the air inlet.

13 Claims, 27 Drawing Sheets

(56) References Cited

U.S. PATENT DOCUMENTS

| | | | | |
|---|---|---|---|---|
| 2013/0319481 | A1* | 12/2013 | Welch | A47L 15/0078 134/99.1 |
| 2014/0041695 | A1* | 2/2014 | Ellingson | A47L 15/0047 134/105 |
| 2014/0238450 | A1* | 8/2014 | Bertram | A47L 15/483 134/18 |
| 2015/0190032 | A1* | 7/2015 | Disch | A47L 15/0047 134/25.2 |
| 2019/0053686 | A1* | 2/2019 | Weigle | A47L 15/0034 |
| 2019/0104916 | A1 | 4/2019 | Kim et al. | |
| 2019/0239717 | A1* | 8/2019 | Yoon | A47L 15/488 |
| 2020/0037845 | A1* | 2/2020 | Thiyagarajan | A47L 15/0047 |
| 2020/0069147 | A1* | 3/2020 | Sankaran Veerabhagu | A47L 15/4257 |
| 2021/0186299 | A1* | 6/2021 | Kim | A47L 15/488 |

FOREIGN PATENT DOCUMENTS

| | | | | |
|---|---|---|---|---|
| DE | 102017203297 | A1 | 9/2017 | |
| EP | 1142528 | A2 * | 10/2001 | A47L 15/483 |
| EP | 2371258 | A2 | 10/2011 | |
| EP | 2578741 | A1 | 4/2013 | |
| EP | 2372012 | B1 | 8/2016 | |
| EP | 2658429 | | 8/2016 | |
| KR | 101202103 | B1 | 11/2006 | |
| KR | 101214705 | B1 | 4/2007 | |
| WO | 2007138064 | A1 | 12/2007 | |
| WO | 2015107474 | A1 | 7/2015 | |
| WO | WO-2020032714 | A1 * | 2/2020 | A47L 15/4246 |

* cited by examiner

DISH TREATING APPLIANCE WITH AN AIR SUPPLY CIRCUIT

BACKGROUND

Contemporary automatic dish treating appliances for use in a typical household include a tub at least partially defining a treating chamber into which dishes can be placed to undergo a treating operation, such as washing. Multiple sprayers can be provided for spraying liquid throughout the tub to remove soils from the dishes. The dish treating appliance can be provided with a door assembly, which can be hingedly mounted to the tub or to a cabinet for pivoting movement about a pivot axis between closed and opened positions to selectively close and open an access opening in the tub.

Dish treating appliances with pivoting doors are known to emit hot, moist air along the top edge of the tub when the door is opened after the completion of a cycle of operation and before the internal air has had a chance to cool naturally. This hot, moist air can flow toward or along a top edge or top wall of the tub, such that the hot, moist air can come into contact with a work surface, such as a countertop, that can overlie the tub and the dishwasher. Such exposure to hot, moist air can cause wear of or deterioration of the work surface over time. To avoid such exposure of the work surface to hot, moist air, dish treating appliances can include an air supply system that directs air along the top of the door. In one example, and further to alter temperature or humidity of the hot, moist air under these conditions, such an air supply system can direct ambient air along the top of the door to effect a mixing of the ambient air with the hot, moist air to yield an air mixture of a lesser temperature or humidity.

BRIEF DESCRIPTION

An aspect of the present disclosure relates to a dish treating appliance comprising a tub at least partially defining a treating chamber with an access opening, a door movable relative to the tub between closed and opened positions to selectively close and open the access opening, and an air supply circuit comprising an air inlet, an air outlet located within the treating chamber and facing an upper portion of the access opening, and an air channel fluidly coupling the air outlet to the air inlet, with at least a portion of the air channel extending along an exterior of the tub.

Another aspect of the present disclosure relates to a dish treating appliance comprising a tub at least partially defining a treating chamber with an access opening, a door movable relative to the tub between closed and opened positions to selectively close and open the access opening, and an air supply circuit comprising an air inlet fluidly coupled to the treating chamber, an air outlet located at an upper portion of the tub adjacent an upper portion of the access opening, and an air channel fluidly coupling the air outlet to the air inlet, with at least a portion of the air channel extending along an exterior of the tub.

Yet another aspect of the present disclosure relates to a dish treating appliance comprising a tub at least partially defining a treating chamber with an access opening, a door movable relative to the tub between closed and opened positions to selectively close and open the access opening, and an air supply circuit comprising an air inlet, an air outlet located at an upper portion of the tub adjacent an upper portion of the access opening, an air channel fluidly coupling the air outlet to the air inlet, with at least a portion of the air channel extending along an exterior of the tub, and a cooling assembly thermally coupled to and configured to cool air passing through the air supply circuit.

DETAILED DESCRIPTION

Figure 1:
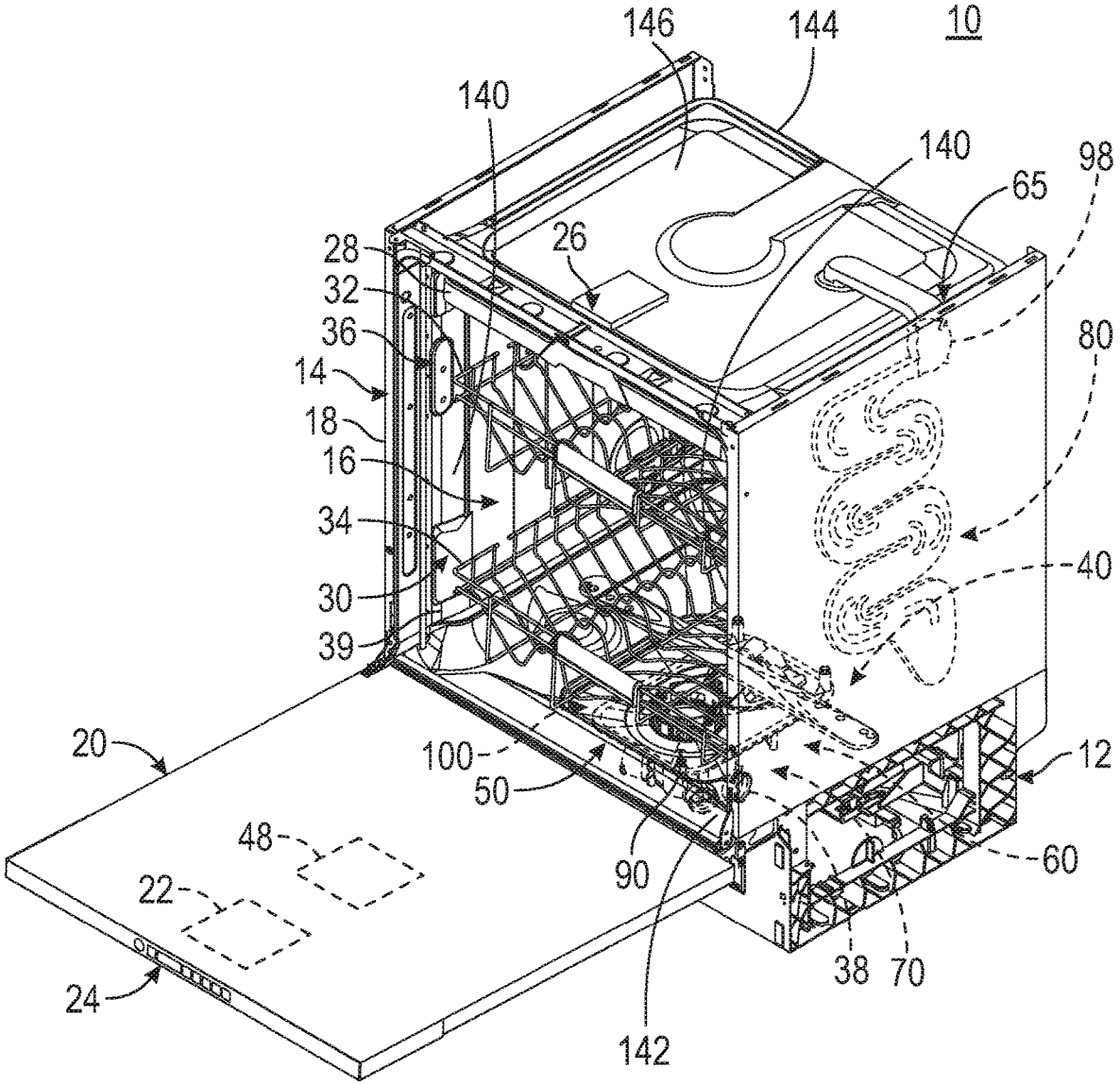
FIG. 1 is a right-side perspective view of a dish treating appliance, illustrated herein as a dishwasher, having multiple systems for implementing an automatic cycle of operation, including an air supply system.

FIG. 1 illustrates an automatic dish treating appliance 10, illustrated herein as a dishwasher 10, capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, silverware, and other utensils. As illustrated, the dishwasher 10 is a built-in dishwasher 10 implementation, which is designed for mounting under a countertop or other work surface. However, this description is applicable to other dishwasher implementations such as a stand-alone, multi-tub-type, drawer-type, or a sink-type, for example, as well as dishwashers having varying widths, sizes, and capacities. The dishwasher 10 shares many features of a conventional automatic dishwasher, which may not be described in detail herein except as necessary for a complete understanding of aspects of the disclosure.

The dishwasher 10 has a variety of systems, some of which are controllable, to implement the automatic cycle of operation. A chassis or cabinet is provided to support the variety of systems needed to implement the automatic cycle of operation and can define an interior. As illustrated, for a built-in implementation, the chassis or cabinet includes a frame in the form of a base 12 on which is supported an open-faced tub 14, which at least partially defines a treating chamber 16, having an access opening, illustrated herein as an open face 18, for receiving the dishes. The open-faced tub 14 can have at least a pair of opposing side walls 140 that are spaced apart from one another, such as by being spaced apart by a bottom wall 142, a rear wall 144, and/or a top wall 146. The pair of opposing side walls 140, the bottom wall 142, the rear wall 144, and the top wall 146 can further be thought of as at least partially defining the treating chamber 16, and optionally also the open face 18 to serve as the access opening.

A closure in the form of a door assembly 20 can be hingedly or pivotally mounted to the base 12, or to any other suitable portion of the cabinet or chassis or of the tub 14, for movement relative to the tub 14 between opened and closed positions to selectively open and close the open face 18 of the tub 14. In one example, the door assembly 20 is mounted for pivoting movement about a pivot axis relative to the base 12, the tub 14, or the open face 18. In the opened position, a user can access the treating chamber 16, as shown in FIG. 1, while, in the closed position (not shown), the door assembly 20 covers or closes the open face 18 of the treating chamber 16. Thus, the door assembly 20 provides selective accessibility to the treating chamber 16 for the loading and unloading of dishes or other items. A closure or latch assembly (not shown) can be provided to selectively retain the door assembly 20 in the closed position. A door opening assembly 26, illustrated herein as a door opener 26, is provided with the dishwasher 10 to selectively bias the door assembly 20 toward the opened position. The door opener 26 can be provided at any suitable location within the dishwasher 10, such as coupled to or mounted to the tub 14 or to another portion of the chassis or cabinet or the dishwasher 10.

The chassis or cabinet, as in the case of the built-in dishwasher implementation, can be formed by other parts of the dishwasher 10, like the tub 14 and the door assembly 20, in addition to a dedicated frame structure, like the base 12, with them all collectively forming a uni-body frame by which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include a dish holding system 30, spray system 40, recirculation system 50, drain system 60, water supply system 70, air supply system 65, heating system 90, and filter system 100. These systems are used to implement one or more treating cycles of operation for the dishes, for which there are many, one of which includes a traditional automatic wash cycle.

A basic traditional automatic cycle of operation for the dishwasher 10 has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The amounts of water, treating chemistry, and/or rinse aid used during each of the multiple wash or rinse steps can be varied. The wash phases and rinse phases can include the heating of the water, even to the point of one or more of the phases being hot enough for long enough to sanitize the dishes. A drying phase can follow the rinse phase(s). The drying phase can include a drip dry, a non-heated drying step (so-called "air only"), heated dry, condensing dry, air dry or any combination. These multiple phases or steps can also be performed by the dishwasher 10 in any desired combination.

A controller 22 can also be included in the dishwasher 10 and operably couples with and controls the various components of the dishwasher 10 to implement the cycles of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can provide an input and output function for the controller 22.

The user interface 24 can include operational controls such as one or more knobs, dials, lights, switches, displays, touch screens and the like for communicating with the user, such as enabling a user to input commands, such as a cycle of operation, to the controller 22 and to receive information, for example about the selected cycle of operation. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the dishwasher 10 and can allow the controller 22 to communicate with the user in a variety of ways. For example, the controller 22 can be configured to send a text message to the user, send an electronic mail to the user, or provide audio information to the user either through the dishwasher 10 or utilizing another device such as a mobile phone.

The controller 22 can include the machine controller and any additional controllers provided for controlling any of the components of the dishwasher 10. For example, the controller 22 can include the machine controller and a motor controller. Many known types of controllers can be used for the controller 22. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

The dish holding system 30 can include any suitable structure or structures for receiving or holding dishes within the treating chamber 16. Exemplary dish holders are illustrated in the form of an upper dish rack 32 and lower dish rack 34, commonly referred to as "racks", which are located within the treating chamber 16. The upper dish rack 32 and the lower dish rack 34 each define an interior and are typically mounted for slidable movement in and out of the treating chamber 16 through the open face 18 for ease of loading and unloading. In one example, it is common for the upper dish rack 32 to be slidably mounted within and to the tub 14 by the use of a suitable drawer withdrawal assembly, such as by the use of drawer guides, slides, or rails 36, while the lower dish rack 34 is instead typically provided with wheels or rollers 38 that can roll along a travel path 39 defined by at least a portion of the dishwasher 10. For example, it is typical for the lower dish rack 34 to be slidable along the travel path 39 such that the lower dish rack 34 can roll along the travel path 39 and then continue to roll onto the door assembly 20, when the door assembly 20 is in the opened position and allows for withdrawal of the dish racks 32, 34.

By way of further example, in such a case, it is also typical that the travel path 39 can include a type of rails 39, but that rails 39 for the lower dish rack 34 may differ in structure from the rails 36 for the upper dish rack 32, and in particular such that the rails 39 may be provided simply as a ledge or a surface formed by the tub 14, such as formed or carried by the side walls 140 or the bottom wall 142 of the tub 14. By providing the rails 39 for the lower dish rack 34 as a simpler support surface, such as a ledge, rather than a more restrictive or enclosing structure such as the rails 36, the rails 39 are better able to accommodate movement or instability of the lower dish rack 34 as the lower dish rack 34 rolls onto the door assembly 20, going from the static, stable tub 14 to the movable door assembly 20. In this way, the rails 39 allow more tolerance for movement as the lower dish rack 34 rolls along the door assembly 20.

In addition, dedicated dish holders can also be provided. One such dedicated dish holder is a third level rack 28 located above the upper dish rack 32. Like the upper dish rack 32, the third level rack 28 is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack 28, it can be washed in the third level rack 28. The third level rack 28 generally has a much shorter height or lower profile than the upper and lower dish racks 32, 34. Typically, the height of the third level rack 28 is short enough that a typical glass cannot be stood vertically in the third level rack 28 and the third level rack 28 still be slid into the treating chamber 16.

Another dedicated dish holder can be a utensil or silverware basket (not shown), which is typically located in the treating chamber 16 and carried by one of the upper or lower dish racks 32, 34 or mounted to the door assembly 20. The silverware basket typically holds utensils and the like in an upright orientation as compared to the on-the-side or flat orientation of the third level rack 28. More than one silverware basket can be provided with the dishwasher 10.

A dispenser assembly 48 is provided to store and dispense treating chemistry, e.g. detergent, anti-spotting agent, etc., into the treating chamber 16. The dispenser assembly 48 can be mounted on an inner surface of the door assembly 20, as shown, or can be located at other positions within the chassis or treating chamber 16, such that the dispenser assembly 48 is positioned to be accessed by the user for refilling of the dispenser assembly 48, whether it is necessary to refill the dispenser assembly 48 before each cycle (i.e. for a single use dispenser) or only periodically (i.e. for a bulk dispenser). The dispenser assembly 48 can dispense one or more types of treating chemistries. The dispenser assembly 48 can be a single-use dispenser, which holds a single dose of treating chemistry, or a bulk dispenser, which holds a bulk supply of treating chemistry and which is adapted to dispense a dose of treating chemistry from the bulk supply during the cycle of operation, or a combination of both a single use and bulk dispenser. The dispenser assembly 48 can further be configured to hold multiple different treating chemistries. For example, the dispenser assembly 48 can have multiple compartments defining different chambers in which treating chemistries can be held.

Figure 2:
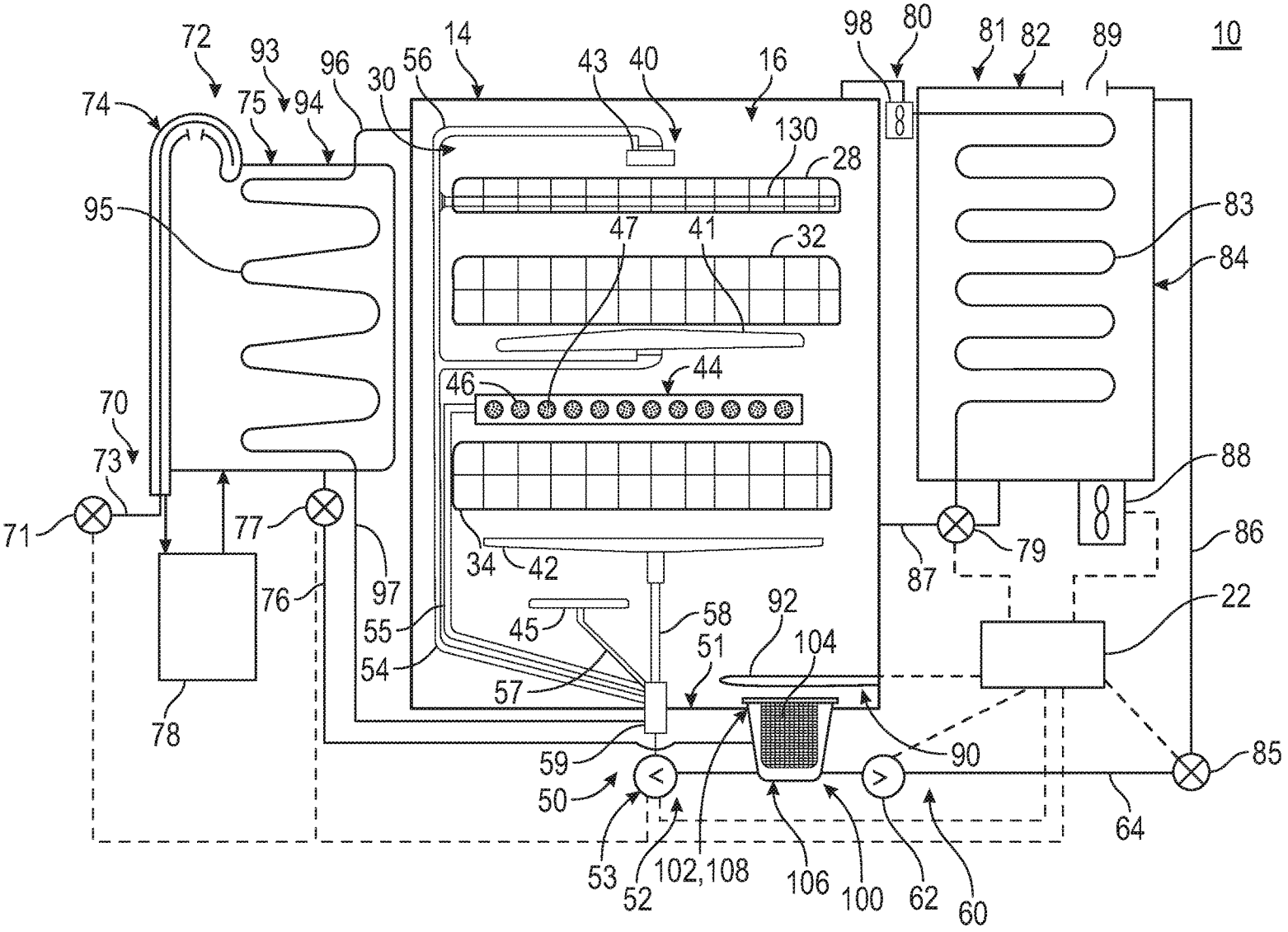
FIG. 2 is a schematic view of the dishwasher of FIG. 1 and illustrating at least some of the systems.

Turning to FIG. 2, the spray system 40 is provided for spraying liquid in the treating chamber 16 and can have multiple spray assemblies or sprayers 41, 42, 43, 44, 45, 130, some of which can be dedicated to a particular one of the dish holders, to particular area of a dish holder, to a particular type of cleaning, or to a particular level of cleaning, etc. The sprayers 41, 42, 43, 44, 45, 130 can be fixed or movable, such as rotating, relative to the treating chamber 16 or dish holder. Exemplary sprayers 41, 42, 43, 44, 45, 130 are illustrated and include an upper spray arm 41, a lower spray arm 42, a third level sprayer 43, a deep-clean sprayer 44, and a spot sprayer 45. The upper spray arm 41 and lower spray arm 42 can be rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, a sprayer 130 can be located at least in part below a portion of the third level rack 28, though it will be understood that such a sprayer 130 can be provided adjacent any of the racks 28, 32, 34. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or can move, such as by way of rotating. The spray emitted by the deep-clean sprayer 44 defines a deep clean zone, which, as illustrated, would extend along a rear side of the lower dish rack 34. Thus, dishes needing deep cleaning, such as dishes with baked-on food, can be positioned in the lower dish rack 34 to face the deep-clean sprayer 44. The deep-clean sprayer 44, while illustrated as only one unit on a rear wall of the tub 14, could comprise multiple units and/or extend along multiple portions, including different walls, of the tub 14, and can be provided above, below, or beside any of the dish holders 28, 32, 34 wherein deep cleaning is desired.

The spot sprayer 45, like the deep-clean sprayer 44, can emit an intensified and/or higher pressure spray, especially to a discrete location within one of the dish holders 28, 32, 34. While the spot sprayer 45 is shown below the lower dish rack 34, it could be adjacent any part of any dish holder 28, 32, 34 or along any wall of the tub 14 where special cleaning is desired. In the illustrated location below the lower dish rack 34, the spot sprayer 45 can be used independently of or in combination with the lower spray arm 42. The spot sprayer 45 can be fixed or can move, such as in rotating.

These sprayers 41, 42, 43, 44, 45, 130 are illustrative examples of suitable sprayers and are not meant to be limiting as to the type of suitable sprayers 41, 42, 43, 44, 45, 130. Additionally, it will be understood that not all of the exemplary sprayers 41, 42, 43, 44, 45, 130 need be included within the dishwasher 10, and that less than all of the sprayers 41, 42, 43, 44, 45, 130 described can be included in a suitable dishwasher 10.

The recirculation system 50 recirculates the liquid sprayed into the treating chamber 16 by the sprayers 41, 42, 43, 44, 45, 130 of the spray system 40 back to the sprayers 41, 42, 43, 44, 45, 130 to form a recirculation loop or circuit by which liquid can be repeatedly and/or continuously sprayed onto dishes in the dish holders 28, 32, 34. The recirculation system 50 can include a sump 51 and a pump assembly 52. The sump 51 collects the liquid sprayed in the treating chamber 16 and can be formed by a sloped or recess portion of the bottom wall 142 of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 41, 42, 43, 44, 45, 130 to the recirculation pump 53. A recirculation valve 59 can selectively fluidly couple each of the conduits 54, 55, 56, 57, 58 to the recirculation pump 53. While each sprayer 41, 42, 43, 44, 45, 130 is illustrated as having a corresponding dedicated supply conduit 54, 55, 56, 57, 58, one or more subsets, comprising multiple sprayers from the total group of sprayers 41, 42, 43, 44, 45, 130, can be supplied by the same conduit, negating the need for a dedicated conduit 54, 55, 56, 57, 58 for each sprayer 41, 42, 43, 44, 45, 130. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54, 55, 56, 57, 58 can be directly coupled to the recirculation pump 53, while one or more of the other conduits 54, 55, 56, 57, 58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupling the treating chamber 16 to a drain line 64. As illustrated, the drain pump 62 fluidly couples the sump 51 to the drain line 64.

While separate recirculation 53 and drain pumps 62 are illustrated, a single pump can be used to perform both the recirculating and the draining functions, such as by configuring the single pump to rotate in opposite directions, or by providing a suitable valve system. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to at least some extent.

A water supply system 70 is provided for supplying fresh water to the dishwasher 10 from a water supply source, such as a household water supply via a household water valve 71. The water supply system 70 includes a water supply unit 72 having a water supply conduit 73 with a siphon break 74 or an air break 74. While the water supply conduit 73 can be directly fluidly coupled to the tub 14 or any other portion of the dishwasher 10, the water supply conduit 73 is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 can be provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

An air supply system 65 is provided to aid in the treating of the dishes during the cycle of operation by supplying air to at least a portion of the dishwasher 10, a non-limiting example of which includes the treating chamber 16. The air supply system 65 can include a variety of assemblies, pathways, and circuits for supplying air to different portions of the dishwasher 10 and for different purposes within the dishwasher 10, such that the air supply system 65 can be thought of as comprising all of the air supplying or air circulating portions of the dishwasher 10. In one non-limiting example, the air supply system 65 comprises a drying system 80 that is provided to aid in the drying of the dishes during the drying phase. The drying system 80 as illustrated, by way of non-limiting example, includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber 16, or a combination of both by operating in one configuration and then the other configuration. A fan or blower 98 can be fluidly coupled with the serpentine conduit 83 to move air through the serpentine conduit 83. It will also be understood that the serpentine conduit 83 is not limited to having a serpentine shape and can instead be provided with any suitable size and shape.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60, or water supply system 70, such that liquid can be supplied to the cooling tank 84. The liquid provided to the cooling tank 84 from any of the systems 40, 50, 60, 70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected based on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater 92, located in the treating chamber 16 at a location where it will be immersed by the water supplied to the treating chamber 16, such as within or near the sump 51. However, it will also be understood that the heater 92 need not be an immersion heater 92; it can also be an in-line heater located in any of the conduits. There can also be more than one heater 92, including both an immersion heater 92 and an in-line heater. The heater 92 can also heat air contained in the treating chamber 16. Alternatively, a separate heating element (not shown) can be provided for heating the air circulated through the treating chamber 16.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated, such as an ultrafiltration system.

Figure 3:
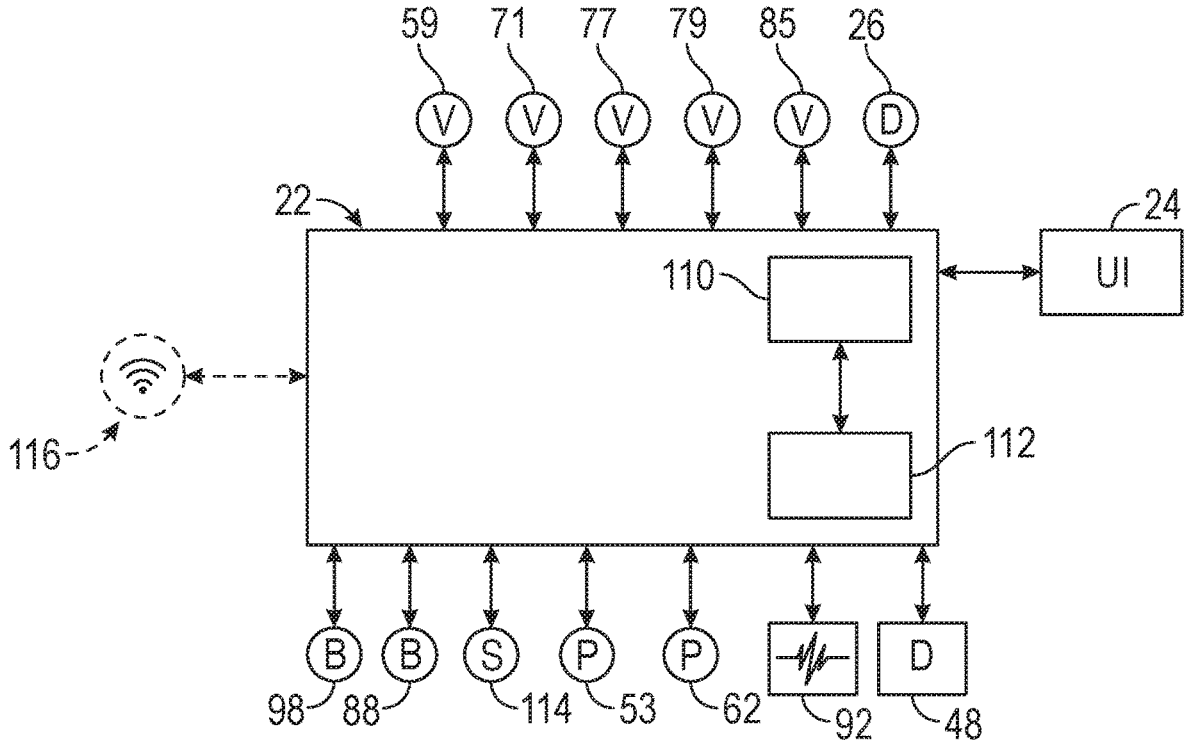
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, the recirculation pump 53 for recirculating the wash liquid during the cycle of operation, the user interface 24 for receiving user selected inputs and communicating information to the user, the dispenser assembly 48 for selectively dispensing treating chemistry to the treating chamber 16, the door opener 26 for selectively actuating the door opener 26, the blower 98 for providing air through the serpentine conduit 83, and the blower 88 for providing air into the cooling tank 84. The controller 22 can also communicate with the recirculation valve 59, the household water valve 71, the controllable valve 77, the return valve 79, and the valve 85 to selectively control the flow of liquid within the dishwasher 10. Optionally, the controller 22 can include or communicate with a wireless communication device 116.

The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store a set of executable instructions including one or more pre-programmed automatic cycles of operation that can be selected by a user and executed by the dishwasher 10. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 24. The memory 110 can also be used to store information, such as a database or table, and to store data received from one or more components of the dishwasher 10 that can be communicably coupled with the controller 22. The database or table can be used to store the various operating parameters for the one or more cycles of operation, including factory default values for the operating parameters and any adjustments to them by the control assembly or by user input.

The controller 22 can also receive input from one or more sensors 114 provided in one or more of the assemblies or systems of the dishwasher 10 to receive input from the sensors 114, which are known in the art and not shown for simplicity. Non-limiting examples of sensors 114 that can be communicably coupled with the controller 22 include, to name a few, an ambient air temperature sensor, a treating chamber temperature sensor, such as a thermistor, a water supply temperature sensor, a door open/close sensor, a moisture sensor, a chemical sensor, and a turbidity sensor to determine the soil load associated with a selected grouping of dishes, such as the dishes associated with a particular area of the treating chamber 16.

Figure 4:
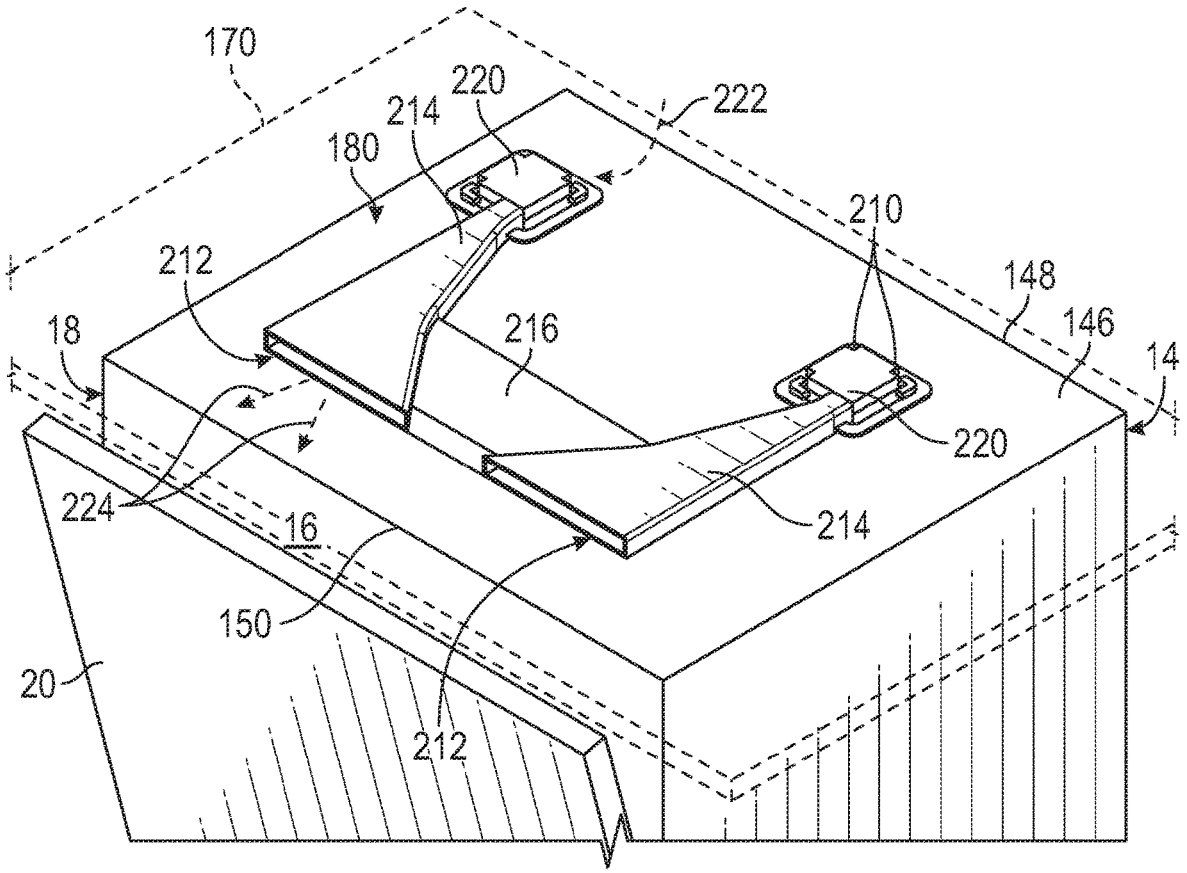
FIG. 4 is a top and right-side perspective view of an example of an air supply circuit for use with the air supply system of the dishwasher of FIG. 1.

Turning now to FIG. 4, while the air supply system 65 has been illustrated herein as including the drying system 80 having the previously described components and configurations, it will be understood that these examples are non-limiting and that the air supply system 65, which may or may not include the drying system 80, can be modified in a variety of ways and still fall within the scope of the present disclosure to supply air for the operation of the dishwasher 10. For example, in the case when the drying system 80 is included, the serpentine conduit 83 can vary by its position along and relative to the tub 14, by its shape, by the inclusion of the fan or blower 98 to move air through the serpentine conduit 83, and/or by the direction of the air flow through the serpentine conduit 83, and still fall within the scope of the present disclosure. Further yet, the air supply system 65 as a whole can also vary, such as by being provided in either an open loop or a closed loop configuration, and additionally by the inclusion of a variety of different air supply circuits to add to or improve the operation and functionality of the dishwasher 10, examples of which will be described in further detail herein.

Specifically, FIG. 4 illustrates an example of an air supply circuit 180 that can be included with the dishwasher 10 and can be thought of as comprising a portion of the air supply system 65. The air supply circuit 180 can be included within the air supply system 65 and the dishwasher 10 in addition to the previously described components of the drying system 80, without the need to replace or remove other parts of the drying system 80 as described. In one aspect of the present disclosure, air supply circuits, such as the air supply circuit 180, can be provided within the air supply system 65 in order to provide an air supply or an air flow that is directed toward the door assembly 20 or the open face 18 of the tub 14. When the door assembly 20 is moved from the closed position to the opened position, such as at the completion of a cycle of operation, heated, humid air that is present within the treating chamber 16 can flow rapidly to exit the treating chamber 16, resulting in an unpleasant user experience or undesirable moisture exposure to a work surface 170 that may overlie the dishwasher 10. These unwanted effects can be minimized or avoided by providing an air supply or air flow, which can be, but is not limited to, a dry air supply or a cooling air supply, that is directed toward the opening of the door assembly 20.

As illustrated in FIG. 4, the top wall 146 of the tub 14 defines a rear edge 148, furthest from the door assembly 20 and the open face 18, and a front edge 150 that is nearest the door assembly 20 and the open face 18. Specifically, the front edge 150 can contact or abut the door assembly 20 when the door assembly 20 is in the closed position, though it is not required. The front edge 150 of the top wall 146 can be thought of as defining a frontmost upper portion, such as an uppermost front edge 150 of the tub 14, as well as thought of as defining an upper portion 150, such as an upper edge 150 of the access opening as defined by the open face 18. While the air supply circuit 180 is illustrated herein as being provided on or extending along at least a portion of the top wall 146, it will be understood that other locations are possible, such as at an upper portion of one of the side walls 140, such that the air supplied is directed toward or adjacent the front edge 150. The air supply circuit 180 can be coupled to or mounted to an exterior of the top wall 146, such that at least a portion of the air supply circuit 180 is located exteriorly of the tub 14.

The air supply circuit 180 comprises at least one air inlet 210, at least one blower 220, at least one air channel 214, and at least one air outlet 212. As illustrated herein, the blower 220 is coupled to the top wall 146 exterior of the tub 14, and, by way of non-limiting example, is positioned at a rear portion of the top wall 146, near the rear edge 148. The blower 220 at least partially defines the at least one air inlet 210. As illustrated herein, each blower 220 defines multiple air inlets 210, though it will be understood that each blower 220 can define any suitable number of air inlets 210. The air inlet 210 is fluidly coupled to ambient air surrounding the exterior of the tub 14, and thus the air inlet 210 fluidly couples the air supply circuit 180 to the ambient air exterior of the tub 14. The blower 220 is further fluidly coupled to the air channel 214 and is also positioned to further at least partially fluidly couple the air inlet 210 with the air outlet 212 and to drive the flow of air from the air inlet 210 to the air outlet 212 through the air channel 214. By way of non-limiting example, the blower 220 can be provided downstream of the air inlet 210, but upstream of the air channel 214, as illustrated, or can have any other suitable location for driving air flow through the air supply circuit 180, including that the blower 220 can be positioned within or integrated with the air channel 214. The blower 220 can be any suitable device for moving, drawing, or propelling air through the air supply circuit 180 and the air channel 214, non-limiting examples of which include a blower, an in-line fan, or another type of fan. The blower 220 is operably coupled with the controller 22.

The air channel 214 extends between the blower 220 and the air outlet 212 and at least partially extends between the air inlet 210 and the air outlet 212. Because the air channel 214 is fluidly coupled to the blower 220, the air channel 214 therefore also serves to at least partially fluidly couple the air inlet 210 to the air outlet 212. In one example, the air channel 214 has at least a portion that extends along the exterior of the tub 14. The air channel 214 extends lengthwise away from the blower 220 and toward the front edge 150 to define the air outlet 212 at the end of the air channel 214 opposite the coupling with the blower 220. The air outlet 212 is located at the upper portion 150 of the tub 14 and adjacent the upper portion 150 of the access opening, as defined by the open face 18 and the front edge 150. Specifically, the air outlet 212 is located above the top wall 146 of the tub 14, overlying the top wall 146 and located exterior to the tub 14 and the treating chamber 16. In one example, in the case that the dishwasher 10 is installed underneath the work surface 170, such as a countertop, the air outlet 212 is positioned between the top wall 146 of the tub 14 and the work surface 170. Further, the air outlet 212 is positioned so as to face toward the upper portion 150 of the access opening, as defined by the front edge 150, which can also be thought of as facing toward the door assembly 20 or facing toward the open face 18.

Moving along the length of the air channel 214 and toward the front edge 150, in one example, the air channel 214 increases in width or cross-sectional area toward the air outlet 212. As illustrated herein, the width of the air outlet 212 is greater than the width of the air inlet 210, such that the air outlet 212 extends across at least a portion of the width of the top wall 146. However, it will be understood that the air outlet 212 can have any suitable width, including a width that is less than or the same as the width of the air inlet 210, and up to and including a width that is the same as the width of the top wall 146. In addition, though the air outlet 212 is illustrated herein as being provided as a rectangular opening air outlet 212, it will be understood that the air outlet 212 can have any suitable shape and size, and also that the air outlet 212 can be provided simply as an opening or a plurality of openings or can include a nozzle (not shown) for specifically directing the air supply out of the air supply circuit 180.

As illustrated herein, the air supply circuit 180 includes a pair of air supply circuits 180, each including at least one air inlet 210, the blower 220, the air channel 214, and the air outlet 212. The pair of air outlets 212 extend in width toward one another, moving along the air channel 214 from the blower 220 to the air outlet 212, with the air channels 214 fluidly coupled to one another by an intermediate channel 216 extending between the air channels 214 at the air outlets 212. However, it will be understood that any suitable number and configuration of air supply circuits 180 can be provided, including only a single air supply circuit 180 with a single air outlet 212, the pair of air supply circuits 180 spaced from one another as illustrated, but without including the intermediate channel 216, or each air supply circuit 180 including more than one blower 220 and/or more than one air outlet 212.

Figure 5:
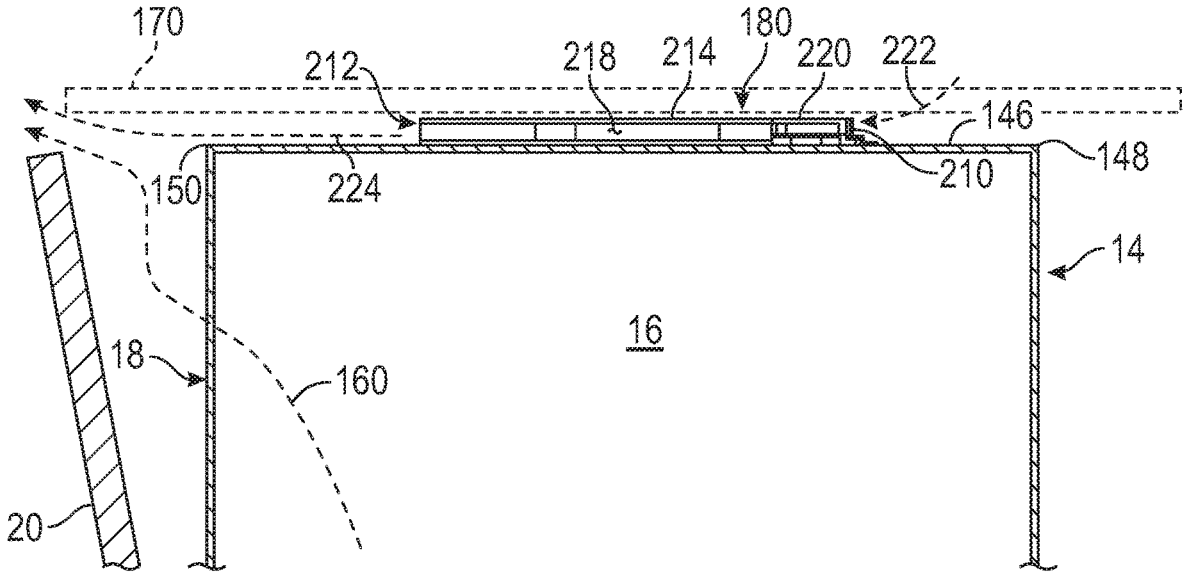
FIG. 5 is a right-side cross-sectional view of the air supply circuit of FIG. 4.

Turning now to FIG. 5, the air channel 214 defines an interior 218, which can be thought of as defining an air supply pathway 218 for the air supply circuit 180. Because the air inlet 210 is fluidly coupled to the ambient air exterior of the tub 14, the ambient air enters the air supply circuit 180 along an inlet air pathway 222 as indicated by the arrow 222. Ambient air exits the air supply circuit 180 along an outlet air pathway 224 as indicated by the arrow 224 that extends along and above the top wall 146 and toward the front edge 150 and the door assembly 20. The arrow 160 indicates a process air pathway 160 along which the heated, humid air within the treating chamber 16 moves when the door assembly 20 is opened after a cycle of operation. Because the air supply circuit 180 is fluidly coupled to the ambient air exterior of the tub 14, the air supplied through the air supply circuit 180 has a lower temperature or a lower relative humidity than the heated, humid air within the treating chamber 16. Thus, the air supply circuit 180 can be thought of as a dry air supply circuit 180 comprising the dry air inlet 210, the dry air channel 214, the dry air outlet 212, and the dry air supply pathway 218.

Turning to the operation of the dry air supply circuit 180, the blower 220 is actuated to operate when a control signal is received from the controller 22. By way of non-limiting example, the controller 22 can be configured to operate the blower 220 when the door assembly 20 is unlatched, such as by an action of a user or due to the actuation of the door opener 26, which can automatically bias the door assembly 20 to a partially opened position at the completion of a cycle of operation. In this way, the dry air supply circuit 180 can be operated by provide a dry air supply that can serve as, for example, a barrier against the heated, humid air within the treating chamber 16.

When the blower 220 is operated, the blower 220 causes ambient air to be drawn from the exterior of the tub 14 into and through the blower 220 along the inlet air pathway 222 and through the dry air inlet 210. As the ambient air passes through the blower 220, the air is then pushed through the dry air channel 214 along the dry air supply pathway 218 to pass through the dry air outlet 212 along the outlet air pathway 224. Because the dry air outlet 212 faces toward the front edge 150, the dry air supplied along the outlet air pathway 224 is supplied toward the front edge 150. The increasing width of the dry air channel 214 and the dry air outlet 212 cause the dry air supply to widen out along the width of the dry air outlet 212, which allows the dry air to be supplied from the dry air supply circuit 180 along the wide and substantially flat shape of the dry air outlet 212. In this way, the dry air supplied from the dry air supply circuit 180 forms a shape that can be thought of as an air barrier, an air curtain, or an air blade, by way of non-limiting example, that can at least partially block or impede the heated, humid air escaping the treating chamber 16 along the process air pathway 160. In one example, the mixing of the dry air supplied along the outlet air pathway 224 and the heated, humid air flowing along the process air pathway 160 lowers the overall temperature and/or humidity of the escaping air relative to the temperature and humidity of the process air pathway 160. Additionally, or alternatively, the shape of the dry air supplied along the outlet air pathway 224 can also act as a barrier to deflect or redirect at least some of the heated, humid air flowing along the process air pathway 160 downwardly or outwardly, away from a user moving the door assembly 20 and away from the work surface 170 that may overlie the tub 14, and in particular the front edge 150 and the open face 18.

Figure 6:
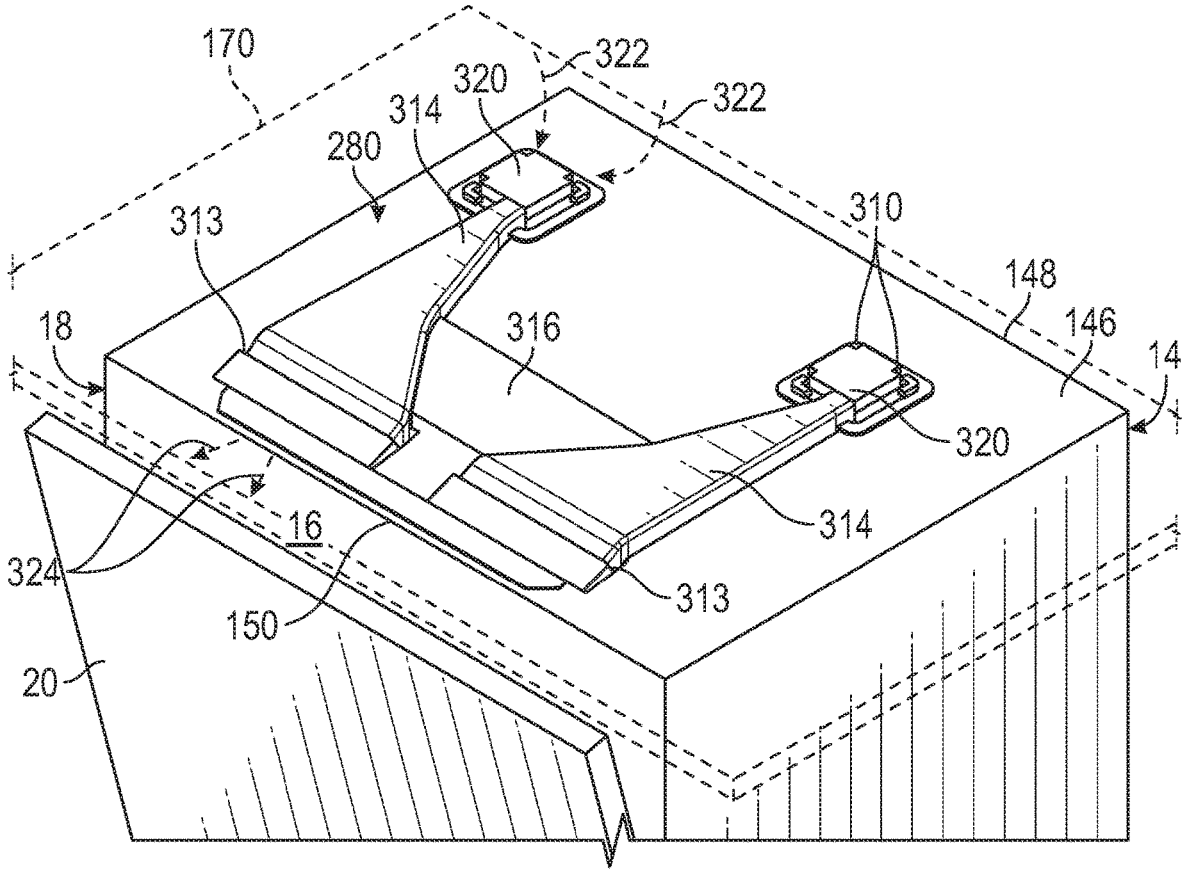
FIG. 6 is a top and right-side perspective view of another example of an air supply circuit for use with the air supply system of the dishwasher of FIG. 1.

FIG. 6 illustrates another example of a dry air supply circuit 280 for use with the air supply system 65 and the dishwasher 10 described herein that is similar to the dry air supply circuit 180 of FIGS. 4-5, and shares many of the same features and components as the dry air supply circuit 180, but differs in some aspects, such as in the location and structure of at least one dry air outlet 312. Therefore, elements of the dry air supply circuit 280 that are similar to those of the dry air supply circuit 180 are identified with numerals increased by 100, with it being understood that the description of the like parts of the dry air supply circuit 180 applies to the dry air supply circuit 280, unless otherwise noted. The air supply circuit 280 can be included within the air supply system 65 and the dishwasher 10 in addition to the previously described components of the drying system 80, without the need to replace or remove other parts of the drying system 80 as described.

The dry air supply circuit 280 is similar to the dry air supply circuit 180 in most aspects, but differs from the dry air supply circuit 180 in that the at least one dry air outlet 312 has a different position and structure relative to the tub 14. The arrangement and the description of at least one dry air inlet 310, an inlet air pathway 322, at least one blower 320, a majority of a body of at least one dry air channel 314, and a pair of dry air supply circuits 280 with the dry air channels 314 fluidly coupled to one another by an intermediate channel 316 extending between the dry air channels 314 is still the same and can be provided in the same manner as in the dry air supply circuit 180.

The dry air supply circuit 280 differs from the dry air supply circuit 180 in that the at least one dry air outlet 312, instead of being located above and overlying the top wall 146 and exterior to the tub 14 and the treating chamber 16, the at least one dry air outlet 312 at least partially passes through the top wall 146 of the tub 14 to be located within the tub 14 and within the treating chamber 16. The structure of the dry air channel 314 can be identical to that of the dry air channel 214 up until the end of the dry air channel 314, nearest the front edge 150 and opposite from the blower 320, that defines the dry air outlet 312. The dry air outlet 312 is still located at the upper portion 150 of the tub 14 and adjacent the upper portion 150 of the access opening, as defined by the open face 18 and the front edge 150. However, at the point of the dry air channel 314 at which the dry air outlet 312 is formed, the dry air outlet 312 curves slightly downward, resulting in the dry air outlet 312 at least partially protruding below the level of the top wall 146.

Accordingly, the top wall 146 of the tub 14 defines at least one outlet opening 313, such that one outlet opening 313 is provided corresponding to each dry air outlet 312. Each outlet opening 313 is sized and shaped accordingly with the corresponding dry air outlet 312 such that the dry air outlet 312 is received within the outlet opening 313 to allow the dry air outlet 312 to extend through the outlet opening 313 and protrude downwardly at least partially below the top wall 146 and into the treating chamber 16. Thus, the dry air outlet 312 is located at least partially below the top wall 146 of the tub 14, at least partially underlying the top wall 146 and located at least partially within the tub 14 and the treating chamber 16.

Figure 7:
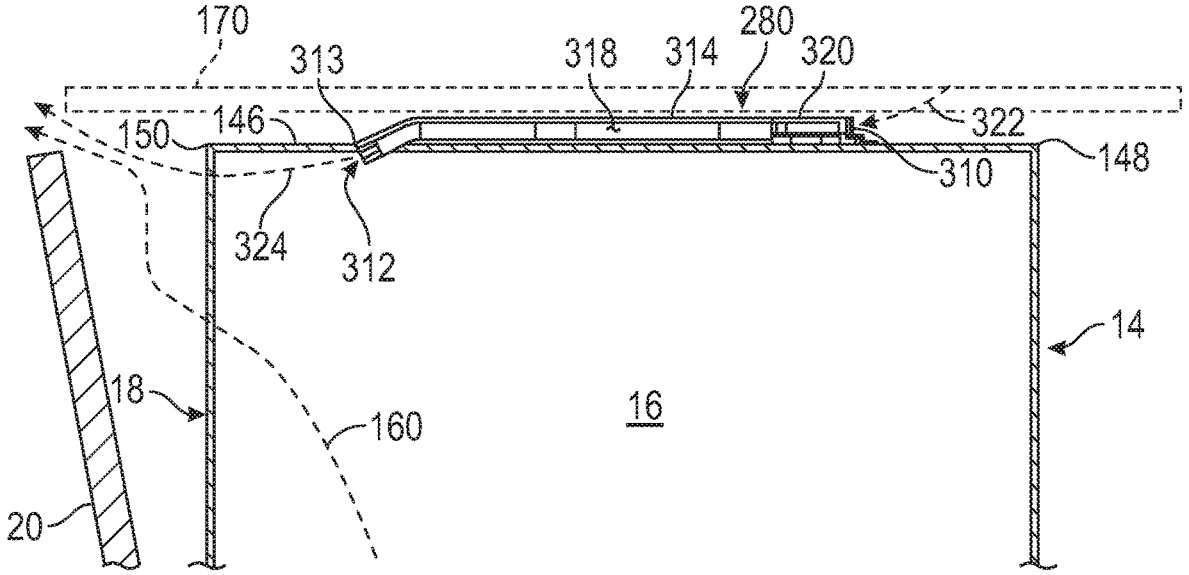
FIG. 7 is a right-side cross-sectional view of the air supply circuit of FIG. 6.

Turning now to FIG. 7, the dry air outlet 312 is received within the outlet opening 313 to extend into the treating chamber 16. Like the dry air outlet 212, the dry air outlet 312 is positioned so as to face toward the upper portion 150 of the access opening, as defined by the front edge 150, which can also be thought of as facing toward the door assembly 20 or facing toward the open face 18. The dry air channel 314 defines an interior 318 that defines the dry air supply pathway 318 for the dry air supply circuit 280. The ambient air exterior of the tub 14 enters the dry air supply circuit 280 along the inlet air pathway 322 as indicated by the arrow 322. Ambient air exits the dry air supply circuit 280 along an outlet air pathway 324 as indicated by the arrow 324 that extends along and below the top wall 146, within the tub 14 and within the treating chamber 16, and toward the front edge 150 and the door assembly 20. Although the air supplied through the dry air supply circuit 280 is now supplied into the treating chamber 16 where the heated, humid process air is present, the ambient air supplied still has a lower temperature or a lower level of relative humidity than the heated, humid air within the treating chamber 16. Thus, the air supply circuit 280 can still be thought of as the dry air supply circuit 280.

The operation of the dry air supply circuit 280 is very similar to the operation of the dry air supply circuit 180, except that the air that is pushed along the dry air supply pathway 318 to pass through the dry air outlet 312 along the outlet air pathway 324 is now supplied into the treating chamber 16. Because the dry air outlet 312 still faces toward the front edge 150, the dry air supplied along the outlet air pathway 324 is still supplied toward the front edge 150, but below the top wall 146 within the treating chamber 16, rather than above the top wall 146 as in the dry air supply circuit 180. The shape of the dry air supplied from the dry air supply circuit 280 can have the same shape, form, and function as in the dry air supply circuit 180 as the position, shape, and function relative to the heated, humid air flowing along the process air pathway 160 remains unchanged by the slightly changed position of the dry air outlet 312.

Figure 8:
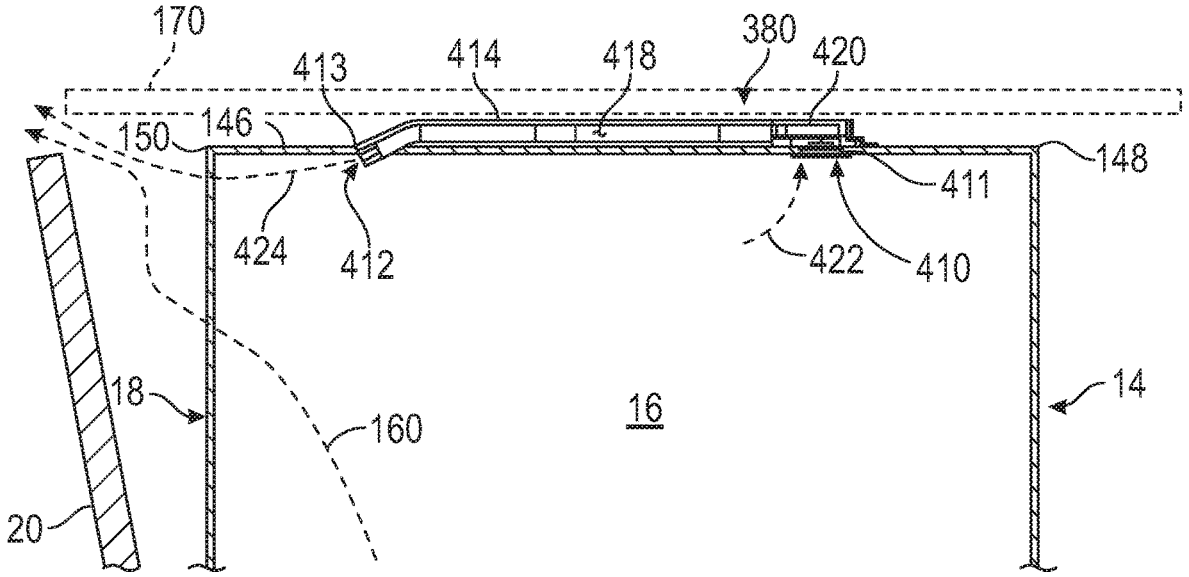
FIG. 8 is a right-side cross-sectional view of another example of an air supply circuit for use with the air supply system of the dishwasher of FIG. 1.

FIG. 8 illustrates another example of an air supply circuit, illustrated as an air circulation circuit 380, for use with the air supply system 65 and the dishwasher 10 described herein that is similar to the dry air supply circuit 280 of FIGS. 6-7, and shares many of the same features and components as the dry air supply circuit 280, but differs in some aspects, such as in the position and structure of a blower 420 and of at least one air inlet 410. Therefore, elements of the air circulation circuit 380 that are similar to those of the dry air supply circuit 280 are identified with numerals increased by 100, with it being understood that the description of the like parts of the dry air supply circuit 280 applies to the air circulation circuit 380, unless otherwise noted. The air circulation circuit 380 can be included within the air supply system 65 and the dishwasher 10 in addition to the previously described components of the drying system 80, without the need to replace or remove other parts of the drying system 80 as described.

The air circulation circuit 380 is similar to the dry air supply circuit 280 in many aspects, but differs from the dry air supply circuit 280 in that the blower 420 and the at least one air inlet 410, and therefore also an inlet air pathway 422, have a different position and structure relative to the tub 14 and to the top wall 146. The arrangement and the description of at least one air channel 414, an interior 418 that defines an air supply pathway 418, at least one air outlet 412, at least one outlet opening 413, an outlet air pathway 424 as indicated by the arrow 424, and the option of including a pair of air supply circuits 380 with the air channels 414 fluidly coupled to one another by an intermediate channel (not shown) extending between the air channels 414 is still the same and can be provided in the same manner as in the dry air supply circuit 280.

The air circulation circuit 380 differs from the dry air supply circuit 280 in that the blower 420, the at least one air inlet 410, and the inlet air pathway 422, instead of being located entirely above and overlying the top wall 146, exterior to the tub 14 and the treating chamber 16, and fluidly coupled to the ambient air surrounding the exterior of the tub 14, the at least one air inlet 410 is fluidly coupled instead to the treating chamber 16. With the at least one air inlet 410 fluidly coupled to the treating chamber 16, the at least one air inlet 410 at least partially passes through the top wall 146 of the tub 14 to be at least partially located within the tub 14 and within the treating chamber 16, in turn locating the inlet air pathway 422 entirely below the top wall 146 of the tub 14, within the tub 14 and within the treating chamber 16.

The blower 420 can be identical to the blower 320, entirely located above the top wall 146 and exterior to the tub 14, such that only the air inlet 410 passes through the top wall 146 to fluidly couple to the treating chamber 16, or the blower 420 can also have an altered position and structure relative to the tub 14 as compared to the blower 320, such that the blower 420 also at least partially passes through the top wall 146 of the tub 14 to be located at least partially within the tub 14 and within the treating chamber 16, along with the air inlet 410. The blower 420, whether or not it partially passes through the top wall 146 or is positioned entirely exterior to the tub 14, can still be coupled to the top wall 146 at least partially exterior of the tub 14, and further can still be positioned, by way of non-limiting example, at the rear portion of the top wall 146, near the rear edge 148, and therefore also at the rear portion and the upper portion of the tub 14. Likewise, the air inlet 410, regardless of partially passing through the top wall 146 to fluidly couple with the treating chamber 16, can still be positioned or located, by way of non-limiting example, at the rear portion of the top wall 146, near the rear edge 148, and therefore also at the rear portion and the upper portion of the tub 14.

Accordingly, whether it is only the air inlet 410 or whether it is both the air inlet 410 and the blower 420 that partially pass through the top wall 146, the top wall 146 of the tub 14 defines at least one inlet opening 411, such that one inlet opening 411 is provided corresponding to each air inlet 410. Each inlet opening 411 is sized and shaped accordingly with the corresponding air inlet 410, and optionally also the blower 420, such that the air inlet 410 is received within the inlet opening 411 to allow the air inlet 410 to extend at least partially through the inlet opening 411 and protrude downwardly at least partially below the top wall 146 and into the treating chamber 16. Thus, the air inlet 410 is located at least partially below the top wall 146 of the tub 14, at least partially underlying the top wall 146 and located at least partially within the tub 14 and the treating chamber 16 to fluidly couple to the treating chamber 16.

With the air inlet 410 no longer fluidly coupled to the ambient air exterior of the tub 14, it is instead process air from within the tub 14 and the treating chamber 16 that enters the air supply circuit 380 along the inlet air pathway 422 as indicated by the arrow 422. The process air exits the air supply circuit 380 along the outlet air pathway 424 that extends along and below the top wall 146, within the tub 14 and within the treating chamber 16, and toward the front edge 150 and the door assembly 20. The air supplied through the air circulation circuit 380 is now process air, rather than ambient air, that is the heated, humid process air that is both drawn from the treating chamber 16 and also supplied back into the treating chamber 16, so the air supplied through the air circulation circuit 380 is not dry air, but is rather the same heated, humid air already present within the treating chamber 16. Thus, the air circulation circuit 380 is not thought of as a dry air supply circuit 180, 280.

The operation of the air circulation circuit 380 is very similar to the operation of the dry air supply circuit 280, except that the air is drawn from the treating chamber 16 and is not dry air, but is the same temperature and level of relative humidity as the rest of the process air within the treating chamber 16. However, the air supplied along the outlet air pathway 424 is still supplied toward the front edge 150 with a force from the blower 420 and the shape of the air supplied from the air circulation circuit 380 has the same shape, form, and barrier function as in the dry air supply circuits 180, 280 relative to the heated, humid air flowing along the process air pathway 160. Therefore, while air supplied from the air circulation circuit 380 is not dry air, the shape and force of movement of the air supplied from the air circulation circuit 380 can still be effective in acting as a barrier to deflect or redirect at least some of the heated, humid air from the process air pathway 160 downwardly or outwardly, keeping the high moisture content away from the work surface 170, and thus can still provide a benefit. While the benefit may not be as significant as the dry air supplied from the dry air supply circuits 180, 280, the air circulation circuit 380 also offers the benefit of not requiring the air inlet 210, 310 in constant fluid communication with the ambient air.

Figure 9:
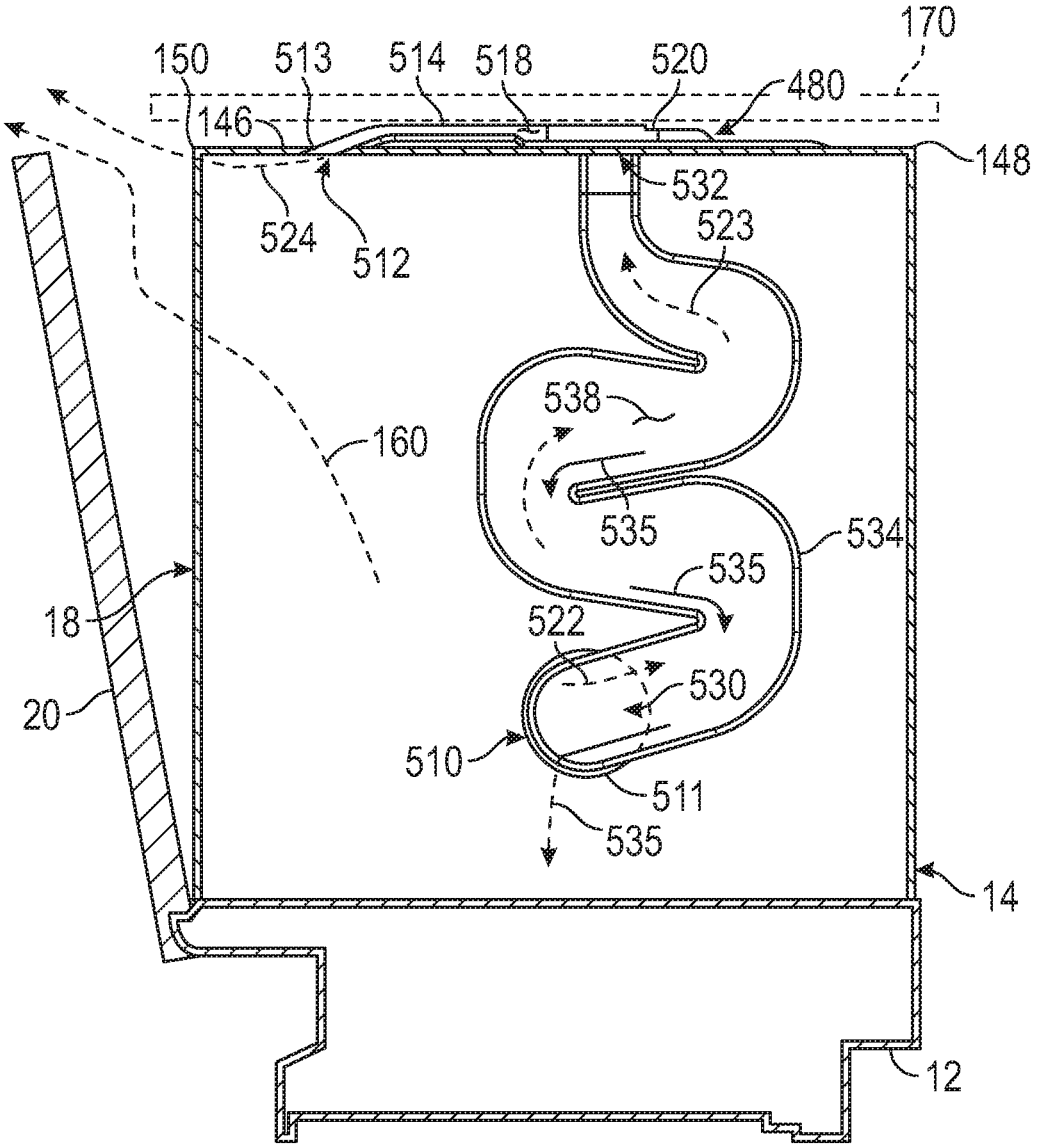
FIG. 9 is a schematic right-side view of another example of an air supply circuit for use with the air supply system of the dishwasher of FIG. 1.

FIG. 9 illustrates another example of a dry air supply circuit, illustrated as a cooling air supply circuit 480, for use with the air supply system 65 and the dishwasher 10 described herein that is similar to the air circulation circuit 380 of FIG. 8, and shares many of the same features and components as the air circulation circuit 380, but differs in some aspects, such as in the position of an air inlet 510 and an inlet air pathway 522, and in the addition of a cooling assembly 534. Therefore, elements of the air supply circuit 480 that are similar to those of the air circulation circuit 380 are identified with numerals increased by 100, with it being understood that the description of the like parts of the air circulation circuit 380 applies to the cooling air supply circuit 480, unless otherwise noted. The air supply circuit 480 can be included within the air supply system 65 and the dishwasher 10 in addition to the previously described components of the drying system 80, without the need to replace or remove other parts of the drying system 80 as described.

The cooling air supply circuit 480 is similar to the air circulation circuit 380 in several aspects, but differs from the air circulation circuit 380 in that the air inlet 510, and therefore also the inlet air pathway 522, have a different position relative to the tub 14 and to the top wall 146, and also in that the cooling air supply circuit 480 includes the cooling assembly 534 that is not present in the air circulation circuit 380. The arrangement and the description of a blower 520, a cooling air channel 514, an interior 518 that defines a cooling air supply pathway 518, a cooling air outlet 512, an outlet opening 513, and an outlet air pathway 524 as indicated by the arrow 524 is still the same and can be provided in the same manner as in the air circulation circuit 380.

The cooling air supply circuit 480 differs from the air circulation circuit 380 in that the air inlet 510, and therefore also the inlet air pathway 522, instead of being located at the top wall 146, at the upper and rear portion of the tub 14, and immediately adjacent the blower 520, the air inlet 510 and the inlet air pathway 522 are instead located at one of the side walls 140, at a lower portion of the tub 14, and spaced from the blower 520. The cooling air supply circuit 480 further comprises the cooling assembly 534, with the air inlet 510 and the inlet air pathway 522 positioned in this way and spaced from the blower 520 in order to accommodate the inclusion of the cooling assembly 534, which was not included in the air circulation circuit 380. As in the air circulation circuit 380, both the air inlet 510 and the inlet air pathway 522 at least partially pass through the tub 14 to fluidly couple to the treating chamber 16, with an inlet opening 511 corresponding with the air inlet 510 such that the air inlet 510 is received within the inlet opening 511. However, rather than being provided in the top wall 146, the air inlet 510, the inlet opening 511, and the inlet air pathway 522 are provided at one of the side walls 140, and specifically such that the side wall 140 defines the inlet opening 511 that receives the air inlet 510 and through which the air inlet 510 and the inlet air pathway 522 partially pass through and are fluidly coupled through to a lower portion of the tub 14 and the treating chamber 16.

The cooling assembly 534 is positioned in the space that the air inlet 510, the inlet opening 511, and inlet air pathway 522 are spaced from the blower 520 by. The cooling assembly 534 is thermally coupled to the air that passes through the cooling air supply circuit 480 and further is configured to cool the air passing through the cooling air supply circuit 480. The cooling assembly 534 is provided herein as a conduit 534, and specifically a serpentine conduit 534, though it will be understood that the serpentine shape is not limiting. The cooling assembly 534, and specifically the serpentine conduit 534, at least partially define a cooling pathway 538. The cooling pathway 538 can be any suitable type of cooling pathway 538 within which the air that is to pass through the cooling air supply circuit 480 can be cooled. Non-limiting examples of such a cooling pathway 538 include at least one of a condensing pathway, an air-cooled pathway or air channel, and/or a water-cooled pathway or air channel.

The cooling assembly 534 and the cooling pathway 538 are fluidly coupled to the air inlet 510 and to the inlet air pathway 522, and thus also to the treating chamber 16. Specifically, the serpentine conduit 534 defines an inlet 530, which can be thought of as comprising a cooling pathway inlet 530, and an outlet 532, which can be thought of as comprising a cooling pathway outlet 532. The cooling pathway inlet 530 is fluidly coupled to the treating chamber 16 at the inlet opening 511, which also defines the air inlet 510, as well as therefore the inlet air pathway 522. In this way, the air inlet 510 to the cooling air supply circuit 480 also forms the cooling pathway inlet 530 to the cooling assembly 534 such that the cooling assembly 534 is fluidly and thermally coupled with the air supply of the cooling air supply circuit 480.

Further, the cooling pathway outlet 532 is fluidly coupled with the cooling air channel 514 at the blower 520, such that the serpentine conduit 534 extends along the side wall 140 between the air inlet 510 and the blower 520, as well as the cooling air supply pathway 518. In this way, the cooling assembly 534 and the cooling pathway 538 are at least partially coextensive with the cooling air supply circuit 480, and specifically with the cooling air channel 514. The cooling air channel 514 can be thought of as extending between the air inlet 510 and the cooling air outlet 512, such that the cooling air channel 514 comprises the cooling air supply pathway 518, the blower 520, and additionally the serpentine conduit 534, with the blower 520 being located within the cooling air channel 514 rather than at the air inlet 510. In this way, the cooling pathway 538 can be thought of as being defined by at least a portion of the cooling air channel 514.

Turning now to the operation of the cooling assembly 534 and the cooling air supply circuit 480, the cooling assembly 534 and the cooling pathway 538 can be cooled by any suitable approach that allows for air passing through the cooling pathway 538 to the cooling air supply pathway 518 to be cooled. By way of non-limiting example, the serpentine conduit 534 can be cooled by air, can be cooled by water, such as by being surrounding by or within a water tank, or can be cooled via other condensing methods, such as by the use of a condenser or a heat exchanger. Regardless of the method of cooling that is used, when the controller 22 operates the blower 520, heated, humid process air within the treating chamber 16 is drawn to enter the cooling air supply circuit 480 at the air inlet 510 along the inlet air pathway 522, thereby also entering into the cooling pathway 538 through the cooling pathway inlet 530. As the heated, humid process air travels upwardly from the air inlet 510 toward the blower 520, moisture condenses out of the heated, humid process air within the cooling pathway 538, creating a liquid flow path 535 as indicated at the arrows 535. The condensed liquid within the cooling pathway 538 flows downwardly, back toward the air inlet 510, due to gravity. The condensed liquid will flow from the cooling pathway 538 back through the air inlet 510 and into the treating chamber 16, where it can be gathered in the sump 51. As the moisture condenses out of the heated, humid process air in the cooling pathway 538, the temperature of the air decreases somewhat and becomes less humid, forming a cooling air supply as indicated by the arrow 523. The cooling air supply 523 is drawn through the cooling pathway outlet 532, through the blower 520, and then pushed through the cooling air supply pathway 518 to reach the cooling air outlet 512 and flow into the treating chamber 16 along the outlet air pathway 524 to be provided toward the front edge 150 as described previously with respect to FIGS. 6-8.

While the previous air supply circuits 180, 280, 380 were described for being provided within the air supply system 65 in addition to the components of the drying system 80 that were already introduced with respect to FIG. 2, the cooling air supply circuit 480, and in particular the cooling assembly 534, could optionally be provided as a replacement for a portion of the drying system 80, rather than in addition to the drying system 80. With respect to FIG. 2, the drying system 80 was described as having the condenser 82 formed of the serpentine conduit 83 with the inlet at the upper portion of the tub 14 and the outlet at the lower portion of the tub 14. The cooling assembly 534 of the cooling air supply circuit 480 instead discloses the cooling pathway inlet 530 at the lower portion of the tub 14, with the cooling pathway outlet 532 at the upper portion of the tub 14. Thus, if it were desired to replace the condenser 82, serpentine conduit 83, and cooling tank 84 of the dishwasher 10 with the cooling assembly 534 of FIG. 9 and as coupled with the cooling air supply circuit 480, the direction of the air supply would simply need to be switched. Alternatively, the cooling air supply circuit 480 could be provided in addition to the condenser 82, serpentine conduit 83, and cooling tank 84 of the dishwasher 10, such as by providing the cooling assembly 534 on a different wall of the tub 14.

Figure 10:
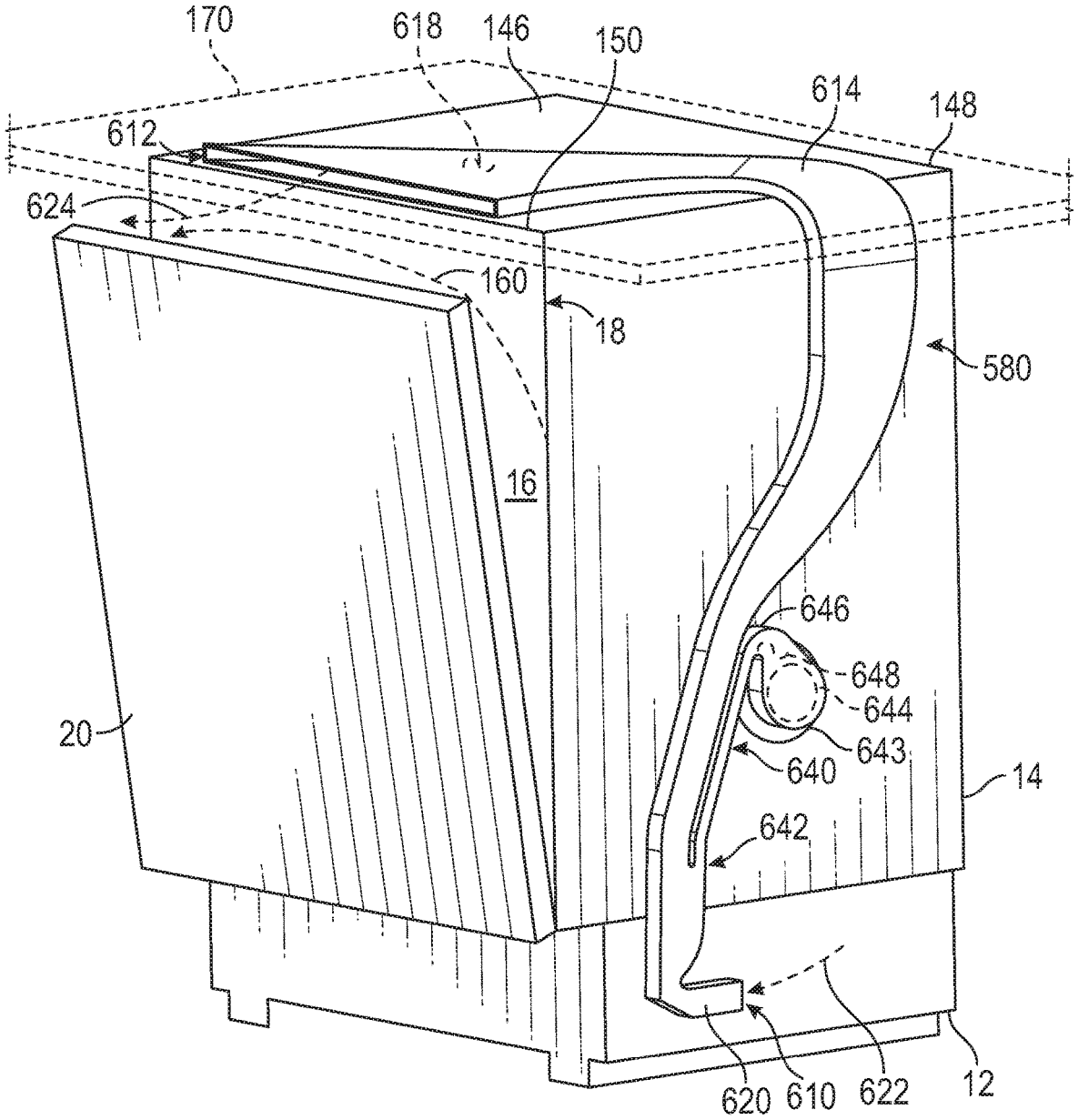
FIG. 10 is a schematic right-side perspective view of another example of an air supply circuit for use with the air supply system of the dishwasher of FIG. 1.

FIG. 10 illustrates another example of a dry air supply circuit 580 for use with the air supply system 65 and the dishwasher 10 described herein that is similar to the dry air supply circuit 180 of FIGS. 4-5, and shares many of the same features and components as the dry air supply circuit 180, but differs in some aspects, such as in the location and structure of a dry air inlet 610 and a dry air channel 614, as well as in the inclusion of a second dry air supply branch 640. Therefore, elements of the dry air supply circuit 580 that are similar to those of the dry air supply circuit 180 are identified with numerals increased by 400, with it being understood that the description of the like parts of the dry air supply circuit 180 applies to the dry air supply circuit 580, unless otherwise noted. The air supply circuit 580 can be included within the air supply system 65 and the dishwasher 10 in addition to the previously described components of the drying system 80, without the need to replace or remove other parts of the drying system 80 as described.

The dry air supply circuit 580 is similar to the dry air supply circuit 180 in some aspects, but differs from the dry air supply circuit 180 in that the dry air inlet 610 has a different position relative to the tub 14 and relative to a dry air outlet 612, that the dry air channel 614 has a different position and structure relative to the tub 14 to accommodate the relative positions of the dry air inlet 610 and the dry air outlet 612, and also that the dry air supply circuit 580 includes the second dry air supply branch 640 that is not present in the dry air supply circuit 180. The arrangement and the description of the general structure of the dry air outlet 612 and its position relative to the front edge 150, of the position of the dry air inlet 610 relative to the position of the blower 620, and of the general order of the supply of air from the dry air inlet 610 to the dry air outlet 612 through the dry air channel 614 is still substantially the same and can be provided in the same manner as in the dry air supply circuit 180.

While the dry air supply circuit 580 differs quite a bit from the dry air supply circuit 180 in the overall visual structure, the underlying principles and steps of operation are consistent with the dry air supply circuit 180, such that the changes can be easily understood. Instead of the dry air supply circuit 580 being provided entirely along a single wall 140, 142, 144, 146 of the tub 14, such as the top wall 146, the dry air supply circuit 580 extends along more area of the dishwasher 10, but otherwise operates very similarly to the dry air supply circuit 180, aside from the inclusion of the second dry air supply branch 640. A blower 620, instead of being coupled to and overlying the top wall 146, is located at a lower portion of the dishwasher 10, and specifically is located even below the tub 14, instead positioned with the base 12. As illustrated herein, and by way of non-limiting example, the blower 620 is further positioned at a front portion of the dishwasher 10 and the tub 14, nearer to the front edge 150 than to the rear edge 148, and in addition to being provided at a lower portion of the dishwasher 10, within the base 12. Despite a very different position as compared to the blower 220 in the dry air supply circuit 180, the blower 620 still at least partially defines the dry air inlet 610 and is fluidly coupled to the ambient air exterior of the tub 14 by the dry air inlet 610.

The dry air channel 614 still extends between the blower 620 and the dry air outlet 612 and interacts with other components in a similar way, but instead of being provided along a single wall 140, 142, 144, 146 of the tub 14, such as the top wall 146, the dry air channel 614 has a lengthened structure. Specifically, the dry air channel 614 extends from the blower 620 at a lower front portion of the base 12 generally diagonally along one of the side walls 140, extending from the front edge 150 to the rear edge 148 of the side wall 140 as it also moves from the base 12 to the upper portion of the tub 14 along the top wall 146. The dry air channel 614 then further extends away from the rear edge 148 and toward the front edge 150 to define the dry air outlet 212, the dry air channel 614 increasing in width toward the dry air outlet 612 and toward the front edge 150. In this example, the dry air channel 614 defines a single dry air outlet 612 that extends along a majority of the width of the top wall 146 and is positioned near the front edge 150. As in the dry air supply circuit 180, the dry air outlet 612 is positioned at the upper portion 150 of the tub 14 and adjacent the upper portion 150 of the access opening, as defined by the open face 18 and the front edge 150, and further the dry air outlet 612 is located above the top wall 146 of the tub 14, overlying the top wall 146, located exterior to the tub 14 and the treating chamber 16, and facing toward the front edge 150.

In addition to the dry air channel 614 defining an interior 618 that defines a dry air supply pathway 618, into which ambient air enters along an inlet air pathway 622 as indicated by the arrow 622 and out of which ambient air exits through the dry air outlet 612 along an outlet air pathway 624 as indicated by the arrow 624 to interact with the heated, humid air of the process air pathway 160 as described with respect to FIGS. 4-5, the dry air supply circuit 580 further comprises the second dry air supply branch 640. The second dry air supply branch 640 can be thought of as a branch 640 off of the main dry air supply circuit 580 and dry air channel 614, with the second dry air supply branch 640 defining a second dry air outlet 644, which can be thought of as a supply branch outlet 644, for the dry air supply circuit 580.

The second dry air supply branch 640 defines a supply branch inlet 642 that splits off from and is fluidly coupled to the dry air channel 614 and the dry air supply pathway 618. A supply branch channel 646 extends between and fluidly couples the supply branch inlet 642 to the supply branch outlet 644 and also defines an interior 648 that can be thought of as defining a supply branch pathway 648. The supply branch outlet 644 is received within an outlet opening 643 defined within the side wall 140, through which the supply branch outlet 644 is fluidly coupled to the treating chamber 16, and in particular at a lower portion of the tub 14 and treating chamber 16. While the dry air supply circuit 580 is illustrated herein as only including the single blower 620, it will be understood that this is not limiting. For example, with the two dry air outlets 612, 644, it may be desirable to provide a blower 620 to be associated with each of the dry air channel 614 and the supply branch channel 646 to selectively control, by the controller 22, which of the dry air outlets 612, 644 the dry air should be supplied to.

Turning to the operation of the dry air supply circuit 580, operation of the blower 620 by the controller 22 draws in ambient air through the dry air inlet 610 along the inlet air pathway 622 to be drawn through the blower 620, then pushed through the dry air supply pathway 618 of the dry air channel 614 to exit through the dry air outlet 612 along the outlet air pathway 624 to form an air barrier, an air curtain, or an air blade to interact with the heated, humid air of the process air pathway 160 as previously described. In one example, a second blower (not shown) can be provided and fluidly coupled with the second dry air supply branch 640 such that when the blower 620 is operated, dry air flows to the dry air outlet 612, and when the second blower is operated, dry air flows to the supply branch outlet 644. However, it will be understood that the selective supplying of dry air to either or both of the dry air outlets 612, 644 can be accomplished by any suitable means, non-limiting examples of which include an additional blower 620 or a valve assembly. The inclusion of the second dry air outlet 644 to provide dry air to the lower portion of the treating chamber 16 can improve performance of the dry air supply circuit 580 both by reducing the overall humidity within the treating chamber 16 by supplying fresh, dry ambient air, as well as by adding air to the treating chamber 16 to increase pressure within the treating chamber 16 to improve venting performance when the door assembly 20 is opened.

Figure 11:
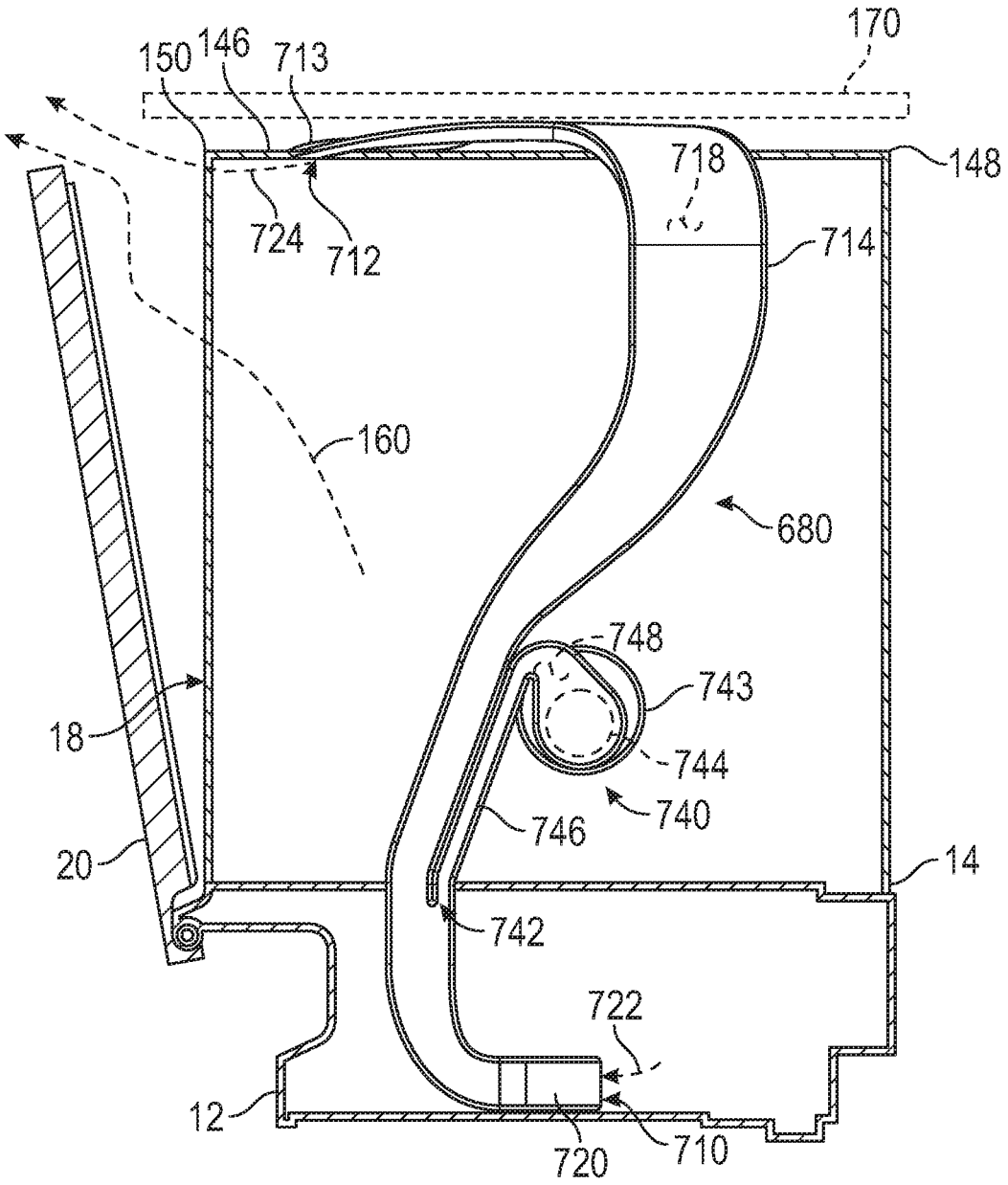
FIG. 11 is a schematic right-side view of another example of an air supply circuit for use with the air supply system of the dishwasher of FIG. 1.

FIG. 11 illustrates another example of a dry air supply circuit 680 for use with the air supply system 65 and the dishwasher 10 described herein that is similar to the dry air supply circuit 580 of FIG. 10, and shares many of the same features and components as the dry air supply circuit 580, but differs in some aspects, such as in the location and structure of at least one dry air outlet 712. Therefore, elements of the dry air supply circuit 680 that are similar to those of the dry air supply circuit 580 are identified with numerals increased by 100, with it being understood that the description of the like parts of the dry air supply circuit 580 applies to the dry air supply circuit 680, unless otherwise noted. The air supply circuit 680 can be included within the air supply system 65 and the dishwasher 10 in addition to the previously described components of the drying system 80, without the need to replace or remove other parts of the drying system 80 as described.

The dry air supply circuit 680 is similar to the dry air supply circuit 580 in nearly all aspects, but differs from the dry air supply circuit 580 in that the dry air outlet 712 passes through the top wall 146 as it is received within an outlet opening 713 defined by the top wall 146 in order to locate the dry air outlet 712 within the treating chamber 16, instead of being positioned above the top wall 146 exterior to the tub 14. The arrangement and the description of a dry air inlet 710, an inlet air pathway 722, at least one blower 720, a majority of a body of a dry air channel 714 defining a dry air supply pathway 718, and as well as a second dry air supply branch 740, including a supply branch inlet 742, a supply branch channel 746, a supply branch outlet 744, a supply branch pathway 748, and a corresponding outlet opening 743, is still the same and can be provided in the same manner as in the dry air supply circuit 580. Further, the only parts of the dry air supply circuit 680 that differ from the dry air supply circuit 580, namely the dry air outlet 712, the outlet opening 713, and an outlet air pathway 724, are instead identical to the same features of the dry air supply circuit 280 of FIGS. 6-7 and are the same differences that were described with respect to the dry air supply circuit 280 of FIGS. 6-7 as compared to the dry air supply circuit 180 of FIGS. 4-5.

Figure 12:
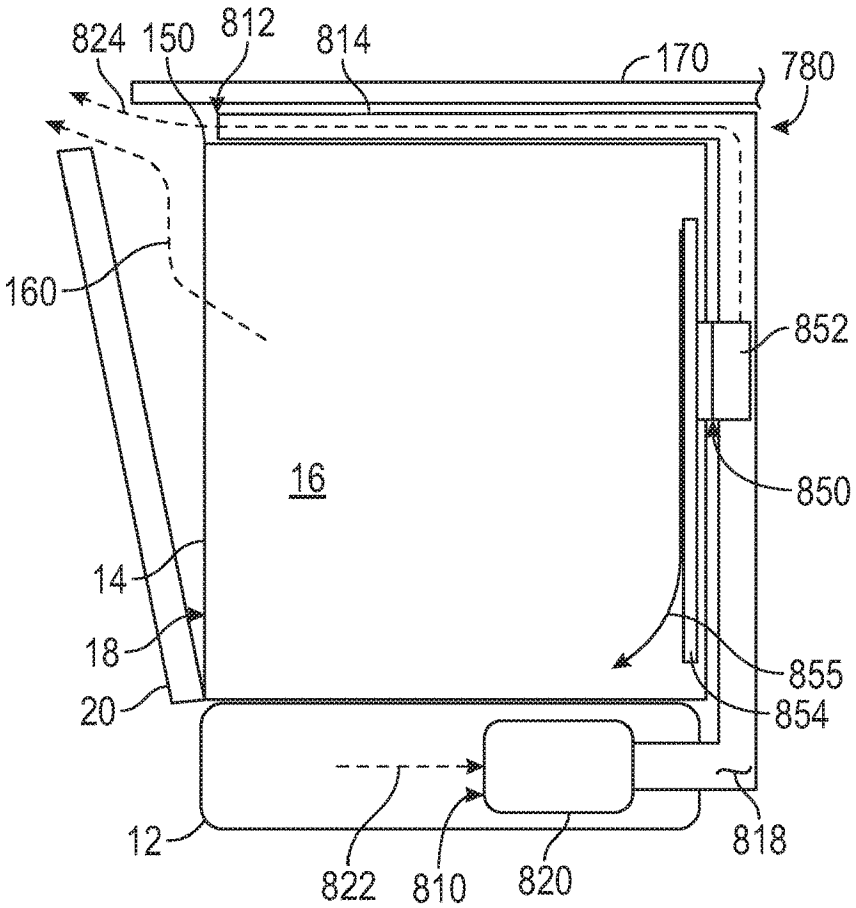
FIG. 12 is a schematic right-side view of another example of an air supply circuit for use with the air supply system of the dishwasher of FIG. 1.

FIG. 12 illustrates another example of an air supply circuit, illustrated as a dry air supply circuit 780, for use with the air supply system 65 and the dishwasher 10 described herein that is similar to the cooling air supply circuit 480 of FIG. 9, and shares many of the same features and components as the cooling air supply circuit 480, but differs in some aspects, such as in the location of an air inlet 810 and an inlet air pathway 822, as well as in the aspects of a cooling assembly 850. Therefore, elements of the dry air supply circuit 780 that are similar to those of the cooling air supply circuit 480 are identified with numerals increased by 300, with it being understood that the description of the like parts of the cooling air supply circuit 480 applies to the dry air supply circuit 780, unless otherwise noted. The dry air supply circuit 780 can be included within the air supply system 65 and the dishwasher 10 in addition to the previously described components of the drying system 80, without the need to replace or remove other parts of the drying system 80 as described.

The dry air supply circuit 780 is similar to the cooling air supply circuit 480 in some aspects, but differs from the cooling air supply circuit 480 in that the air inlet 810, and therefore also the inlet air pathway 822, have a different location relative to the tub 14 and to the treating chamber 16, in that an air outlet 812, and therefore also an outlet air pathway 824, have a different position relative to the tub 14 and to the top wall 146, and also in that the dry air supply circuit 780 includes the cooling assembly 850 that differs from the cooling assembly 534 of the cooling air supply circuit 480. Although the cooling assembly 850 differs from the cooling assembly 534 of the cooling air supply circuit 480, the arrangement of the cooling assembly 850 that is located at least partially within an air channel 814 and at least partially within an interior 818 that defines an air supply pathway 818, and is also thermally coupled with the air channel 814 and the air supply pathway 818 is an aspect that is still the same, despite the differing implementations.

The dry air supply circuit 780 differs from the cooling air supply circuit 480 in that the air inlet 810, and therefore also the inlet air pathway 822, instead of being located at a lower portion of the tub 14, the air inlet 810 and the inlet air pathway 822 are instead located at a lower portion of the dishwasher 10, and specifically are located even below the tub 14 and the treating chamber 16, instead located within or coupled to the base 12. A blower 820, rather than being spaced from the air inlet 810 as in the cooling air supply circuit 480, is instead also located with the base 12 and provided directly with the air inlet 810 and the inlet air pathway 822, such that the blower 820 can at least partially define the air inlet 810. As illustrated herein, and by way of non-limiting example, the air inlet 810, the inlet air pathway 822, and the blower 820 are located with the base 12 and further are positioned at a rear portion of the dishwasher 10, nearer to the rear edge 148 than to the front edge 150, though it will be understood that any suitable position within the base 12 can be used. Further differing from the cooling air supply circuit 480, the air inlet 810 and the blower 820 are fluidly coupled to the ambient air exterior of the tub 14.

The air channel 814, and thus also the air supply pathway 818, extends between the blower 820 and the air outlet 812. As illustrated herein, and by way of non-limiting example, with the blower 820 located with the base 12, the air channel 814 extends from the blower 820 out of the base 12, upwardly along the rear wall 144 from the base 12 to the rear edge 148 of the top wall 146, then forwardly along the top wall 146 from the rear edge 148 toward the front edge 150 to define the air outlet 812. However, it will be understood that the air channel 814 is not limited to the position along the rear wall 144 and the top wall 146, but could instead be provided along another portion of the tub 14, such as along one of the side walls 140 rather than the rear wall 144.

As the air channel 814 extends toward the front edge 150 to define the air outlet 812, the air channel 814 can have a constant width or can increase in width toward the air outlet 812 and toward the front edge 150. Further, the air channel 814 can extend toward and define only the single air outlet 812 or multiple air outlets 812. Regardless of the number and size of the air outlets 812, the air outlet 812 is positioned at the upper portion 150 of the tub 14 and adjacent the upper portion 150 of the access opening, as defined by the open face 18 and the front edge 150. Further, the air channel 814 and the air outlet 812 are located entirely above the top wall 146 of the tub 14, overlying the top wall 146 and underlying the work surface 170 such that it is between the top wall 146 and the work surface 170, located exterior to the tub 14 and the treating chamber 16, and facing toward the front edge 150 and directing the outlet air pathway 824 toward the front edge 150.

The cooling assembly 850 is provided with the air channel 814 at a position between the blower 820 and the air outlet 812. As illustrated herein, the cooling assembly 850 is positioned along at least a portion of the rear wall 144. While the cooling assembly 534 of the cooling air supply circuit 480 was provided to simply cool the air within the serpentine conduit 534, the cooling assembly 850 can be more specifically thought of as a heating and cooling assembly 850 comprising a hot side 852, provided herein as a heating surface 852, and a cold side 854, provided herein as a cooling surface 854, with the heating and cooling assembly 850 thermally coupled to the dry air supply circuit 780, such that at least one of the heating surface 852 and the cooling surface 854 are thermally coupled to the dry air supply circuit 780. The heating surface 852 and the cooling surface 854 can be provided as, but are not limited to, opposing surfaces 852, 854 of the thermoelectric device 850. It will be understood that it is within the scope of the present disclosure that both the heating surface 852 and the cooling surface 854 can be thermally coupled to the dry air supply circuit 780, such as to different portions of the dry air supply circuit 780, that one of the heating surface 852 and the cooling surface 854 can be thermally coupled to the dry air supply circuit 780 while the other of the heating surface 852 and the cooling surface 854 is not thermally coupled to another component of the dishwasher 10, or that one of the heating surface 852 and the cooling surface 854 can be thermally coupled to the dry air supply circuit 780 while the other of the heating surface 852 and the cooling surface 854 is thermally coupled to another portion of the dishwasher 10.

In one example, and as illustrated herein, the heating and cooling assembly 850 is provided as a thermoelectric device 850. In a simple example, such a thermoelectric device 850 can be any thermoelectric device 850 that can be configured to input voltage or current in order to output thermal energy to generate the heating surface 852 and the cooling surface 854. More specifically, operation of the thermoelectric device 850, such as by way of operable coupling with the controller 22, results in the thermoelectric device 850 having one side, such as the hot side 852, that has a higher temperature, such as a temperature higher than the ambient starting temperature of the thermoelectric device 850 prior to operation, while the other side, such as the cold side 854, has a lower temperature, such as a temperature that is lower than the ambient starting temperature of the thermoelectric device 850 prior to operation. Non-limiting examples of suitable heating and cooling assemblies 850 include a Peltier device or Peltier segment, an other type of thermoelectric device or thermoelectric segment, or any heat exchanger having a cooling surface and a heating surface, such that operation results in the hot side 852 that can act as the heating surface 852 and the cold side 854 that can act as the cooling surface 854.

While the thermoelectric device 850 can be as simple as the thermoelectric device 850 having the hot side 852 defining the heating surface 852 and the cold side 854 defining the cooling surface 854, it will also be understood that the heating surface 852 and the cooling surface 854 can also comprise various additional structures or configurations that can be provided as, coupled with, adjacent to, or abutting the thermoelectric device 850 to form or otherwise act as at least a portion of a thermal interface between the thermoelectric device 850 and various aspects of the dishwasher 10. The heating surface 852 and the cooling surface 854 can comprise any suitable thermally conductive structure or surface that can thermally couple with the thermoelectric device 850 in order to transfer thermal energy from the thermoelectric device 850 to a portion of the dishwasher 10, such as the dry air supply circuit 780. By way of non-limiting example, such suitable structures or surfaces to serve as the heating surface 852 or the cooling surface 854 include a plurality of fins, such as radiator fins, a water-cooled radiator structure, a contact surface itself that the thermoelectric device 850 abuts, or a panel or wall.

As illustrated in the present example, the thermoelectric device 850 has the heating surface 852 that is thermally coupled to the air channel 814 and the air supply pathway 818, while the cooling surface 854 is thermally coupled to the tub 14 and the treating chamber 16. In one example, the heating surface 852 can comprise a set of heating surface fins 852, such as radiator fins, that are coupled with the air channel 814 such that the heating surface fins 852 extend into and are at least partially received within the air channel 814 and the air supply pathway 818 to provide increased surface area to thermally couple to the air supply pathway 818. Further, the cooling surface 854 can comprise a cooling wall 854, such as a thermally conductive sheet or panel, that is coupled with the tub 14, and specifically with the rear wall 144, such that the cooling wall 854 is at least partially received within the tub 14 and the treating chamber 16 to provide increased surface area to thermally couple to the treating chamber 16. While the cooling wall 854 is illustrated herein as having a larger surface area than the thermoelectric device 850, it will be understood that the cooling wall 854 can have any suitable size, such that it can be the same shape and surface area as the thermoelectric device 850, or can be co-extensive with a portion of or with all of the rear wall 144.

By providing the heating surface fins 852 that extend from the thermoelectric device 850 and into the air channel 814, along with the cooling wall 854 that extends from the thermoelectric device 850 and into the treating chamber 16, improved thermal contact for thermal transfer between the thermoelectric device 850 and each of the air supply pathway 818 and the treating chamber 16 can be realized, both due to the positioning of the heating surface 852 and the cooling surface 854 within the air supply pathway 818 and the treating chamber 16, respectively, and also due to the increased surface area of each of the heating surface fins 852 and the cooling wall 854 relative to the thermoelectric device 850 itself. However, it will still be understood that such an arrangement is not limiting and that both the heating surface 852 and the cooling surface 854 can comprise any suitable surface or structure, such as that both the heating surface 852 and the cooling surface 854 can comprise sets of fins or a thermally conductive panel or wall. Further, the thermoelectric device 850 can be provided without any of these structures like the fins or the wall, with the thermoelectric device 850 provided between and abutting the tub 14 and the air channel 814 and the contact with the thermoelectric device 850 itself defining the heating surface 852 and the cooling surface 854. For example, the thermoelectric device 850 can directly contact the rear wall 144, with the rear wall 144 having at least a portion that is thermally conductive, such that at least a portion of the rear wall 144 itself acts as the cooling wall 854.

It will also be understood that more than one thermoelectric device 850 can be provided to further increase the surface area for thermal transfer between the thermoelectric device 850 and at least a portion of the air channel 814 or another portion of the dishwasher 10, such as the treating chamber 16. Further, the thermoelectric device 850, or even a plurality of thermoelectric devices 850 can be provided at any suitable position along the air supply pathway 818, including at any suitable position on the rear wall 144, the top wall 146, or the side walls 140 in the case that the air channel 814 extends along the side wall 140. Essentially, the at least one thermoelectric device 850 can be provided at any suitable location such that the thermoelectric device 850 is thermally coupled at least to the air supply circuit 780.

Turning now to the operation of the dry air supply circuit 780, when the controller 22 operates the blower 820, ambient air is drawn along the inlet air pathway 822 and through the air inlet 810 and blower 820 into the air supply pathway 818. The ambient air is flowed along the air supply pathway 818, past the heating surface 852, and toward the air outlet 812 to exit through the air outlet 812 along the outlet air pathway 824. The outlet air pathway 824 directs the air supplied to flow between the top wall 146 and the work surface 170, toward the front edge 150. When the controller 22 operates the thermoelectric device 850, the thermoelectric device 850 heats the heating surface 852 and cools the cooling wall 854. When this operation of the thermoelectric device 850 occurs at the same time that the blower 820 is operated, the ambient air supplied from the blower 820 flows over the heating surface 852 and is heated relative to the ambient temperature, though not as hot as the heated, humid air within the treating chamber 16. At the same time, the thermoelectric device 850 cools the cooling wall 854, which, in turn, causes cooling of the air within the treating chamber 16 that contacts the cooling wall 854. The cooling of the heated, humid air by the cooling wall 854 within the treating chamber 16 causes condensation to occur within the treating chamber 16 along the cooling wall 854, creating a condensed liquid flow 855 as indicated at the arrow 855 that flows downwardly along the cooling wall 854 and the tub 14 to collect in the sump 51.

The air flow of the air supply pathway 818 over the heating surface 852 serves to absorb heat from the heating surface 852, thereby drawing heat away from the heating surface 852 and the thermoelectric device 850 and into the ambient air supplied to the heating surface 852. Removing that heat from the heating surface 852 and from the thermoelectric device 850 results in improved performance of the thermoelectric device 850, such that more cooling of the cooling wall 854 can then occur, thereby improving condensation performance within the treating chamber 16. Though this does result in the ambient air in the air supply pathway 818 becoming somewhat heated, rather than cooled, the air released through the air outlet 812 is still cooler than and has a lower level of relative humidity than the heated, humid air within the treating chamber 16, so it can still provide an improved barrier between the process air pathway 160 and the work surface 170.

Figure 13:
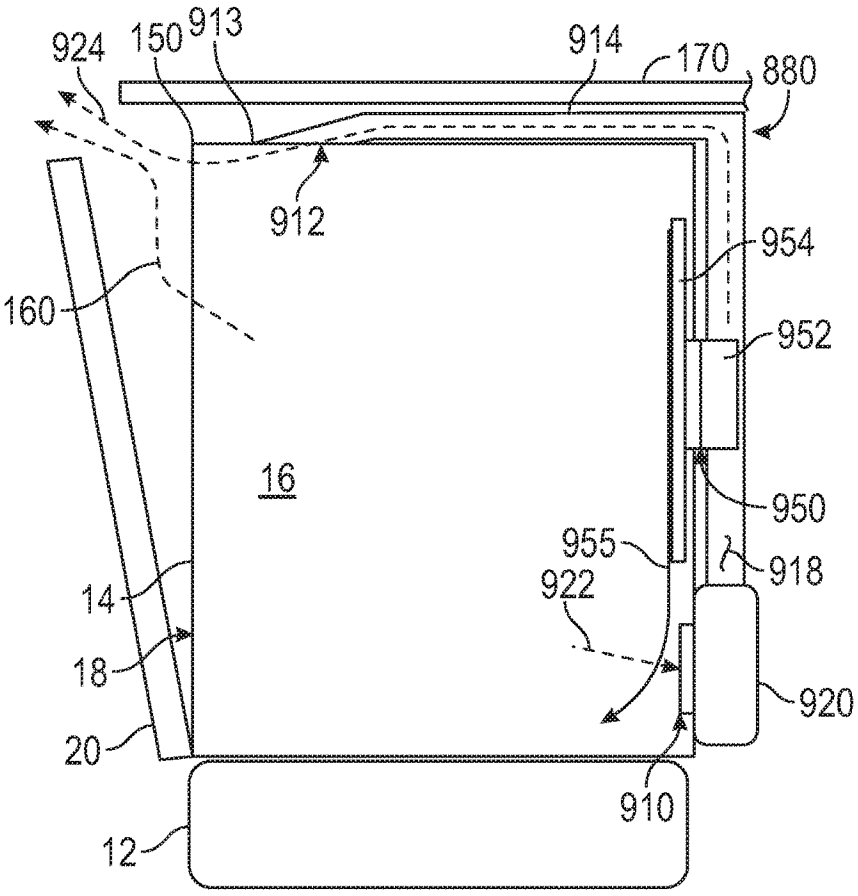
FIG. 13 is a schematic right-side view of another example of an air supply circuit for use with the air supply system of the dishwasher of FIG. 1.

FIG. 13 illustrates another example of an air supply circuit, illustrated as an air circulation circuit 880, for use with the air supply system 65 and the dishwasher 10 described herein that is similar to the dry air supply circuit 780 of FIG. 12, and shares many of the same features and components as the dry air supply circuit 780, but differs in some aspects, such as in the location of an air inlet 910 and an inlet air pathway 922, as well as in the location of an air outlet 912 and an outlet air pathway 924. Therefore, elements of the air circulation circuit 880 that are similar to those of the dry air supply circuit 780 are identified with numerals increased by 100, with it being understood that the description of the like parts of the dry air supply circuit 780 applies to the air circulation circuit 880, unless otherwise noted. The air circulation circuit 880 can be included within the air supply system 65 and the dishwasher 10 in addition to the previously described components of the drying system 80, without the need to replace or remove other parts of the drying system 80 as described.

The air circulation circuit 880 is similar to the dry air supply circuit 780 in many aspects, but differs from the dry air supply circuit 780 in that the air inlet 910, the inlet air pathway 922, and a blower 920 have a different location relative to the tub 14 and to the treating chamber 16, and also in that the air outlet 912, and therefore also the outlet air pathway 924, have a different position relative to the tub 14 and to the top wall 146. The arrangement and the description of at least a portion of an air channel 914 with an interior 918 that defines an air supply pathway 918, as well as of a thermoelectric device 950, a heating surface 952, a cooling wall 954, and a condensed liquid flow 955 as indicated by the arrow 955 is still the same and can be provided in the same manner as in the dry air supply circuit 780.

The air circulation circuit 880 differs from the dry air supply circuit 780 in that the air inlet 910, the inlet air pathway 922, and the blower 920, instead of being located at the base 12, the air inlet 910, the inlet air pathway 922, and the blower 920 are instead located at the lower portion of the tub 14 and the treating chamber 16. Specifically, the air inlet 910, the inlet air pathway 922, and the blower 920 are located at a lower end of the rear wall 144, such that the blower 920 is exterior of the tub 14 and the air inlet 910 and the inlet air pathway 922 are at least partially received within the tub 14 and passing through the rear wall 144. Thus, the air inlet 910 fluidly couples the treating chamber 16 to the blower 920 and to the air supply pathway 918. The air channel 914 still extends between the blower 920 and the air outlet 912, as well as past the heating surface 952 of the thermoelectric device 950, which remains unchanged from the dry air supply circuit 780. The air circulation circuit 880 further differs from the dry air supply circuit 780 in that the air outlet 912 passes through the top wall 146 as it is received within an outlet opening 913 defined by the top wall 146 in order to locate the air outlet 912 within the treating chamber 16, in the same way as the cooling air outlet 512 of the cooling air supply circuit 480 described in FIG. 9, instead of being positioned above the top wall 146 exterior to the tub 14 as in the dry air supply circuit 780.

The air circulation circuit 880 operates in a way very similar to the dry air supply circuit 780, except that the operation of the blower 920 draws heated, humid process air from within the treating chamber 16 to enter the air circulation circuit 880 through the air inlet 910 and along the inlet air pathway 922 to flow along the air supply pathway 918. As the process air flows over the heating surface 952, the process air is slightly heated, resulting in some drying or reduction in moisture or humidity, of the air supplied along the air supply pathway 918. At the same time, the operation of the thermoelectric device 950 and the drawing away of heat from the heating surface 952 results in condensation occurring along the cooling wall 954 within the treating chamber 16 and the condensed liquid flow 955 collecting in the tub 14 and the sump 51. The heated and partially dried air is further supplied along the air supply pathway 918 to reach the air outlet 912, where the supplied air exits the air channel 914 into the treating chamber 16 and toward the front edge 150.

As in the dry air supply circuit 780, the air supplied along the outlet air pathway 924 is not cooled, but is somewhat drier than the heated, humid air of the process air pathway 160, and is still supplied with a force from the blower 920 that is greater than that of the heated, humid air flowing along the process air pathway 160, and thus can still provide a beneficial barrier function, as described previously with respect to the dry air supply circuit 380 of FIG. 8.

While the air circulation circuit 880 has been described as being provided with the air supply system 65 in addition to the drying system 80, it will be understood that the air circulation circuit 880 could optionally be provided as a replacement for a portion of the drying system 80, rather than in addition to the drying system 80. With respect to FIG. 2, the drying system 80 was described as having the condenser 82 formed of the serpentine conduit 83 with the inlet at the upper portion of the tub 14 and the outlet at the lower portion of the tub 14. The air circulation circuit 880 instead discloses the air inlet 810 at the lower portion of the tub 14, with the air outlet 912 at the upper portion of the tub 14. Thus, if it were desired to replace the condenser 82, serpentine conduit 83, and cooling tank 84 of the dishwasher 10 with the air circulation circuit 880 of FIG. 13, the direction of the air supply would need to be switched. Alternatively, the air circulation circuit 880 could be provided in addition to the condenser 82, serpentine conduit 83, and cooling tank 84 of the dishwasher 10, such as by providing the air circulation circuit 880 on a different wall of the tub 14.

Figure 14:
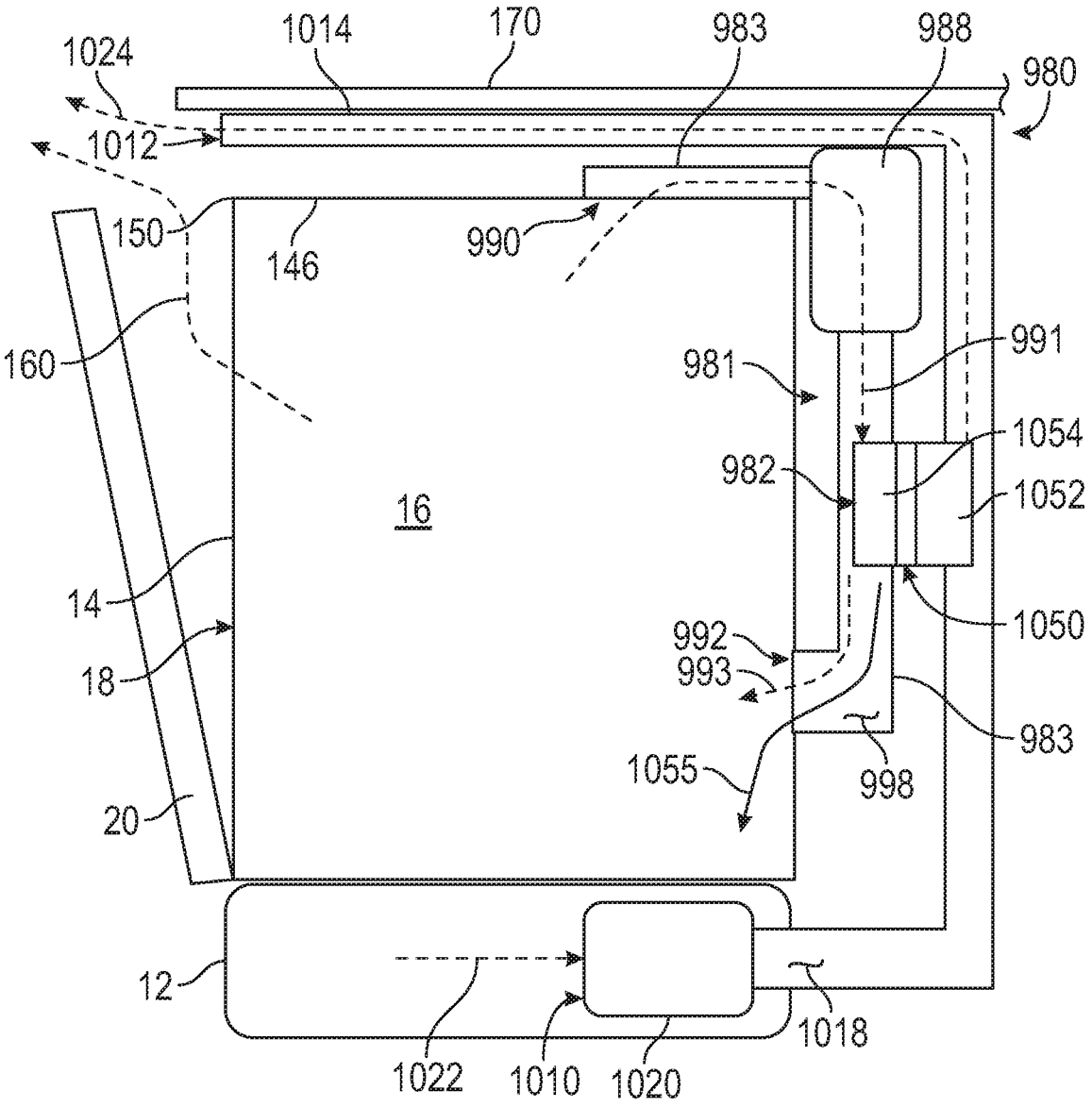
FIG. 14 is a schematic right-side view of another example of an air supply circuit for use with the air supply system of the dishwasher of FIG. 1.

FIG. 14 illustrates another example of an air supply circuit, illustrated as a dry air supply circuit 980, for use with the air supply system 65 and the dishwasher 10 described herein that is very similar to the dry air supply circuit 780 of FIG. 12, and shares many of the same features and components as the dry air supply circuit 780, but differs in some aspects, such as in the addition of a condensing assembly 981. Therefore, elements of the dry air supply circuit 980 that are similar to those of the dry air supply circuit 780 are identified with numerals increased by 200, with it being understood that the description of the like parts of the dry air supply circuit 780 applies to the dry air supply circuit 980, unless otherwise noted.

The dry air supply circuit 980 is similar to the dry air supply circuit 780 in most aspects, but differs from the dry air supply circuit 780 in that the dry air supply circuit 980 comprises the condensing assembly 981 that is not present in the dry air supply circuit 780 and in that a cooling surface 1054 has a different structure and location relative to the tub 14 and to the rear wall 144. Apart from that, the arrangement and the description of an air inlet 1010, an inlet air pathway 1022, a blower 1020, an air channel 1014 with an interior 1018 defining an air supply pathway 1018, a thermoelectric device 1050 having a heating surface 1052 and the cooling surface 1054, an air outlet 1012, and an outlet air pathway 1024 is still the same and can be provided in the same manner as in the dry air supply circuit 780.

The dry air supply circuit 980 differs from the dry air supply circuit 780 in that the cooling surface 1054, instead of being provided as the cooling wall 954 that is thermally coupled to the rear wall 144 and the tub 14, is instead thermally coupled to at least a portion of the condensing assembly 981. In one example, the cooling surface 1054, instead of the cooling wall 954, can comprise a set of cooling surface fins 1054, such as radiator fins, in the same way as the heating surface 1052 comprising the set of heating surface fins 1052. Further, the cooling surface fins 1054 are coupled with the condensing assembly 981 such that the cooling surface fins 1054 extend into and are at least partially received within the condensing assembly 981 to provide increased surface area to thermally couple to the condensing assembly 981.

In one example, the condensing assembly 981 can be thought of as comprising the condensing assembly 81 of FIGS. 1-2, or as another example of the condensing assembly 81, or as replacing the condensing assembly 81, such that previous description of the condensing assembly 81 applies to the condensing assembly 981. Alternatively, the condensing assembly 981 can be provided in addition to and separate from the condensing assembly 81. In either case, the remaining components of the dry air supply circuit 980, apart from the condensing assembly 981, can be included within the air supply system 65 and the dishwasher 10 in addition to the previously described components of the drying system 80, without the need to replace or remove other parts of the drying system 80 as described. The condensing assembly 981 can be thought of as being at least partially positioned between a portion of the dry air supply circuit 980 and the tub 14, such that the portion of the dry air supply circuit 980, and specifically the air channel 1014 is spaced from the tub 14 to accommodate the condensing assembly 981.

The condensing assembly 981 comprises a condenser 982 at least partially formed of a condensing conduit 983. In one example, the cooling surface 1054 can be provided as the condenser 982 or can at least partially form the condenser 982, along with the condensing conduit 983. The condensing conduit 983 defines a condensing inlet 990 fluidly coupling the treating chamber 16 to the condensing assembly 981 and a condensing outlet 992 fluidly coupling the condensing assembly 981 to the treating chamber 16. In one non-limiting example, the condensing inlet 990 is provided in the top wall 146, such as at the rear portion of the top wall 146 near the rear edge 148, to fluidly couple the condensing assembly 981 to the upper portion of the tub 14, while the condensing outlet 992 is provided in the rear wall 144, such as at the lower portion of the rear wall 144, to fluidly couple the condensing assembly 981 to the lower portion of the tub 14 and the treating chamber 16.

The condensing conduit 983 extends between the condensing inlet 990 and the condensing outlet 992 and can have any suitable shape, such as a straight condensing conduit 983 having uniform or varying width, or as a serpentine conduit 983. The condensing conduit 983 defines an interior 998 which can be thought of as defining a condensing air pathway 998. A condenser blower 988 is coupled to, such as provided within, the condensing conduit 983 to drive air supply through the condensing assembly 981. The condenser blower 988 is also operably coupled with the controller 22. Air entering the condensing assembly 981 flows through the condensing inlet 990 along the condensing inlet air pathway 991 as indicated by the arrow 991 and toward the cooling surface 1054. From the cooling surface 1054, air flows toward and through the condensing outlet 992 along the condensing outlet air pathway 993 as indicated by the arrow 993. Condensed liquid forms a condensed liquid flow 1055 to flow through the condensing outlet 992 into the tub 14 and the sump 51.

Turning now to the operation of the dry air supply circuit 980 and the condensing assembly 981, which forms a part of the dry air supply circuit 980, the operation of the dry air supply circuit 980 can be the same as that of the dry air supply circuit 780, differing only in that the ambient air that is heated by the heating surface 1052 and then flows to the air outlet 1012 exits along the outlet air pathway 1024 still between the top wall 146 and the work surface 170, but can be slightly spaced from the top wall 146 to flow more closely along the work surface 170 toward the front edge 150 due to accommodating the height of the condensing assembly 981 between the air channel 1014 and the tub 14. For the condensing assembly 981, when the condenser blower 988 is operated, heated, humid process air from the treating chamber 16 is drawn through the condensing inlet 990 along the condensing inlet flow pathway 991 to flow through the condenser blower 988 and toward the cooling surface 1054. Specifically, the cooling surface fins 1054 extend through the condensing conduit 983 to extend into the condensing air pathway 998 to provide increased surface area for thermal coupling of the cooling surface 1054 with the condensing air pathway 998 to cool and condense the heated, humid air within the condensing conduit 983. As moisture condenses out of the process air, the process air is cooled and is returned to the treating chamber 16 along the condensing outlet air pathway 1024 and through the condensing outlet 992. The moisture that condenses out of the process air at the cooling surface 1054 and within the condensing air pathway 998 forms the condensed liquid flow 1055 which flows down the condensing conduit 983, through the condensing outlet 992, and into the tub 14 to be collected in the sump 51.

In one example, the controller 22 can be configured to operate the blower 1020, the thermoelectric device 1050, and the condenser blower 988 at the same time to ensure cooperative performance of the dry air supply circuit 980, and specifically of the air supply pathway 1018 and the condensing assembly 981. However, it will be understood that the components can be operated separately as desired, such that, by way of non-limiting examples, the blower 1020 and the thermoelectric device 1050 can be operated while the condenser blower 988 is not operated, or that the condenser blower 988 and the thermoelectric device 1050 can be operated while the blower 1020 is not operated, depending on the requirements of the cycle of operation. When the blower 1020, the thermoelectric device 1050, and the condenser blower 988 are all operated concurrently, the dry air supply circuit 980 is operated to provide a barrier air flow from the air outlet 1012 of heated, dry air to prevent heated, humid air of the process air pathway 160 from reaching the work surface 170, as well as improving condensing performance of the cooling surface 1054 in the condensing assembly 981 to remove moisture from the heated, humid air drawn from the treating chamber 16 and to return the dried and somewhat cooled air to the treating chamber 16 to cool the air within the treating chamber 16.

FIGS. 15-18 illustrate another example of a dry air supply circuit 2580 for use with the air supply system 65 and the dishwasher 10 described in the present disclosure that is similar to the dry air supply circuit 580 of FIG. 10, and shares many of the same features and components as the dry air supply circuit 580, but differs in some aspects, such as in the location of a dry air inlet 2610 and a dry air channel 2614, as well as in the location and structure of a dry air outlet 2612, and also in the inclusion of a dry air valve assembly 2650. Therefore, elements of the dry air supply circuit 2580 that are similar to those of the dry air supply circuit 580 are identified with numerals increased by 2000, with it being understood that the description of the like parts of the dry air supply circuit 580 applies to the dry air supply circuit 2580, unless otherwise noted. The air supply circuit 2580 can be included within the air supply system 65 and the dishwasher 10 in addition to the previously described components of the drying system 80, without the need to replace or remove other parts of the drying system 80 as described.

The dry air supply circuit 2580 is similar to the dry air supply circuit 580 in some aspects, but differs from the dry air supply circuit 580 in that the dry air inlet 2610 has a different position relative to the tub 14 and relative to the dry air outlet 2612, that the dry air channel 2614 has a different position and structure relative to the tub 14 to accommodate the relative positions of the dry air inlet 2610 and the dry air outlet 2612, that the dry air outlet 2612 has a different position and structure relative to the front edge 150 of the top wall 146 of the tub 14 to accommodate the position of the door opener 26, and also that the dry air supply circuit 2580 includes the dry air valve assembly 2650 that is not present in the dry air supply circuit 580. The arrangement and the description of the general structure and function of an inlet air pathway 2622 and at least one blower 2620 at the dry air inlet 2610, a portion of a body of a dry air channel 2614 defining a dry air supply pathway 2618, an outlet air pathway 2624 at the dry air outlet 2612, and as well as a second dry air supply branch 2640, including a supply branch inlet 2642, a supply branch channel 2646, a supply branch outlet 2644, a supply branch pathway 2648, and a corresponding outlet opening 2643 defined within the side wall 140 and through which the supply branch outlet 2644 is fluidly coupled to the treating chamber 16, is still the same and can be provided in the same manner as in the dry air supply circuit 580.

Figure 15:
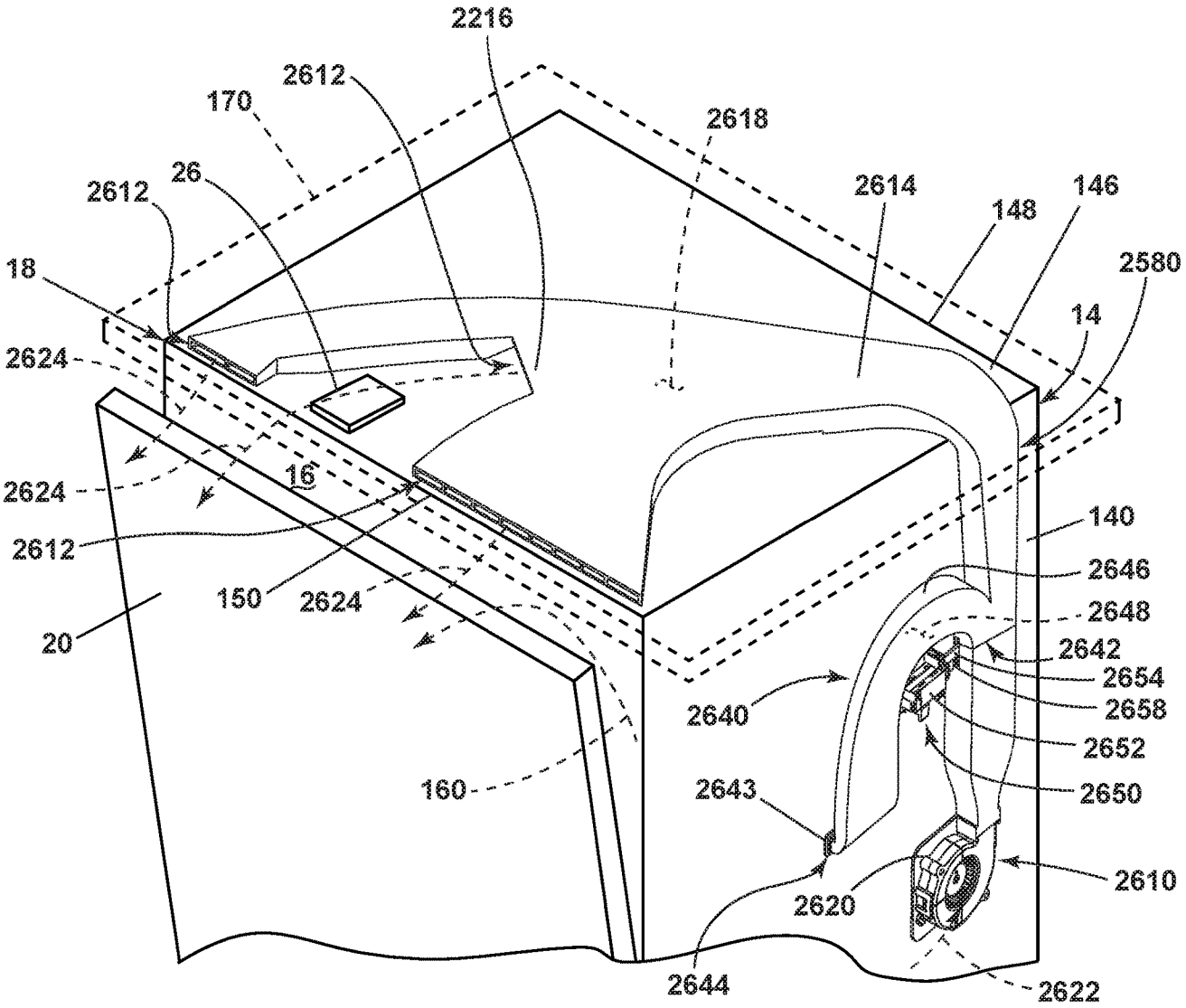
FIG. 15 is a schematic top and right-side perspective view of another example of an air supply circuit for use with the air supply system of the dishwasher of FIG. 1.

While the dry air supply circuit 2580 differs somewhat from the dry air supply circuit 580 in the overall visual structure, the underlying principles and steps of operation are consistent with the dry air supply circuit 580, such that the changes can be easily understood. In FIG. 15, it can be best seen that, instead of the dry air supply circuit 580 having the dry air inlet 610, the blower 620, and the inlet air pathway 622 being positioned at the base 12, the dry air inlet 2610, the blower 2620, and the inlet air pathway 2622 can instead be positioned along the tub 14 rather than the base 12, such as along the side wall 140 of the tub 14. Specifically, as illustrated and by way of non-limiting example, the dry air inlet 2610, the blower 2620, and the inlet air pathway 2622 are further positioned at a rear portion of the dishwasher 10 and the tub 14, nearer to the rear edge 148 than to the front edge 150, and can also be provided at a lower portion of the side wall 140 and of the tub 14. The blower 2620 can still at least partially define the dry air inlet 2610 and is fluidly coupled to the ambient air exterior of the tub 14 by the dry air inlet 2610.

The dry air channel 2614 still extends between the blower 2620 and the dry air outlet 2612 along both the side wall 140 and the top wall 146 and interacts with other components in a similar way to the dry air channel 614, but instead of extending diagonally along the one of the side walls 140, since the dry air inlet 2610 is already positioned near the rear edge 148, the dry air channel 2614 extends generally vertically along the side wall 140 near the rear edge 148 of the side wall 140 between the blower 2620 and the top wall 146. Along the top wall 146, the dry air channel 2614 then extends away from the rear edge 148 and toward the front edge 150 to define the dry air outlet 2612, the dry air channel 2614 increasing in width toward the dry air outlet 2612 and toward the front edge 150.

In the illustrated example, instead of the dry air channel 614 defining a single dry air outlet 612 extending along the majority of the width of the top wall 146, the dry air channel 2614 instead defines more than one section of dry air outlet 2612. Specifically, the dry air channel 2614 defines at least a pair of dry air outlets 2612 spaced from one another along the top wall 146 and positioned near the front edge 150, as well as near the side walls 140, respectively, and fluidly coupled to one another by an intermediate section 2216 positioned and extending between the spaced pair of dry air outlets 2612, similar to the intermediate channel 216 of the dry air supply circuit 180 of FIG. 4. However, instead of the intermediate channel 216 simply connecting the pair of air channels 214 as in the dry air supply circuit 180, the intermediate section 2216 further defines an intermediate section of the dry air outlet 2612 that is positioned further back from the front edge 150 than the spaced pair of dry air outlets 2612. In one example, the spacing apart of the pair of dry air outlets 2612 and the distance from the front edge 150 of the section of the dry air outlet 2612 defined by the intermediate section 2216 are specifically determined by the size and position of the door opener 26 to accommodate the structure of the door opener 26 along the front edge 150 of the top wall 146. In this way, the sections of the dry air outlets 2612 collectively can still extend along the majority of the width of the top wall 146, while also accommodating the positioning of the door opener 26 by the inclusion of the section of the dry air outlet 2612 defined by the intermediate section 2216 that is recessed from the front edge 150 to allow for the location of the door opener 26 while still providing the outlet air pathway 2624 along the width and position of the door opener 26. Further, by way of non-limiting example, it is contemplated that the door opener 26 can also be specifically shaped, such as by its overall shape and/or by the inclusion of ribs or other structural features, so as to support and direct the flow of the dry air from the section of the dry air outlet 2612 defined by the intermediate section 2216 over and around the door opener 26 and toward the front edge 150.

In addition to the dry air supply circuit 2580 including the dry air supply branch 2640 defining the supply branch outlet 2644 that fluidly couples the dry air inlet 2610 with the treating chamber 16, as described with respect to the dry air supply branch 640 of FIG. 10, the dry air supply circuit 2580 further comprises the dry air valve assembly 2650 that is configured to selectively fluidly couple the dry air inlet 2610 with the dry air supply pathway 2618 and the dry air outlet 2612 and with the supply branch pathway 2648 and the supply branch outlet 2644. The dry air valve assembly 2650 comprises an actuator 2652 operably coupled to an output shaft 2654 that is movable relative to the actuator 2652 between at least a first position and a second position. The dry air channel 2614 defines an opening 2658 through which the output shaft 2654 extends into dry air supply pathway 2618. The opening 2658 can be provided at any suitable position along the dry air channel 2614, so long as the opening 2658 is located at or upstream of the supply branch inlet 2642 to selectively allow the flow of dry air through the supply branch inlet 2642 into the supply branch pathway 2648. The actuator 2652 can include any suitable type of actuator 2652 for driving movement of the output shaft 2654 between the first and second positions, non-limiting examples of which include a wax motor, a solenoid actuator, or a DC motor.

Figure 16:
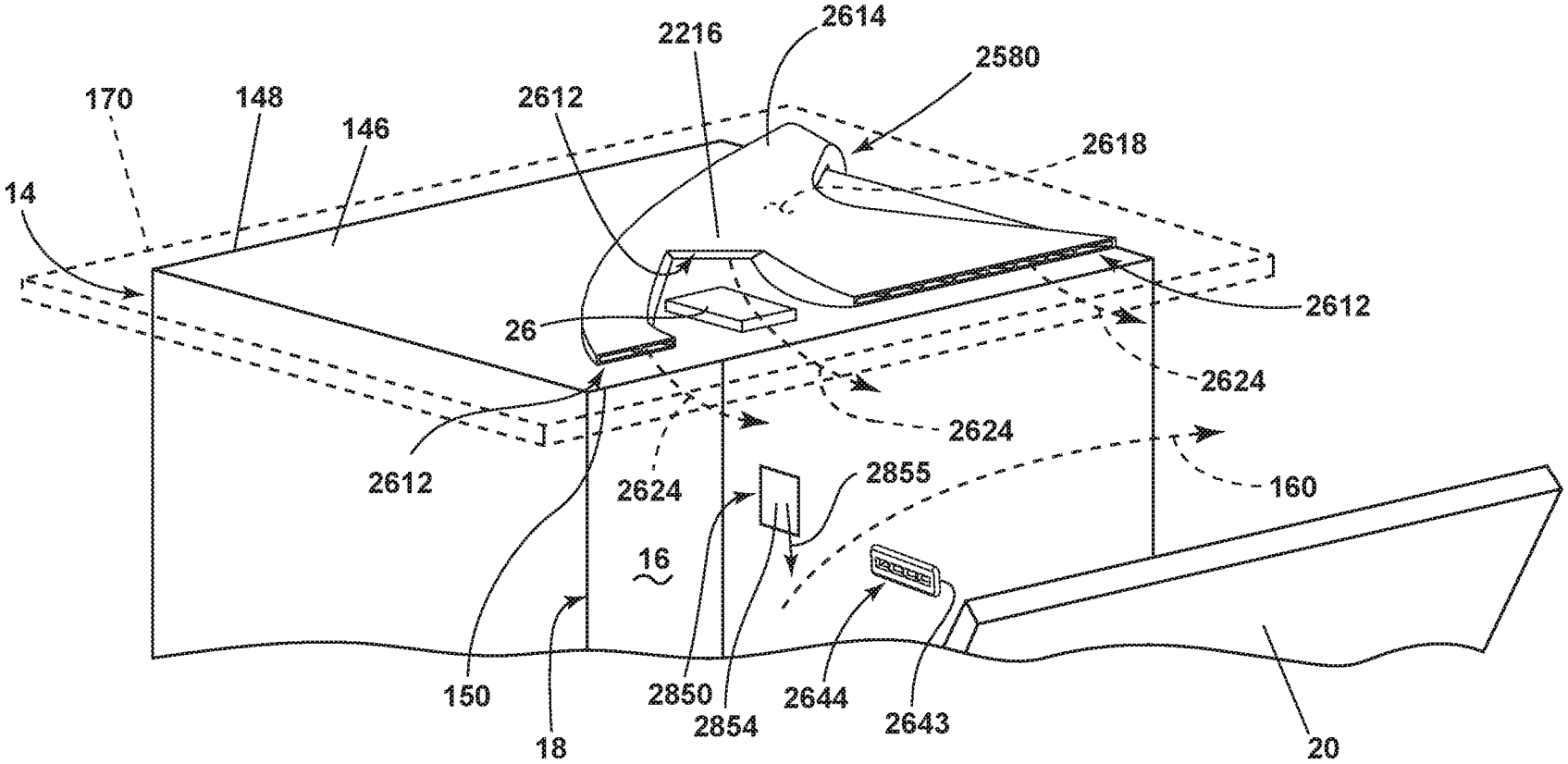
FIG. 16 is a schematic top and left-side perspective view of a portion of the air supply circuit of FIG. 15.
Figure 17:
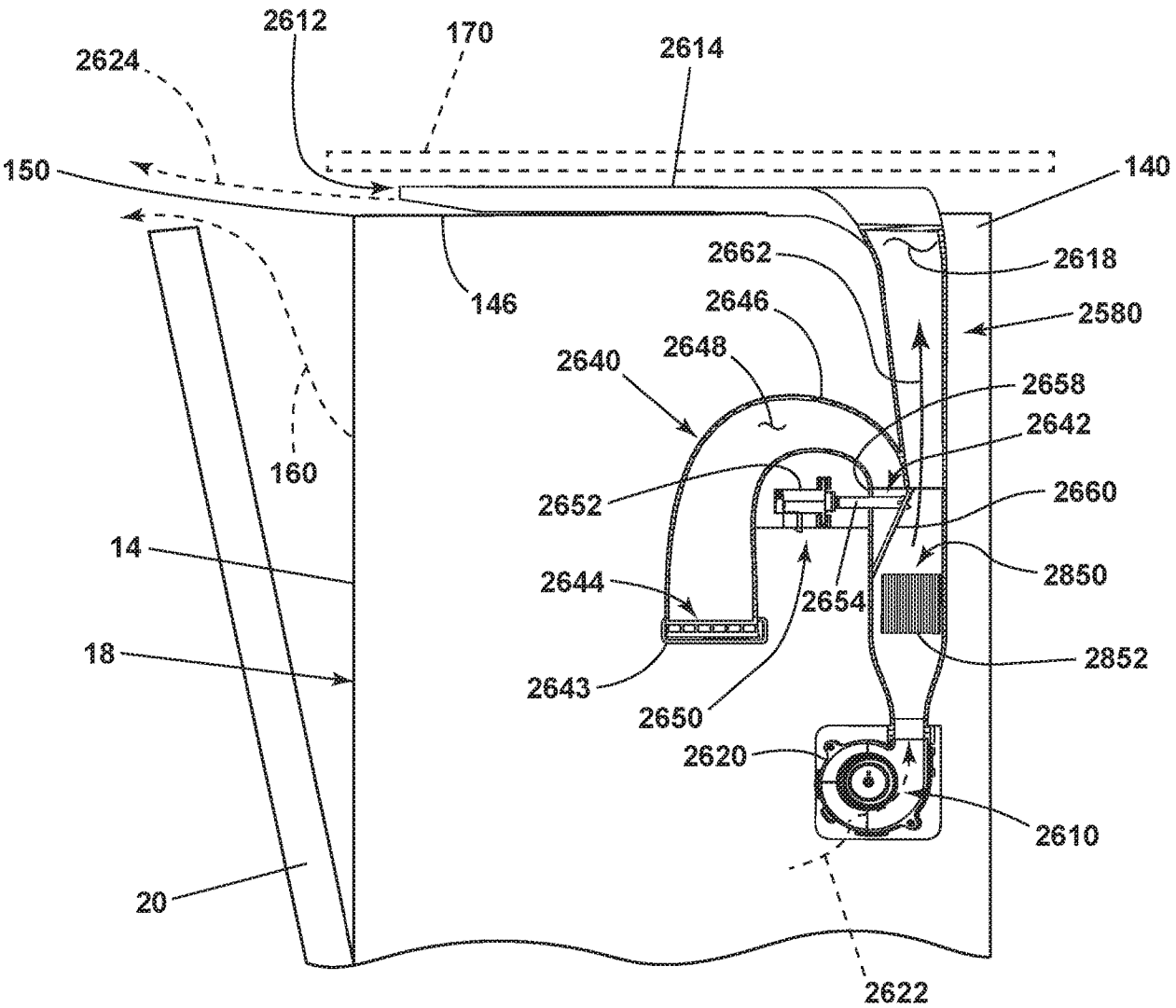
FIG. 17 is a schematic right-side cross-sectional view of a portion of the air supply circuit of FIG. 15, including a dry air valve assembly in a first position.

The section of the dry air outlet 2612 formed by the intermediate section 2216 and the position and structure of the supply branch outlet 2644 fluidly coupling the supply branch pathway 2648 with the treating chamber 16 is best seen in the view of FIG. 16. As illustrated, the supply branch outlet 2644 can be positioned generally at a middle portion of the side wall 140, though it will be understood that such a position is not limiting and the supply branch outlet 2644 can be provided at any suitable location on the tub 14.

The dry air supply circuit 2580 can optionally further comprise a heating and cooling assembly 2850 that is similar to the heating and cooling assembly 850 of FIG. 12, and shares many of the same features and components as the heating and cooling assembly 850, but differs in some aspects, such as in the location of the heating and cooling assembly 2850 relative to the dry air inlet 2610. Therefore, elements of the heating and cooling assembly 2850 that are similar to those of the heating and cooling assembly 850 are identified with numerals increased by 2000, with it being understood that the description of the like parts of the heating and cooling assembly 850 applies to the heating and cooling assembly 2850, unless otherwise noted.

The heating and cooling assembly 2850 is similar to the heating and cooling assembly 850 in many aspects, but differs from the heating and cooling assembly 850 in the positioning of the heating and cooling assembly 2850 relative to the dry air inlet 2610 and to the tub 14. The arrangement and the description of the general structure and function of a heating surface, illustrated as a set of heating surface fins 2852 (FIG. 17), thermally coupled to the dry air channel 2614 and at least a portion of the dry air supply pathway 2618 and a cooling surface, illustrated as a cooling wall 2854, thermally coupled with the tub 14, as well as a condensed liquid flow 2855, as indicated by the arrow 2855, that can flow downwardly along the tub 14 to collect in the sump 51, is still the same and can be provided in the same manner as in the heating and cooling assembly 850.

Instead of the heating and cooling assembly 850 being positioned within the rear wall 144, the heating and cooling assembly 2850 can instead be positioned at the side wall 140 corresponding to the position of the dry air channel 2614, such as near the rear edge 148 of the side wall 140. As illustrated, the heating and cooling assembly 2850 is positioned at a portion of the dry air channel 2614 upstream of the dry air valve assembly 2650, though it will be understood that the heating and cooling assembly 2850 can be positioned at any suitable location with the dry air channel 2614. Additionally, or alternatively, more than one heating and cooling assembly 2850 can be included, such that at least one heating and cooling assembly 2850 is located within the dry air supply pathway 2618 while at least one heating and cooling assembly 2850 is located within the supply branch pathway 2648.

Figure 18:
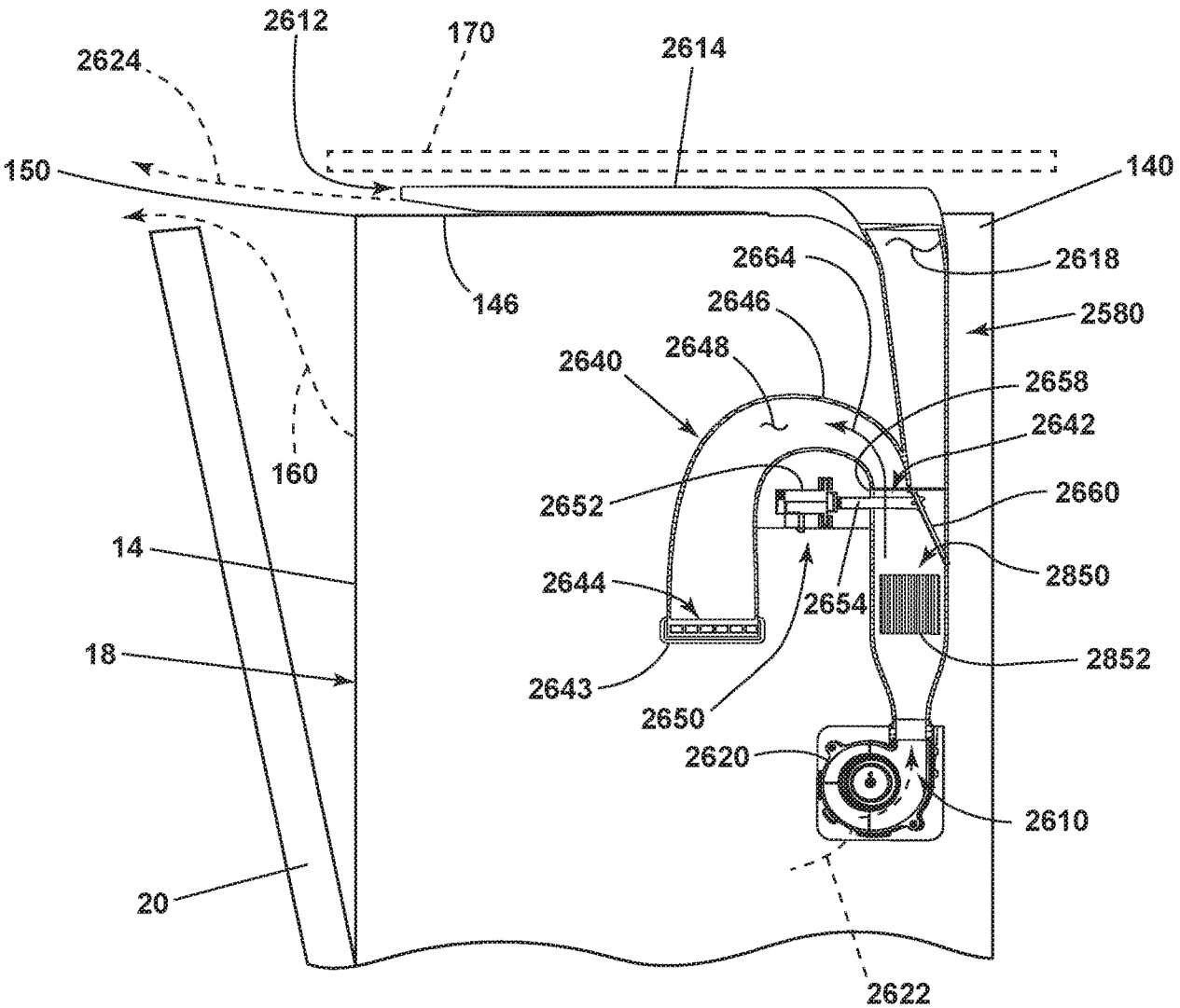
FIG. 18 is a schematic right-side cross-sectional view of the portion of the air supply circuit of FIG. 17, with the dry air valve assembly in a second position.

In FIG. 18, the dry air valve assembly 2650 is shown in the second, extended position, corresponding to an extended position of the output shaft 2654 and the gate 2660. In the second, extended position, the output shaft 2654 extends further away from the actuator 2652 to protrude further through the opening 2658 and into the dry air channel 2614. The gate 2660 is rotated relative to the output shaft 2654 to extend further from the actuator 2652. In the second, retracted position of the dry air valve assembly 2650, the gate 2660 blocks the remainder of the dry air channel 2614 to prevent dry air from flowing through the remainder of the dry air supply pathway 2618 downstream of the gate 2660, but no longer blocks the supply branch inlet 2642, allowing dry air entering the dry air channel 2614 through the dry air inlet 2610 to instead flow through the supply branch inlet 2642, along the supply branch pathway 2648 toward the supply branch outlet 2644 as indicated by the arrow 2664. Thus, the dry air valve assembly 2650, and specifically the gate 2660, fluidly couples the dry air inlet 2610 with the supply branch channel 2646 and the supply branch outlet 2644, and thus also to the treating chamber 16, in the second, extended position.

Turning now to the operation of the dry air supply circuit 2580, operation of the blower 620 by the controller 22 draws in ambient air through the dry air inlet 2610 along the inlet air pathway 2622 to be drawn through the blower 2620 and into the dry air channel 2614. In the case that the dry air supply circuit 2580 includes the optional heating and cooling assembly 2850 as illustrated, when the heating and cooling assembly 2850 is operated, dry air entering the dry air channel 2614 flows over the heating surface fins 2852 and is heated relative to the ambient temperature, while the cooling wall 2854 is cooled, generating the condensed liquid flow 2855 within the treating chamber 16. Downstream of the heating and cooling assembly 2850, when the dry air valve assembly 2650 is in the first, retracted position of FIG. 17, the gate 2660 blocks the supply branch inlet 2642 and dry air is pushed from the blower 2620 through the dry air supply pathway 2618 to exit through the dry air outlet 2612 along the outlet air pathway 2624 to form an air barrier, an air curtain, or an air blade to interact with the heated, humid air of the process air pathway 160 as previously described. Alternatively, when the dry air valve assembly 2650 is in the second, extended position of FIG. 18, the gate 2660 blocks the remainder of the dry air channel 2614 downstream of the gate 2660 and dry air is pushed from the blower 2620 through the supply branch pathway 2648 to exit through the supply branch outlet 2644 and into the treating chamber 16 to reduce the overall level of relative humidity within the treating chamber 16 by the supply of fresh, dry ambient air, as well as by adding air to the treating chamber 16 to increase pressure within the treating chamber 16 to improve venting performance when the door assembly 20 is opened.

In one non-limiting example, the dry air valve assembly 2650 can be actuated to the first, retracted position to fluidly couple the dry air inlet 2610 with the dry air outlet 2612 during cycles of operation or phases of cycles of operation that generate high temperatures within the treating chamber 16. For example, some final rinse phases for intensive cycles of operation can result in temperatures of 60-70° C. within the treating chamber 16, which would be undesirable for contact with the work surface 170 but which results in improved drying performance during a drying cycle of operation as compared to lower temperatures. Thus, in such a case, the dry air valve assembly 2650 is provided in the first, retracted position to allow dry air to flow through the dry air outlet 2612 and to create the air barrier to prevent the heated, humid air of the process air pathway 160 from reaching the work surface 170. Alternatively, for phases or cycles of operation that do not reach such high temperatures within the treating chamber 16, the dry air valve assembly 2650 can be actuated to the second, extended position to fluidly couple the dry air inlet 2610 with the supply branch outlet 2644. For example, final rinse phases for some eco or less intensive cycles of operation only reach temperatures of 40-44° C. within the treating chamber 16, which is less likely to have negative impacts on the work surface 170, but which results in decreased drying performance as compared to cycles with higher drying temperatures. Thus, in such a case, the dry air valve assembly 2650 is provided in the second, extended position to allow dry air to flow through the supply branch outlet 2644 and into the treating chamber 16 to support and supplement the drying process by reducing the overall level of relative humidity, as well as optionally increasing the temperature, within the treating chamber 16.

While the dry air valve assembly 2650 has been described as having first and second positions to supply the dry air either to the dry air outlet 2612 or to the supply branch outlet 2644, it is also contemplated that the dry air valve assembly 2650 can include additional positions between the first, retracted position and the second, extended position, such that the dry air valve assembly 2650 can be operated to fluidly couple and to allow the flow of dry air to both the dry air outlet 2612 and to the supply branch outlet 2644 at the same time. However, this would require the blower 2620 to be capable of generating higher air flow than when operating the dry air valve assembly 2650 to supply the dry air to only one of the dry air outlet 2612 or the supply branch outlet 2644 at one time.

The examples described with respect to FIGS. 4-18 include various implementations of air supply circuits 180, 280, 380, 480, 580, 680, 780, 880, 980, 2580, all of which include the eventual outlet of supplied air adjacent the upper portion of the open face 18 when the door assembly 20 is in the opened position in order to supply an air barrier flow to deter moisture-laden air from contacting the work surface 170. Thus, the air supply circuits 180, 280, 380, 480, 580, 680, 780, 880, 980, 2580, despite varying in the location of various components, in the inclusion of cooling assemblies 534, 850, 2850, and in the source of the inlet air being ambient air or process air from the treating chamber 16, can all be thought of as examples of open loop air supply circuits 180, 280, 380, 480, 580, 680, 780, 880, 980, 2580 supplying the air barrier flow adjacent the upper portion of the open face 18. However, it will be understood that the concepts and structures as previously described can also have applicability within the dishwasher 10 in the context of closed loop air supply circuit implementations, such as air circulation circuits, examples of which are illustrated in FIGS. 19-29, to serve the purpose of improving the performance and efficiency of drying cycles within the dishwasher 10. While the closed loop implementations of FIGS. 19-29 are illustrated herein as being provided separately from and without the inclusion of the outlet of supplied air adjacent the upper portion of the tub 14 to supply the air barrier flow as in the open loop examples, it will be understood that the closed loop implementations of FIGS. 19-29 can also be provided along with the open loop air supply circuits 180, 280, 380, 480, 580, 680, 780, 880, 980, 2580 within the air supply system 65 in any suitable or desirable combination.

Figure 19:
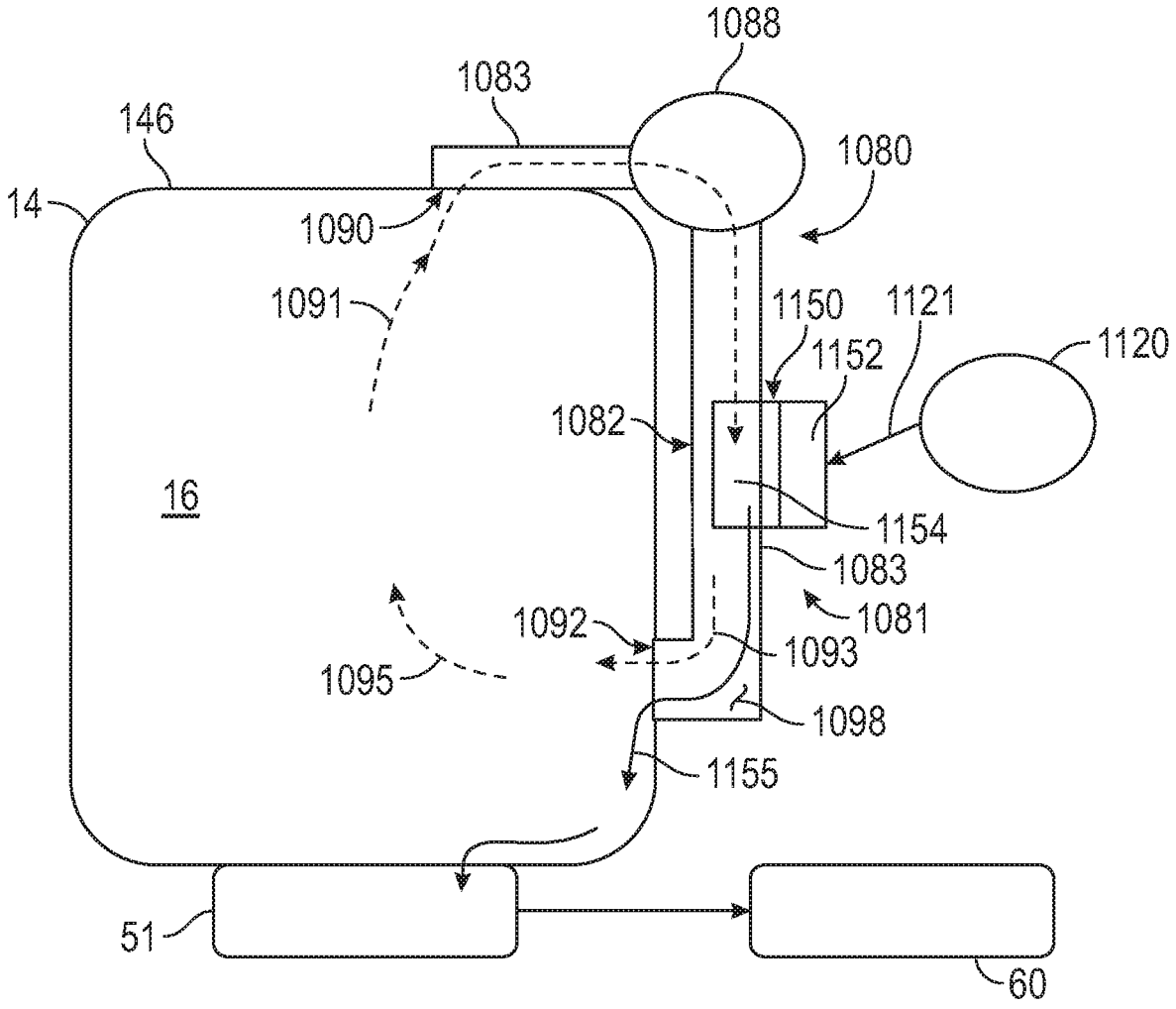
FIG. 19 is a schematic view of another example of an air supply circuit for use with the air supply system of the dishwasher of FIG. 1.

FIG. 19 illustrates another example of an air supply circuit, illustrated as an air circulation circuit 1080, for use with the air supply system 65 and the dishwasher 10 described herein that is similar to the dry air supply circuit 980 of FIG. 14, and shares several of the same features and components as the dry air supply circuit 980, but differs in some aspects, such as that the air circulation circuit 1080 does not include the air channel 1014 or other associated components of the air supply pathway 1018. Therefore, elements of the air circulation circuit 1080 that are similar to those of the dry air supply circuit 980 are identified with numerals increased by 100, with it being understood that the description of the like parts of the dry air supply circuit 980 applies to the air circulation circuit 1080, unless otherwise noted. The air circulation circuit 1080 can be included within the air supply system 65 and the dishwasher 10 in addition to the previously described components of the drying system 80, without the need to replace or remove other parts of the drying system 80 as described, or the air circulation circuit 1080 can be thought of as replacing the condensing assembly 81 or as another example of a condensing assembly 1081.

The air circulation circuit 1080 is similar to the dry air supply circuit 980 in some aspects, but differs from the dry air supply circuit 980 in that the air circulation circuit 1080 comprises the condensing assembly 1081 and a thermoelectric device 1150, but does not include the air channel 1014 or other associated components of the air supply pathway 1018 thermally coupled to a heating surface 1152. Apart from that, the arrangement and the description of the condensing assembly 1081, a condensing inlet 1090, a condensing inlet air pathway 1091, a condensing conduit 1083, a condenser blower 1088, a condenser 1082, an interior 1098 defining a condensing air pathway 1098, a condensing outlet 1092, a condensing outlet air pathway 1093, a condensed liquid flow 1155, and the thermoelectric device 1150 having the heating surface 1152 and a cooling surface 1154 is still the same and can be provided in the same manner as in the dry air supply circuit 980.

Other than the components of the dry air supply circuit 980 that are not included in the air circulation circuit 1080, the air circulation circuit 1080 differs further from the dry air supply circuit 980 simply in that the heating surface 1152, instead of being thermally coupled to the air supply pathway 1018, is instead thermally coupled to a blower, illustrated as a dry air fan 1120. The dry air fan 1120 is positioned relative to the heating surface 1152 such that the dry air fan 1120 can generate a dry air flow 1121, as indicated by the arrow 1121, to pass over the heating surface 1152 and to cool and to draw heat away from the heating surface 1152.

Turning now to the operation of the air circulation circuit 1080, the operation of the condensing assembly 1081 can function the same as the condensing assembly 981, such that operation of the condenser blower 1088 and the thermoelectric device 1150 draws heated, humid process air from the treating chamber 16 through the condensing air pathway 1098 where the process air is cooled and dehumidified by condensing moisture out of the process air, and provided back into the treating chamber 16 along the condensing outlet air pathway 1093 as at least partially cooled, dried air. Concurrently, the operation of the dry air fan 1120 to flow the dry air flow 1121 over the heating surface 1152 improves condensing performance of the cooling surface 1154 and the condenser 1082. The condensed liquid flow 1155 generated by the condensing flows through the condensing outlet 1092 into the tub 14 to be collected in the sump 51 and subsequently provided to the drain system 60.

In this closed loop air circulation circuit 1080, the relatively or at least partially cooled, dried air, instead of exiting the treating chamber 16 through the opened door assembly 20 along the process air pathway 160, moves throughout the treating chamber 16 as a dry air flow 1095 indicated by the arrow 1095. As the dry air flow 1095 moves from the condensing outlet 1092 through the treating chamber 16 toward the condensing inlet 1090, the dry air flow 1095 is heated and collects moisture from within the treating chamber 16 to again become heated, humid air to be provided back to the condensing assembly 1081.

Figure 20:
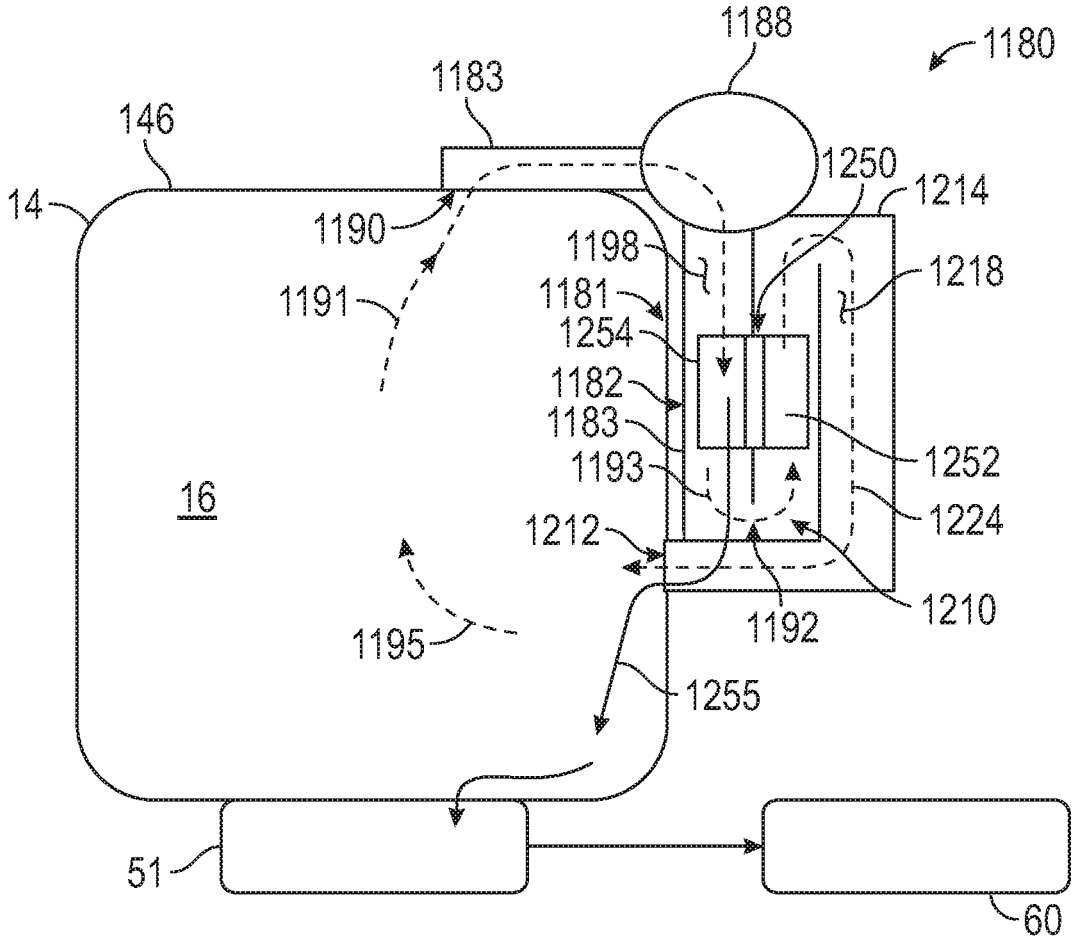
FIG. 20 is a schematic view of another example of an air supply circuit for use with the air supply system of the dishwasher of FIG. 1.

FIG. 20 illustrates another example of an air supply circuit, illustrated as an air circulation circuit 1180, for use with the air supply system 65 and the dishwasher 10 described herein that is similar to the air circulation circuit 1080 of FIG. 19, and shares several of the same features and components as the air circulation circuit 1080, but differs in some aspects, such as in the structure of a condensing conduit 1183 and the inclusion of a portion that can be provided as an air supply pathway 1218 thermally coupled with a heating surface 1252 of a thermoelectric device 1250. Therefore, elements of the air circulation circuit 1180 that are similar to those of the air circulation circuit 1080 are identified with numerals increased by 100, with it being understood that the description of the like parts of the air circulation circuit 1080 applies to the air circulation circuit 1180, unless otherwise noted. The air circulation circuit 1180 can be included within the air supply system 65 and the dishwasher 10 in addition to the previously described components of the drying system 80, without the need to replace or remove other parts of the drying system 80 as described, or the air circulation circuit 1180 can be thought of as replacing the condensing assembly 81 or as another example of a condensing assembly 1181.

The air circulation circuit 1180 is similar to the air circulation circuit 1080 in some aspects, but differs from the air circulation circuit 1080 in that the air circulation circuit 1180 includes an additional portion provided as the air supply pathway 1218 and thermally coupled with the heating surface 1252, and also that a condensing outlet air pathway 1193 has an altered path and position. The arrangement and the description of a portion of the condensing assembly 1181, a condensing inlet 1190, a condensing inlet air pathway 1191, a portion of a condensing conduit 1183, a condenser blower 1188, a condenser 1182, an interior 1198 defining a condensing air pathway 1198, a condensed liquid flow 1155 to the sump 51 and the drain system 60, and the thermoelectric device 1250 having the heating surface 1252 and a cooling surface 1254 is still the same and can be provided in the same manner as in the air circulation circuit 1080.

The air circulation circuit 1180 differs from the air circulation circuit 1080 downstream of the cooling surface 1254 that acts as the condenser 1182. Instead of the condensing air pathway 1198 flowing from the cooling surface 1254 directly to the condensing outlet 1192 as in the air circulation circuit 1080, the condensing conduit 1183 doubles back along itself to return toward the heating surface 1252, which can be thought of as the air circulation circuit 1180 further comprising a second portion, which can be provided as an air channel 1214 having an interior 1218 defining an air circulation pathway 1218. While the condensing conduit 1183 and the air channel 1214 can be provided collectively as a single continuous conduit 1183 or channel 1214, the two portions can be thought of as distinct condensing air and air circulation pathways 1198, 1218 having different functions. At a point between the cooling surface 1254 and the heating surface 1252, downstream of the cooling surface 1254 and upstream of the heating surface 1252, a transition from the condensing air pathway 1198 to the air circulation pathway 1218 can be thought of as forming or defining the condensing outlet 1192 and an air inlet 1210, such that the condensing outlet 1192 is fluidly coupled to the air inlet 1210 and the condensing outlet air pathway 1193 also serves to define an inlet air pathway 1193 through the air inlet 1210 and into the air circulation pathway 1218. As the condensing outlet 1192 no longer fluidly couples directly to the treating chamber 16 to allow the condensed liquid flow 1155 to move into the tub 14, a conduit (not shown, but schematically represented by the arrow 1155) can be provided to drain the condensed liquid flow 1155 into the tub 14 from the condensing conduit 1183 downstream of the cooling surface 1254 and upstream of the condensing outlet 1192.

The air channel 1214 further defines an air outlet 1212 fluidly coupling the air circulation pathway 1218 to the treating chamber 16. The air channel 1214 extends between the air inlet 1210 and the air outlet 1212, with the air circulation pathway 1218 defined thereby being also thermally coupled to the heating surface 1252 of the thermoelectric device 1250. Specifically, the heating surface 1252, such as the heating surface fins 1252, extend into the air circulation pathway 1218 through the air channel 1214 to provide an increased surface area for thermal coupling with the air circulation pathway 1218. Although the air circulation circuit 1180 is provided as a closed loop implementation and the dry air supply circuit 980 of FIG. 14 is provided as an open loop implementation, due to the thermal coupling of the heating surface 1252 to the air circulation pathway 1218 alongside the inclusion of the condensing assembly 1181, the air channel 1214 and the air circulation pathway 1218 can be thought of as similar to and as an alternative to the air channel 1014 and the air supply pathway 1018 of the dry air supply circuit 980 of FIG. 14, differing in that the air inlet 1210 to the air channel 1214 is from the condensing air pathway 1198 rather than ambient air, and the air outlet 1212 is to the treating chamber 16 rather than to the exterior of the tub 14.

The operation of the air circulation circuit 1180 is the same as that of the air circulation circuit 1080 until the supplied air passes the cooling surface 1254. After passing the cooling surface 1254, the condensed liquid flow 1255 is provided from the condensing conduit 1183 back into the tub 14 by the conduit (not shown) generally indicated by the arrow 1255 to be collected in the sump 51 and provided to the drain system 60. The at least partially cooled, dehumidified process air is provided along the condensing outlet air pathway 1193 into the air circulation pathway 1218 via the condensing outlet 1192 and the air inlet 1210. The at least partially cooled, dehumidified process air passes over the heating surface 1252 and absorbs heat from the heating surface 1252 to form an at least partially heated, dried process air that is provided along the outlet air pathway 1224 to flow through the air outlet 1212 and into the treating chamber 16. From there, the at least partially heated, dried process air is provided through the treating chamber 16 as a dry air flow 1195 as in the air circulation circuit 1080.

Because the at least partially heated, dried process air that exits the air circulation circuit 1180 is warmer than the process air that exits the air circulation circuit 1080, the air circulation circuit 1180 does not realize as much cooling of the air as in the air circulation circuit 1080. However, the air circulation circuit 1180 instead provides the advantage that the heat from the heating surface 1252 of the thermoelectric device 1250 is recaptured within the air channel 1214, rather than simply being cooled by the dry air fan 1120 of the air circulation circuit 1080, wherein the heat from the thermoelectric device 1250 is simply dispersed and goes unused.

Figure 21:
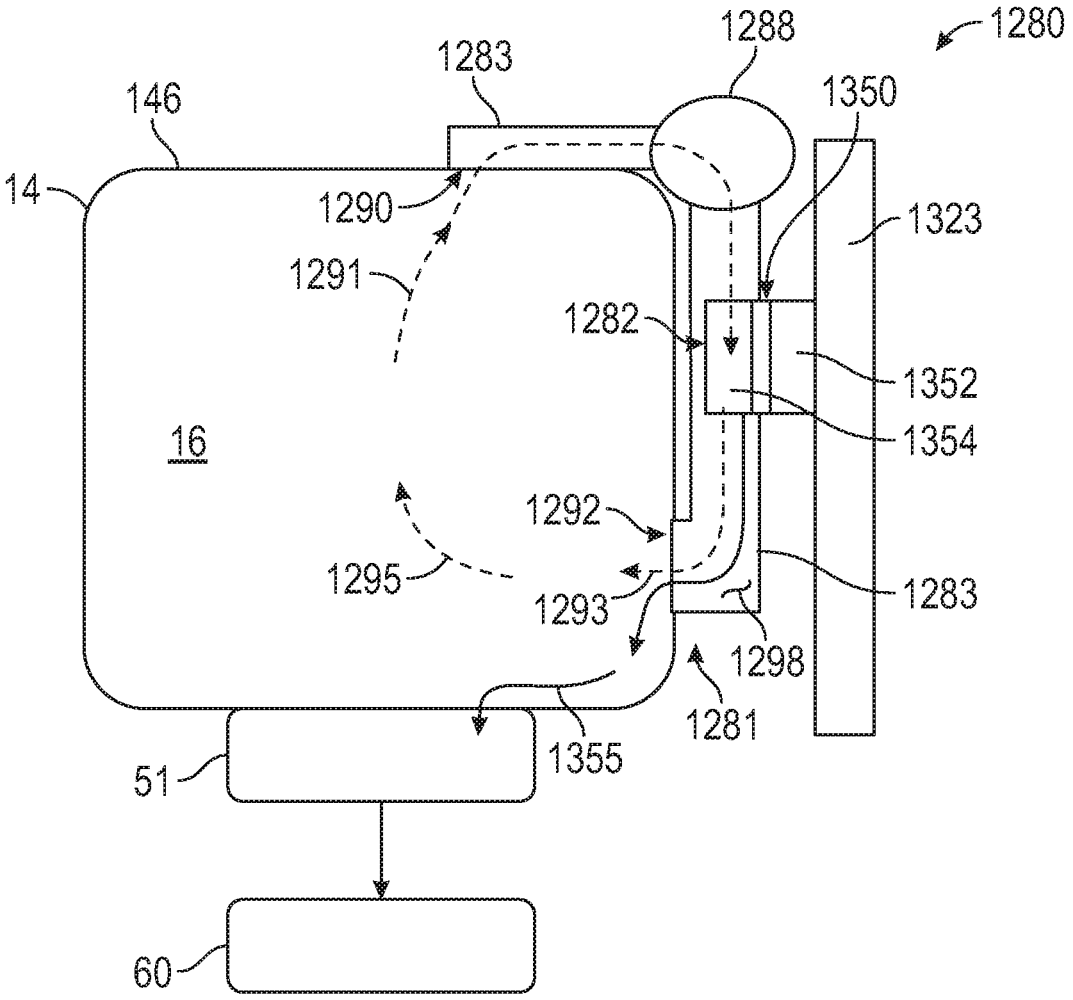
FIG. 21 is a schematic view of another example of an air supply circuit for use with the air supply system of the dishwasher of FIG. 1.

FIG. 21 illustrates another example of an air supply circuit, illustrated as an air circulation circuit 1280, for use with the air supply system 65 and the dishwasher 10 described herein that is very similar to the air circulation circuit 1080 of FIG. 19, and shares most of the same features and components as the air circulation circuit 1080, but differs in a structure that is thermally coupled with a heating surface 1352 of a thermoelectric device 1350. Therefore, elements of the air circulation circuit 1280 that are similar to those of the air circulation circuit 1080 are identified with numerals increased by 200, with it being understood that the description of the like parts of the air circulation circuit 1080 applies to the air circulation circuit 1280, unless otherwise noted. The air circulation circuit 1280 can be included within the air supply system 65 and the dishwasher 10 in addition to the previously described components of the drying system 80, without the need to replace or remove other parts of the drying system 80 as described, or the air circulation circuit 1280 can be thought of as replacing the condensing assembly 81 or as another example of a condensing assembly 1281.

The air circulation circuit 1280 is nearly identical to the air circulation circuit 1080 in almost all aspects, but differs from the air circulation circuit 1080 only in that the air circulation circuit 1280 includes a heat sink 1323 thermally coupled with the heating surface 1352. Apart from that, the arrangement and the description of the condensing assembly 1281, a condensing inlet 1290, a condensing inlet air pathway 1291, a condensing conduit 1283, an interior 1298 defining a condensing air pathway 1298, a condenser blower 1288, a condenser 1282, a condensing outlet 1292, a condensing outlet air pathway 1293, a dry air flow 1295, a condensed liquid flow 1355 to the sump 51 and the drain system 60, and the thermoelectric device 1350 having the heating surface 1352 and a cooling surface 1354 is still the same and can be provided in the same manner as in the air circulation circuit 1080.

The air circulation circuit 1280 differs from the air circulation circuit 1080 only in that, instead of providing the dry air fan 1120 to direct the dry air flow 1121 onto the heating surface 1352, the heat sink 1323 is instead thermally coupled to the heating surface 1352 to remove or draw heat away from the heating surface 1352. While the heat sink 1323 can be any suitable thermally conductive structure for absorbing and dissipating heat away from the heating surface 1352, in one example the heat sink 1323 is provided as a heating wall 1323, which can be thought of similarly to the cooling wall 854 of FIG. 12. Even more specifically, in one non-limiting example, the heating wall 1323 comprises a metal side panel 1323 of the dishwasher 10, such as a portion of the cabinet or chassis, such that the heating surface 1352 of the thermoelectric device 1350 can directly abut the metal side panel 1323 to absorb heat away from the heating surface 1352 and dissipate the heat to the ambient air at the opposite side of the metal side panel 1323. It will be understood that the metal side panel 1323 is not limited to being formed of metal, but can be the side panel 1323 formed of any thermally conductive material.

FIGS. 22-25 illustrate another example of an air supply circuit, illustrated as an air circulation circuit 2080, for use with the air supply system 65 and the dishwasher 10 described in the present disclosure that is similar to the air circulation circuit 1080 of FIG. 19, and shares many of the same features and components as the air circulation circuit 1080, but differs in some aspects, such as in the inclusion of a dry air supply circuit 2180 comprising a dry air channel 2214 defining a dry air supply pathway 2218, as well as in the inclusion of a dry air valve assembly 2250 within the dry air supply circuit 2180. Therefore, elements of the air circulation circuit 2080 that are similar to those of the air circulation circuit 1080 are identified with numerals increased by 1000, with it being understood that the description of the like parts of the air circulation circuit 1080 applies to the air circulation circuit 2080, unless otherwise noted. The air circulation circuit 2080 can be included within the air supply system 65 and the dishwasher 10 in addition to the previously described components of the drying system 80, without the need to replace or remove other parts of the drying system 80 as described, or the air circulation circuit 2080 can be thought of as replacing the condensing assembly 81 or as another example of a condensing assembly 2081, which can be thought of as a condensing circuit.

The air circulation circuit 2080 is similar to the air circulation circuit 1080 in many aspects, but differs from the air circulation circuit 1080 in that the air circulation circuit 2080 includes the additional dry air supply circuit 2180 comprising a dry air fan 2120 provided with the dry air supply pathway 2218 and thermally coupled with a heating surface 2152, and also that the dry air valve assembly 2250 is included with the dry air supply circuit 2180, which is not present in the air circulation circuit 1080, to selectively fluidly couple the dry air supply pathway 2218 to a condensing air pathway 2098. The arrangement and description of the general structure and function of the condensing assembly 2081, a condensing inlet 2090, a condensing inlet air pathway 2091, a condensing conduit 2083, a condenser blower 2088, a condenser 2082, an interior of the condensing conduit 2083 defining the condensing air pathway 2098, a condensing outlet 2092, a condensing outlet air pathway 2093, a condensed liquid flow 2155, and a heating and cooling assembly 2150 having the heating surface 2152 and a cooling surface 2154, as well as the dry air fan 2120 generating a dry air flow 2121, is still the same and can be provided in the same manner as in the air circulation circuit 1080.

Figure 22:
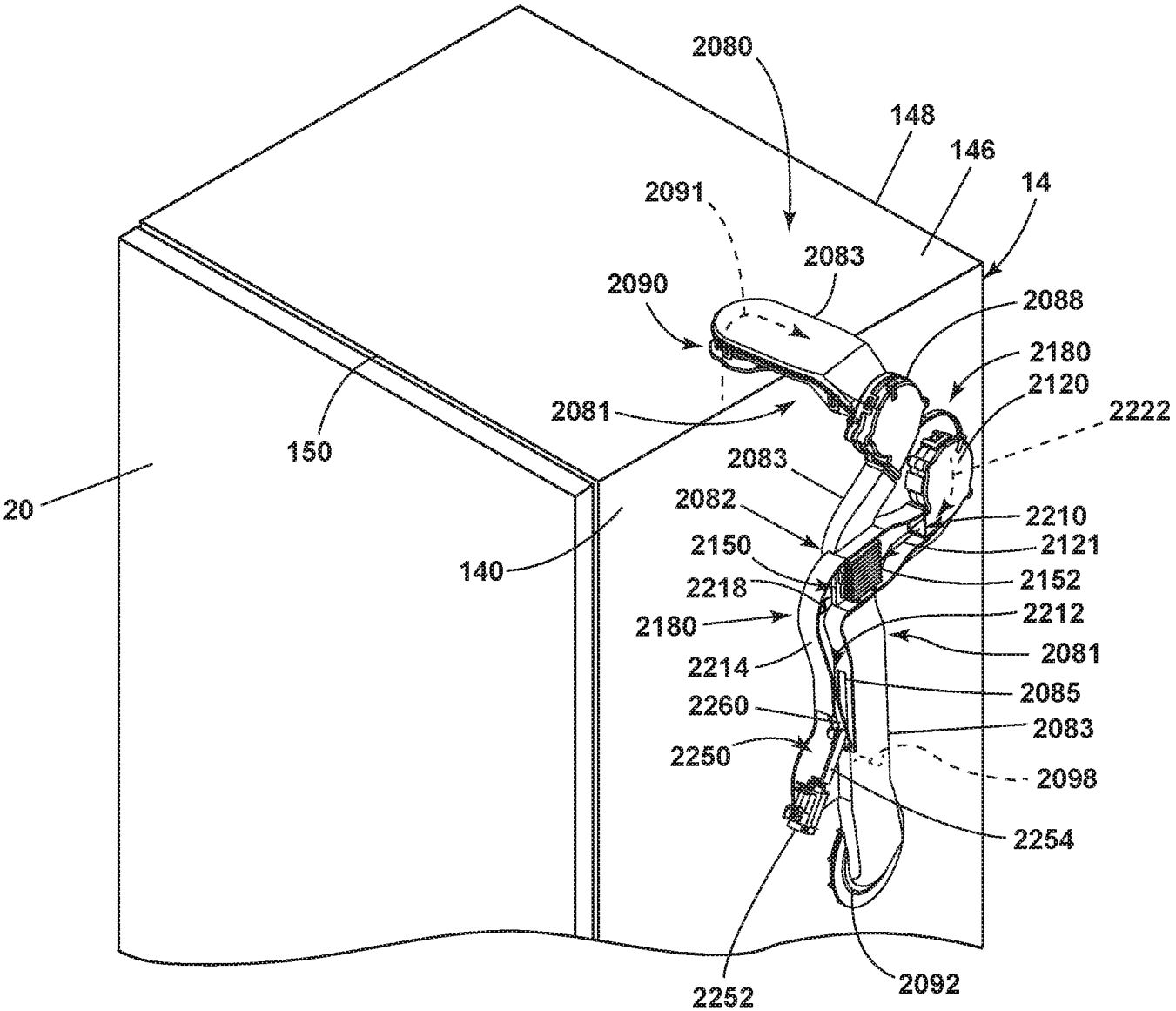
FIG. 22 is a schematic perspective view of another example of an air supply circuit for use with the air supply system of the dishwasher of FIG. 1.

In FIG. 22, it can be seen that the air circulation circuit 2080 differs from the air circulation circuit 1080 downstream of the dry air fan 2120 by the inclusion of the dry air supply circuit 2180 comprising the dry air channel 2214 at least partially defining the dry air supply pathway 2218 and other associated components. The dry air supply circuit 2180, the dry air channel 2214, and the dry air supply pathway 2218 are similar to portions of the air circulation circuit 1180 and the air channel 1214 defining the air circulation pathway 1218 of FIG. 20, as well as similar to the dry air supply circuit 980 and the air channel 1014 defining the air supply pathway 1018 of FIG. 14. However, the dry air supply circuit 2180, the dry air channel 2214, and the dry air supply pathway 2218 differ from the air circulation circuit 1180 in that the dry air channel 2214 is at least partially separate and fluidly distinct from the condensing conduit 2083 and in the inclusion of the dry air fan 2120 and its air source, and also differ from the dry air supply circuit 980 in the location, orientation, and relative positions of the dry air channel 2214, a dry air inlet 2210, and a dry air outlet 2212 relative to the tub 14 and relative to the condensing assembly 2081. Therefore, elements of the dry air supply circuit 2180 that are similar to those of the air circulation circuit 1180 are identified with numerals increased by 1000, while elements of the dry air supply circuit 2180 that are similar to those of the dry air supply circuit 980 are identified with numerals increased by 1200, with it being understood that the description of the like parts of the dry air supply circuit 980 and of the air circulation circuit 1180 applies to the dry air supply circuit 2180, unless otherwise noted.

The condensing assembly 2081, which can be thought of as the condensing circuit, and the dry air supply circuit 2180 can be thought of as collectively forming the air circulation circuit 2080. The condensing assembly 2081 can be thought of as being at least partially positioned between a portion of the dry air supply circuit 2180 and the tub 14, such that the portion of the dry air supply circuit 2180, and specifically of the dry air channel 2214, is spaced from the tub 14 to accommodate the condensing assembly 2081. In one example, as illustrated, the condensing assembly 2081 extends along at least a portion of the top wall 146 and at least a portion of the side wall 140, such that the condensing inlet 2090 is provided in the top wall 146 while the condensing outlet 2092 is provided in the side wall 140, such as at the lower portion of the side wall 140. The dry air supply circuit 2180 can be provided along the same side wall 140, adjacent to at least a portion of the condensing conduit 2083 and with at least a portion of the dry air channel 2214 overlying a portion of the condensing conduit 2083.

The dry air fan 2120, which is analogous to the blower 1020 of the dry air supply circuit 980, the dry air inlet 2210, and an inlet air pathway 2222 can be positioned at a rear portion of the dishwasher 10 and the tub 14, nearer to the rear edge 148 than to the front edge 150 of the side wall 140, and can also be provided at an upper portion of the side wall 140 and of the tub 14. The dry air fan 2120 can at least partially define the dry air inlet 2210 and is fluidly coupled to the ambient air exterior of the tub 14 by the dry air inlet 2210. Specifically, the dry air supply circuit 2180 is located exterior of the tub 14, such as between the side wall 140 of the tub 14 and, for example, a side panel (not shown) of the dishwasher 10, such as a portion of the cabinet or chassis, such that the dry air fan 2120 is fluidly coupled to the ambient air exterior of the tub 14 in the space between the side wall 140 of the tub 14 and the side panel.

The dry air channel 2214 extends between the dry air fan 2120 and the dry air outlet 2212 forwardly along the side wall 140 toward the front edge 150 and crossing over the condensing conduit 2083 such that the dry air outlet 2212 is positioned opposite from the dry air inlet 2210 about the condensing conduit 2083. The dry air channel 2214 can be positioned between the side wall 140 of the tub 14 and the side panel, as described above, and, in the non-limiting example as illustrated, is an open-faced dry air channel 2214. In such an example, the side panel (not shown) of the dishwasher 10, such as of the cabinet or chassis, can close the open-faced dry air channel 2214 to further define the dry air supply pathway 2218. Alternatively, the dry air channel 2214 can be a closed dry air channel 2214, fully defining the dry air supply pathway 2218 itself.

The dry air supply pathway 2218 defined by the dry air channel 2214 is further thermally coupled to the heating surface 2152 of the heating and cooling assembly 2150. Specifically, the heating surface 2152, which can comprise a set of heating surface fins, extends into the dry air supply pathway 2218 through the dry air channel 2214. Thus, ambient air that is drawn into the dry air channel 2214 by the dry air fan 2120 along the inlet air pathway 2222 and through the dry air inlet 2210 can then be provided to the heating surface 2152 as the dry air flow 2121, as indicated by the arrow 2121. In the illustrated example, the heating and cooling assembly 2150 is positioned at the portion of the dry air channel 2214 where the dry air channel 2214 and the condensing conduit 2083 overlap with one another.

Downstream of the heating surface 2152 within the dry air supply pathway 2218, the dry air outlet 2212 is at least partially defined by the dry air channel 2214 and is positioned adjacent a portion of the condensing conduit 2083. The dry air outlet 2212 selectively fluidly couples the dry air channel 2214 further with the ambient air exterior of the tub 14 between the side wall 140 and the side panel (not shown) of the dishwasher 10 as previously described and/or with the treating chamber 16 via the condensing air pathway 2098. The condensing conduit 2083 defines an opening 2085 that is positioned adjacent or abutting the dry air outlet 2212 of the dry air channel 2214 and that fluidly couples the dry air outlet 2212 with the condensing air pathway 2098 upstream of the condensing outlet 2092. The dry air valve assembly 2250, which is similar to the dry air valve assembly 2650 of the dry air supply circuit 2580 of FIGS. 15-18, selectively opens and closes the opening 2085 so as to selectively fluidly couple the dry air outlet 2212 with the condensing air pathway 2098, and thus also the treating chamber 16, or with the exterior of the tub 14. The dry air valve assembly 2250 comprises an actuator 2252 operably coupled to an output shaft 2254 that is movable relative to the actuator 2252 between at least a first, retracted position and a second, extended position. The actuator 2252 can include any suitable type of actuator 2252 for driving movement of the output shaft 2254 between the first and second positions, non-limiting examples of which include a wax motor, a solenoid actuator, or a DC motor.

Figure 23:
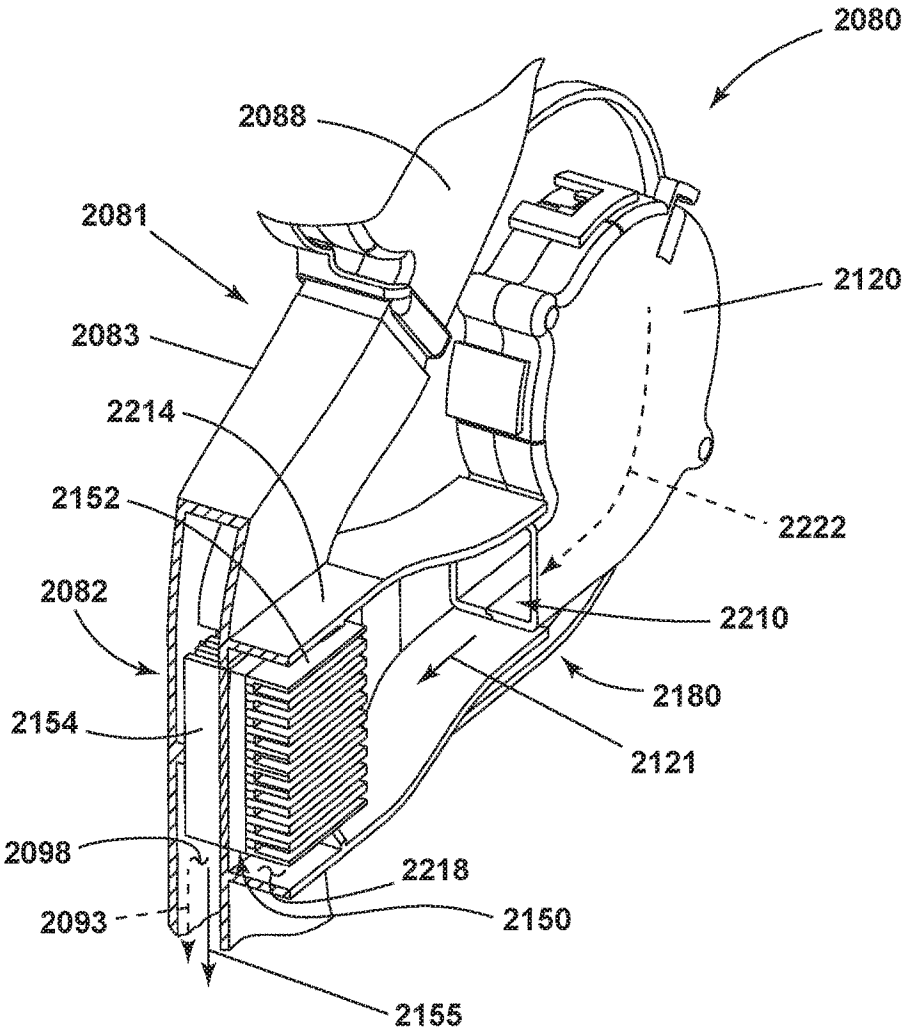
FIG. 23 is a left-side perspective cross-sectional view of a portion of the air supply circuit of FIG. 22.

The arrangement of the heating and cooling assembly 2150 with respect to the condensing assembly 2081 and the dry air supply circuit 2180 is best seen in the view of FIG. 23. The heating and cooling assembly 2150 is positioned at the portion of the dry air channel 2214 that overlies or overlaps the condensing conduit 2083. In this arrangement, the heating surface 2152, which can comprise the set of heating surface 2152 fins, extends through the dry air channel 2214 and into the dry air supply pathway 2218 for thermal coupling with the dry air supply pathway 2218. Likewise, the cooling surface 2154, which can comprise a set of cooling surface 2154 fins, extends through the condensing conduit 2083 and into the condensing air pathway 2098 for thermal coupling with the condensing air supply pathway 2098, as described previously with respect to FIG. 14 and FIG. 20. Downstream of the cooling surface 2154, the condensed liquid flow 2155 and the condensing outlet air pathway 2093 extend downwardly through the condensing air pathway 2098 and toward the condensing outlet 2092, as described previously with respect to FIG. 19.

Figure 25:
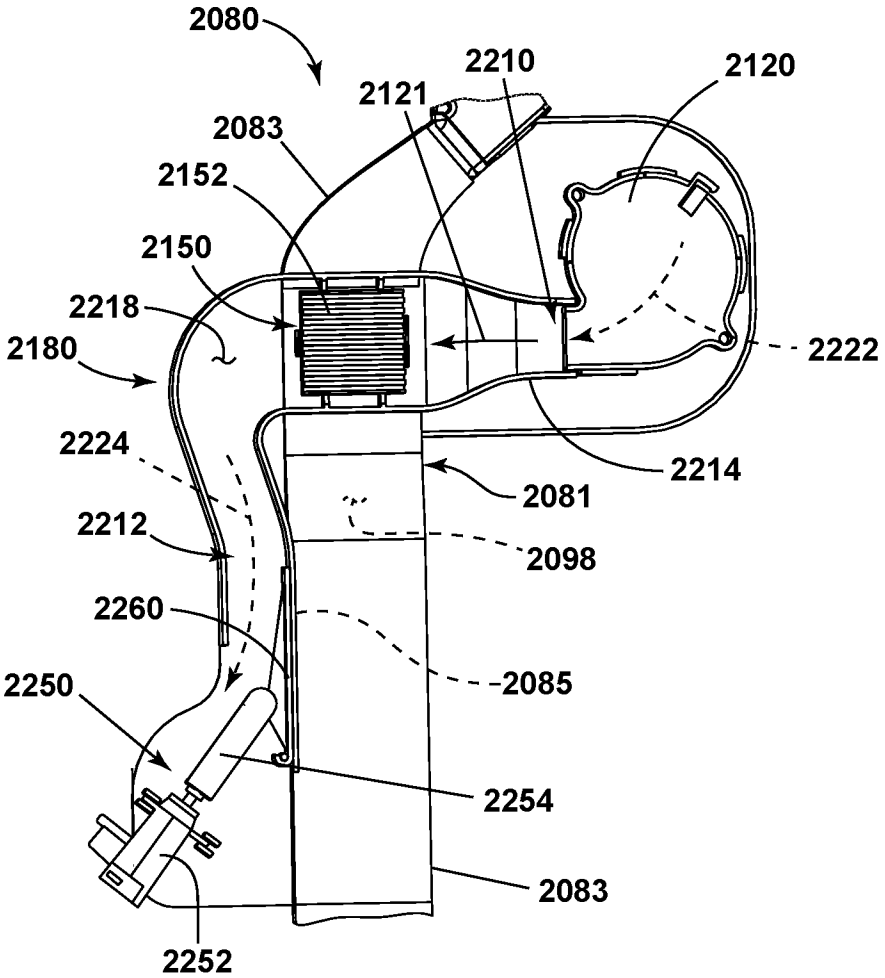
FIG. 25 is a front view of the portion of the air supply circuit of FIG. 24, with the dry air valve assembly in a second position.
Figure 24:
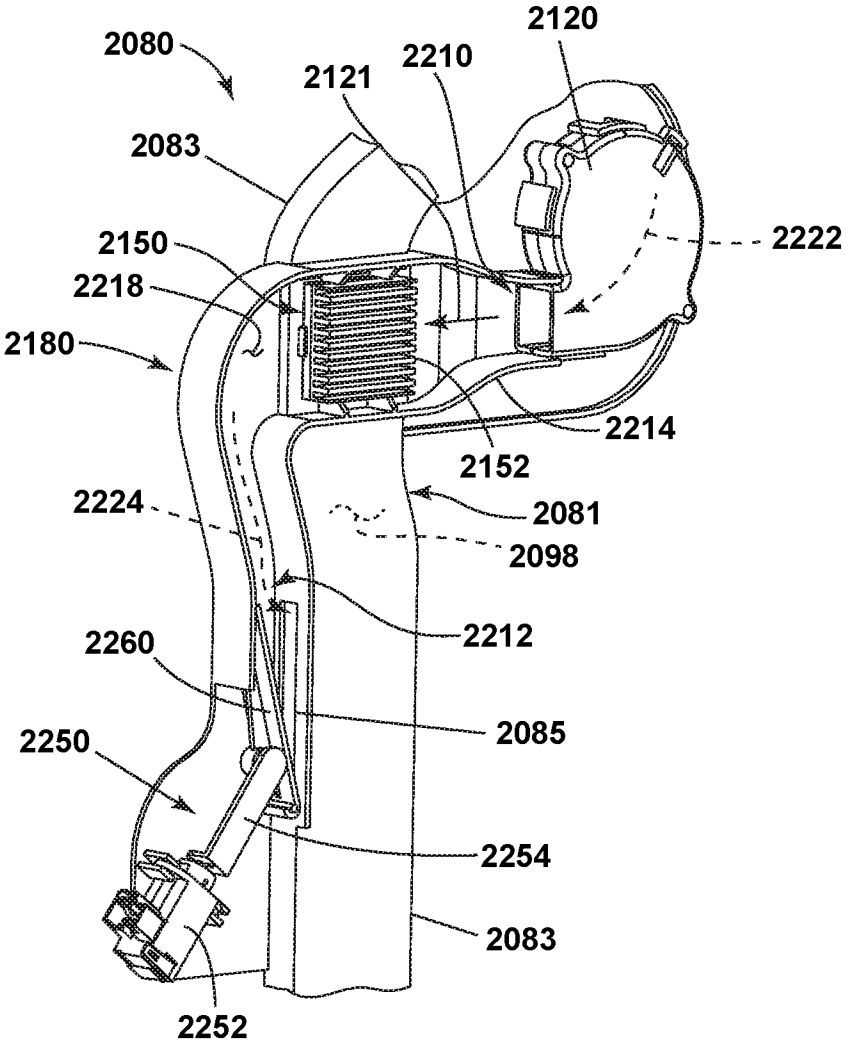
FIG. 24 is a left-side perspective view of a portion of the air supply circuit of FIG. 22, including a dry air valve assembly in a first position.

In FIG. 24, the dry air valve assembly 2250 is shown in a first, retracted position, corresponding to a retracted position of the output shaft 2254 relative to the actuator 2252. It can also be seen that the dry air valve assembly 2250 further comprises a movable gate 2260 to which the output shaft 2254 is further operably coupled. The gate 2260 is movable relative to the output shaft 2254 between at least a first, retracted position, as shown, and a second, extended position (FIG. 25). Thus, the first position of the dry air valve assembly 2250, as shown, corresponds to the retracted position of the output shaft 2254 and of the gate 2260 relative to the actuator 2252. While the gate 2260 is illustrated as being rotatable relative to the output shaft 2254, other types of relative movement are also contemplated, non-limiting examples of which include sliding movement or translational movement. In the first, retracted position of the dry air valve assembly 2250, the gate 2260 is spaced from at least a portion of the opening 2085 to allow fluid coupling of the dry air supply pathway 2218 with the condensing air pathway 2098 through the opening 2085. Additionally, in the first, retracted position of the dry air valve assembly 2250, at least a portion of the gate 2260 contacts or abuts the dry air channel 2214 to block further air flow from exiting the dry air channel 2214 except through the opening 2085, preventing fluid coupling of the dry air supply pathway 2218 with the exterior of the tub 14. Specifically, the gate 2260 blocks the remainder of the dry air channel 2214 to prevent dry air from flowing from the dry air outlet 2212 to the exterior of the tub 14, instead allowing dry air from the dry air supply pathway 2218 exiting the dry air channel 2214 through the dry air outlet 2212 to flow through the opening 2085 along an outlet air pathway 2224 of the first, retracted position, as shown, and into the condensing air pathway 2098 toward the condensing outlet 2092. Thus, the dry air valve assembly 2250, and specifically the gate 2260, fluidly couples the dry air outlet 2212 with the condensing air pathway 2098, the condensing outlet 2092, and therefore also the treating chamber 16, in the first, retracted position.

In FIG. 25, the dry air valve assembly 2250 is shown in a second, extended position, corresponding to an extended position of the output shaft 2254 and of the gate 2260 relative to at least the actuator 2252. In the second, extended position, the output shaft 2254 extends further away from the actuator 2252 to protrude further toward the condensing conduit 2083 and the opening 2085. The gate 2260 is rotated relative to the output shaft 2254, specifically to be angled further away from the actuator 2252, as well as rotated relative to the dry air channel 2214 and the condensing conduit 2083. In the second, retracted position of the dry air valve assembly 2250, the gate 2260 abuts the condensing conduit 2083 to close the opening 2085 and prevent dry air from flowing through the opening 2085, but no longer blocks the remainder of the dry air channel 2214 to prevent dry air from flowing from the dry air outlet 2212 to the exterior of the tub 14. Dry air from the dry air supply pathway 2218 is then permitted to exit the dry air channel 2214 through the dry air outlet 2212 to flow to the exterior of the tub 14 along an outlet air pathway 2224 of the second, extended position, as shown, and specifically into the space between the side wall 140 of the tub and the side panel (not shown) of the dishwasher 10 as previously described. Thus, the dry air valve assembly 2250, and specifically the gate 2260, fluidly couples the dry air outlet 2212 with the exterior of the tub 14 in the second, extended position.

Turning now to the operation of the air circulation circuit 2080, the operation of the condensing assembly 2081 is the same as that of the condensing assembly 1081 of the air circulation circuit 1080 of FIG. 19. Regarding the dry air supply circuit 2180, the operation of the dry air supply circuit 2180 is very similar to the operation of the dry air supply circuit 980 of FIG. 14. Specifically, operation of the dry air fan 2120 by the controller 22 draws in ambient air through the dry air inlet 2210 along the inlet air pathway 2222 to be drawn through the dry air fan 2120 and into the dry air channel 2214, and further to be provided to the heating surface 2152 as the dry air flow 2121. When the heating and cooling assembly 2150 is operated, the dry air flow 2121 flows over the heating surface 2152 and can be heated relative to the ambient temperature, while the cooling surface 2154 is cooled, dehumidifying the process air within the condensing air pathway 2098 by condensing moisture out of the process air to generate the condensed liquid flow 2155 within the condensing conduit 2083 to flow through the condensing outlet 2092 into the tub 14 to be collected in the sump 51 and subsequently provided to the drain system 60.

Downstream of the heating and cooling assembly 2150, when the dry air valve assembly 2250 is in the first, retracted position of FIG. 24, the gate 2260 blocks the dry air flow 2121 through the dry air supply pathway 2218 from exiting the dry air channel 2214 to the exterior of the tub 14. Instead, the dry air flow 2121 is pushed from the dry air fan 2120 through the dry air supply pathway 2218 to exit through the dry air outlet 2212 along the outlet air pathway 2224 of the first, retracted position to flow through the opening 2085 and into the condensing air pathway 2098 to be provided to the treating chamber 16 through the condensing outlet 2092. The dry air provided to the treating chamber 16 in this way can interact with the heated, humid air within the treating chamber 16 to reduce the overall level of relative humidity within the treating chamber 16 by the supply of fresh, dry ambient air to improve drying performance and reduce drying time, as well as by adding air to the treating chamber 16 to increase pressure within the treating chamber 16 to improve venting performance when the door assembly 20 is opened. Alternatively, when the dry air valve assembly 2250 is in the second, extended position of FIG. 25, the gate 2260 closes the opening 2085, such that the dry air flow 2121 is instead pushed from the dry air fan 2120 through the dry air supply pathway 2218 to exit through the dry air outlet 2212 along the outlet air pathway 2224 of the second, extended position to flow to the exterior of the tub 14.

In one non-limiting example, similar to the operation of the dry air valve assembly 2650 of FIGS. 15-18, the dry air valve assembly 2250 can be actuated to the first, retracted position to fluidly couple the dry air outlet 2212 with the treating chamber 16 when the temperature and/or humidity level within the treating chamber 16 is at or below a predetermined threshold. Specifically, the predetermined threshold can be the temperature and/or humidity level within the treating chamber 16 at or below which contact of the air within the treating chamber 16 with the exterior of the tub 14 or with the work surface 170 is not likely to have undesirable effects or to cause any wear or damage to the work surface 170 or any other part of the environment exterior of the tub 14. When the dry air valve assembly 2250 is in the first, retracted position and dry air flows from the dry air supply circuit 2180 into the treating chamber 16, the extra air being pushed into the interior of the tub 14 increases the air pressure within the treating chamber 16, which can result in air escaping from the tub 14 at any available openings, such as through the air break 74. Because of this possibility, it is important to only operate the dry air valve assembly 2250 to provide the dry air to the treating chamber 16 when the temperature and/or humidity within the treating chamber 16 is at or below the predetermined threshold so that any air that may escape from the tub 14 due to the increased air pressure within the tub 14 is safe and suitable for contact with the exterior of the tub 14 and the work surface 170.

Therefore, when the temperature and/or humidity level within the treating chamber 16 is above the predetermined threshold, the dry air valve assembly 2250 can be actuated to the second, extended position to fluidly couple the dry air outlet 2212 with the exterior of the tub 14 and to prevent air from the dry air outlet 2212 from entering the condensing air pathway 2098 and the treating chamber 16. Providing the dry air valve assembly 2250 in the second, extended position when the temperature and/or humidity level within the treating chamber 16 is above the predetermined threshold ensures that the air pressure within the tub 14 is not raised to increase the likelihood of air escape from the tub 14 when the temperature and/or humidity level of the air that would escape from the tub 14 is undesirable for contact with the work surface 170 or the exterior of the tub 14. In this way, the benefit of providing the dry air to the treating chamber 16 in order to improve drying performance and reduce the time needed for a drying phase of a cycle of operation can be achieved, but only when the temperature and/or humidity level within the treating chamber 16 is safe and suitable to do so and would not have any undesirable effects on the work surface 170 or the exterior of the tub 14 if air were to escape the tub 14 due to the increased air pressure from providing the dry air into the treating chamber 16.

While the dry air valve assembly 2250 has been described as having first and second positions to supply the dry air either to the treating chamber 16 or to the exterior of the tub 14, it is also contemplated that the dry air valve assembly 2250 can include additional positions between the first, retracted position and the second, extended position, such that the dry air valve assembly 2250 can be operated to fluidly couple and to allow the flow of dry air to both the treating chamber 16 and to the exterior of the tub 14 at the same time. However, this would require the dry air fan 2120 to be capable of generating higher air flow than when operating the dry air valve assembly 2250 to supply the dry air to only one of the treating chamber 16 or the exterior of the tub 14 at one time, which may not always be desirable or feasible within the dishwasher 10.

Figure 26:
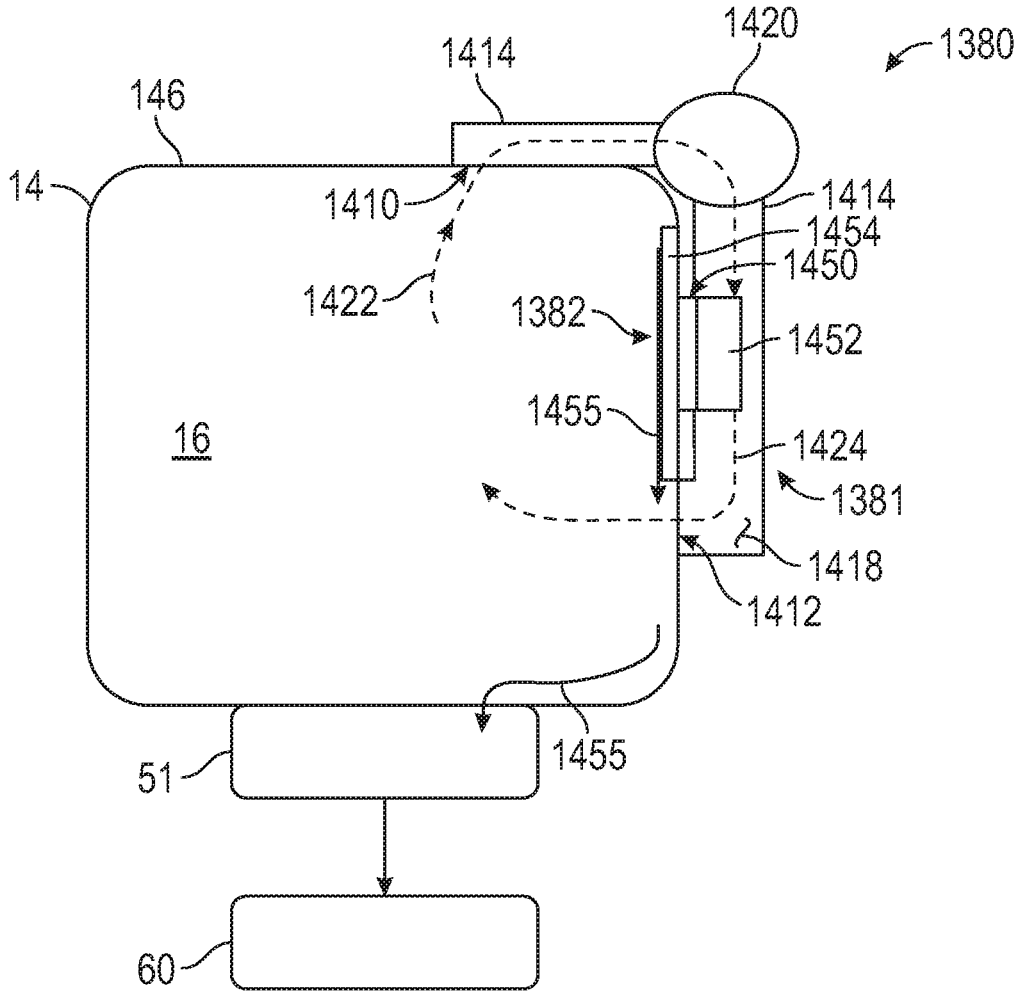
FIG. 26 is a schematic view of another example of an air supply circuit for use with the air supply system of the dishwasher of FIG. 1.

FIG. 26 illustrates another example of an air supply circuit, illustrated as an air circulation circuit 1380, for use with the air supply system 65 and the dishwasher 10 described herein that is similar to the air circulation circuit 880 of FIG. 13, and shares many of the same features and components as the air circulation circuit 880, but differs in some aspects, such as in the location of an air inlet 1410 and an inlet air pathway 1422, as well as in the location of an air outlet 1412 and an outlet air pathway 1424, and in a direction of air supply along an air supply pathway 1418. Therefore, elements of the air circulation circuit 1380 that are similar to those of the air circulation circuit 880 are identified with numerals increased by 500, with it being understood that the description of the like parts of the air circulation circuit 880 applies to the air circulation circuit 1380, unless otherwise noted. The air circulation circuit 1380 can be included within the air supply system 65 and the dishwasher 10 in addition to the previously described components of the drying system 80, without the need to replace or remove other parts of the drying system 80 as described, or the air circulation circuit 1380 can be thought of as replacing the condensing assembly 81 or as another example of a condensing assembly 1381.

The air circulation circuit 1380 is similar to the air circulation circuit 880 in many aspects, but differs from the air circulation circuit 880 in that the air inlet 1410, the inlet air pathway 1422, and a blower 1420 have a different location relative to the tub 14 and to the treating chamber 16, and also in that the air outlet 1412, and therefore also the outlet air pathway 1424, have a different position relative to the tub 14 and to the top wall 146, in the direction of the air supply along the air supply pathway 1418, and in that the air circulation circuit 1380 is a closed loop implementation. The arrangement, such as the order of air supply, and the description, though not necessarily the position, of the air inlet 1410, the inlet air pathway 1422, at least a portion of an air channel 1414 with an interior 1418 that defines the air supply pathway 1418, a blower 1420, the air outlet 1412, the outlet air pathway 1424, as well as of a thermoelectric device 1450, a heating surface 1452, a cooling wall 1454, and a condensed liquid flow 1455 as indicated by the arrow 1455 to the sump 51 and the drain system 60 is still the same and can be provided in the same order and operation, though not in the same positions, as in the air circulation circuit 880.

The air circulation circuit 1380 differs from the air circulation circuit 880 in that the air inlet 1410, the inlet air pathway 1422, and the blower 1420, instead of being located at the lower portion of the rear wall 144, are located at the top wall 146, such as near the rear edge 148 or the rear portion of the top wall 146 and the tub 14. The blower 1420 can be positioned at the corner of the tub 14 adjacent the rear edge 148 of the top wall 146. The air outlet 1412 and the outlet air pathway 1424, instead of being located near the front edge 150 of the top wall 146, are instead located at the lower portion of the tub 14, and specifically at the lower portion of the rear wall 144. The air channel 1414 extends between the air inlet 1410 and the air outlet 1412, with a portion of the air channel 1414 extending along the top wall 146 and a portion of the air channel 1414 extending along the rear wall 144. The thermoelectric device 1450, the heating surface 1452, and the cooling wall 1454 can have the same positions as in the air circulation circuit 880 with respect to the rear wall 144 and to the air channel 1414. Essentially, the positioning of the thermoelectric device 1450, the heating surface 1452, the cooling wall 1454, and the condensed liquid flow 1455 are positioned exactly as in the air circulation circuit 880 of FIG. 13, while the air inlet 1410, the inlet air pathway 1422, the air channel 1414, the air supply pathway 1418, the blower 1420, the air outlet 1412, and the outlet air pathway 1424 are positioned exactly as in the air circulation circuit 1280 of FIG. 21.

Turning now to the operation, when the blower 1420 and the thermoelectric device 1450 are operated, heated, humid process air is drawn from the treating chamber 16 through the air inlet 1410 along the inlet air pathway 1422, through the blower 1420, and pushed along the air supply pathway 1418 passing over the heating surface 1452 to absorb heat from the heating surface 1452. Because the already heated process air draws heat away from the heating surface 1452, the process air is not cooled, though the heating from the heating surface 1452 may slightly reduce moisture content of the process air. The process air is then returned to the treating chamber 16 through the air outlet 1412 along the outlet air pathway 1424 to pass through the treating chamber 16 and continue to circulate through the air circulation circuit 1380. As the heating surface 1452 is heated, the cooling wall 1454 is, in turn, cooled to cause condensation to occur within the tub 14 and along the cooling wall 1454. Condensed liquid flows along the condensed liquid flow 1455, downwardly along the rear wall 144 toward the sump 51 and subsequently to the drain system 60. Although no cooling of the process air occurs in the air circulation circuit 1380, the air supply or circulation through the air circulation circuit 1380 does result in the occurrence of condensation within the treating chamber 16 to at least somewhat dry the process air and improve the performance of the drying process. In this way, the closed loop air circulation circuit 1380 can be thought of as further comprising the condensing assembly 1381, with the cooling wall 1454 acting as a condenser 1382.

Figure 27:
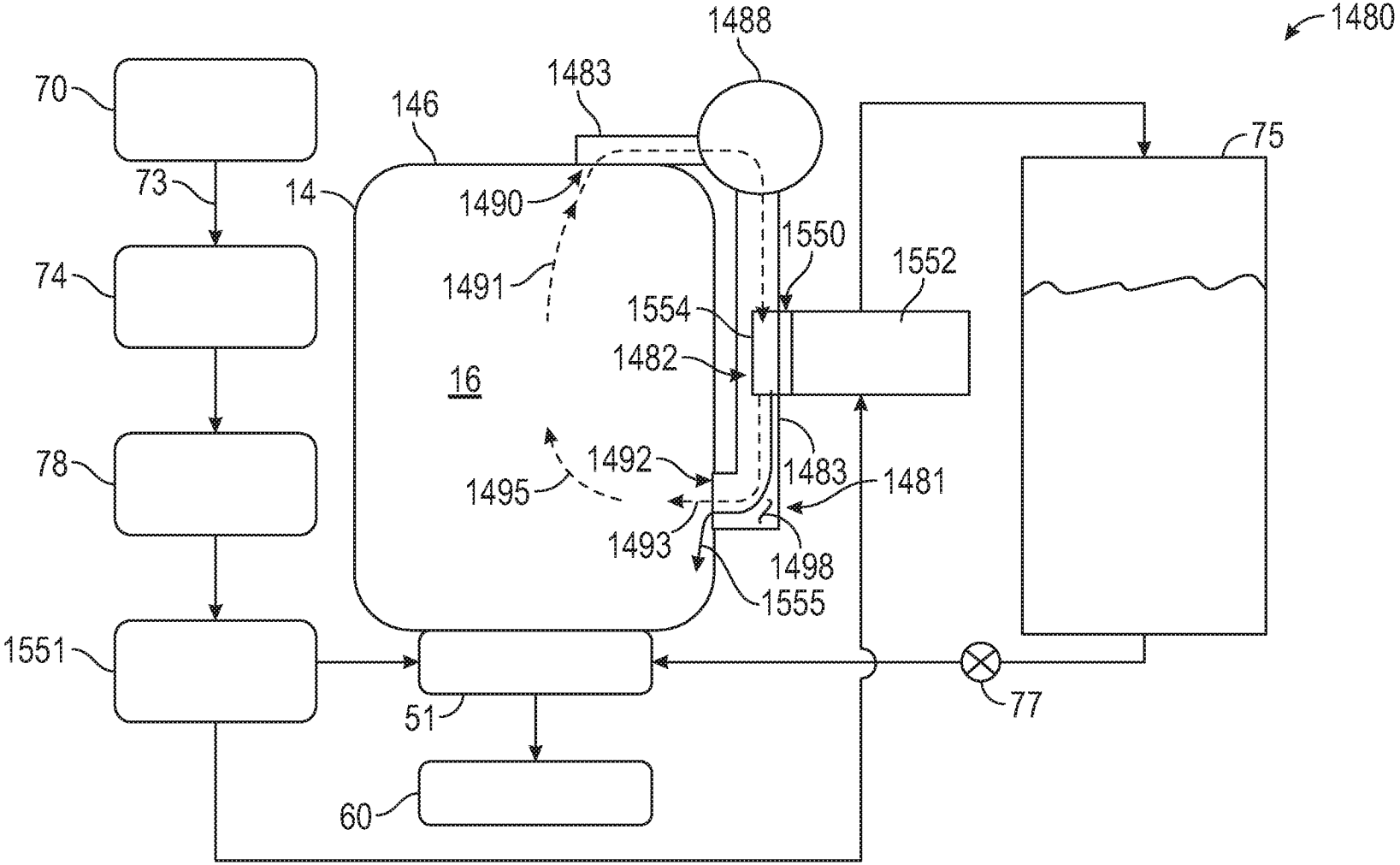
FIG. 27 is a schematic view of another example of an air supply circuit for use with the air supply system of the dishwasher of FIG. 1.

FIG. 27 illustrates another example of an air supply circuit, illustrated as an air circulation circuit 1480, for use with the air supply system 65 and the dishwasher 10 described herein that is very similar to the air circulation circuit 1080 of FIG. 19, and shares most of the same features and components as the air circulation circuit 1080, but differs in a structure that is thermally coupled with a heating surface 1552 of a thermoelectric device 1550. Therefore, elements of the air circulation circuit 1480 that are similar to those of the air circulation circuit 1080 are identified with numerals increased by 400, with it being understood that the description of the like parts of the air circulation circuit 1080 applies to the air circulation circuit 1480, unless otherwise noted. The air circulation circuit 1480 can be included within the air supply system 65 and the dishwasher 10 in addition to the previously described components of the drying system 80, without the need to replace or remove other parts of the drying system 80 as described, or the air circulation circuit 1480 can be thought of as replacing the condensing assembly 81 or as another example of a condensing assembly 1481.

The air circulation circuit 1480 is nearly identical to the air circulation circuit 1080 in almost all aspects, but differs from the air circulation circuit 1080 only in that the air circulation circuit 1480 includes the heating surface 1552 comprising a water-cooled radiator 1552 thermally coupled with the heating surface 1552 and with the thermoelectric device 1550, and with the dishwasher 10 comprising a water supply circuit for supplying water to the water-cooled radiator 1552. Apart from that, the arrangement and the description of the condensing assembly 1481, a condensing inlet 1490, a condensing inlet air pathway 1491, a condensing conduit 1483, an interior 1498 defining a condensing air pathway 1498, a condenser blower 1488, a condenser 1482, a condensing outlet 1492, a condensing outlet air pathway 1493, a dry air flow 1495, a condensed liquid flow 1555 to the sump 51 and the drain system 60, and the thermoelectric device 1550 having the heating surface 1552 and a cooling surface 1554 is still the same and can be provided in the same manner as in the air circulation circuit 1080.

The air circulation circuit 1480 differs from the air circulation circuit 1080 only in that, instead of providing the dry air fan 1120 to direct the dry air flow 1121 onto the heating surface 1552, the water-cooled radiator 1552 is instead thermally coupled to the heating surface 1552 to remove or draw heat away from the heating surface 1552 and the thermoelectric device 1550. While the water-cooled radiator 1552 can be any suitable thermally conductive structure for absorbing and dissipating heat away from the heating surface 1552 by flowing cooling water over the radiator 1552, in one non-limiting example the water-cooled radiator 1552 is provided as the radiator 1552 comprising a plurality of radiator fins 1552 that can be cooled by flowing water over the radiator 1552 and the fins 1552. The water-cooled radiator 1552 is very similar to previous examples of the heating surface fins 1152, 1252, except that the water-cooled radiator 1552 is cooled by flowing water over the radiator fins 1552, rather than by flowing cooling air over the heating surface fins 1152, 1252 as described previously.

While the inclusion of the water-cooled radiator 1552 can provide a variety of benefits within the dishwasher 10, it also requires additional water supply circuitry for providing the cooling water to the water-cooled radiator 1552 to flow over the water-cooled radiator 1552. In one example, as illustrated herein, the water-cooled radiator 1552 is fluidly coupled to the water supply system 70 for supplying water to the water-cooled radiator 1552. Specifically, the water supply system 70 provides water to the dishwasher 10 through the water supply conduit 73 to the siphon break 74 or air break 74. As described previously with respect to FIG. 2, the water softener 78 can fluidly couple the water supply conduit 73 to the supply tank 75, and specifically to fluidly couple the water supply conduit 73 to the supply tank 75 downstream of the air break 74, such that supplied water automatically passes through the air break 74 on the way to the water softener 78, as well as automatically passes through the water softener 78 on the way to the supply tank 75.

In the present example with the water-cooled radiator 1552 included, the water supply system 70 can be fluidly coupled to the water-cooled radiator 1552 downstream of the water softener 78, but upstream of the supply tank 75. In one example, the water supply system 70 comprises a two-position valve 1551 provided between the water softener 78 and the supply tank 75. The two-position valve 1551 selectively couples the water supply system 70 either to the sump 51 or to the water-cooled radiator 1552. Water that is supplied from the two-position valve 1551 to the water-cooled radiator 1552 is provided to flow through the water-cooled radiator 1552, then is further provided to the supply tank 75. Downstream of the supply tank 75, the controllable valve 77 is fluidly coupled to the sump 51 to control when water is released from the supply tank 75 to the sump 51.

The operation of the air circulation circuit 1480 is the same as the operation of the air circulation circuit 1080, except that, instead of operating the dry air fan 1120 to cool the heating surface 1552, cooling of the heating surface 1552 is instead performed by flowing cooling liquid through the water-cooled radiator 1552, cooling the condensing conduit 1483 and causing condensation by the condenser 1482. For example, when the controller 22 operates the condenser blower 1488 and operates the thermoelectric device 1550, the water supply system 70 can additionally be operated to flow cooling water through the water-cooled radiator 1552, which can occur, in one non-limiting example, at predetermined intervals during a drying phase of a cycle of operation. By way of operable coupling with the controller 22, the two-position valve 1551 is actuated to a position that selectively allows water to flow from the water softener 78 toward the water-cooled radiator 1552. As the water passes over the water-cooled radiator 1552, the water absorbs and draws heat away from the heating surface 1552. The heated water then flows out of the water-cooled radiator 1552 and into the supply tank 75. The water can then be stored in the supply tank 75 until it is needed for use in a subsequent cycle of operation or phase of the cycle of operation. When the water stored in the supply tank 75 is needed for a cycle of operation, the controller 22 controls the controllable valve 77 to release water from the supply tank 75 to the sump 51 to be provided to the treating chamber 16.

Figure 28:
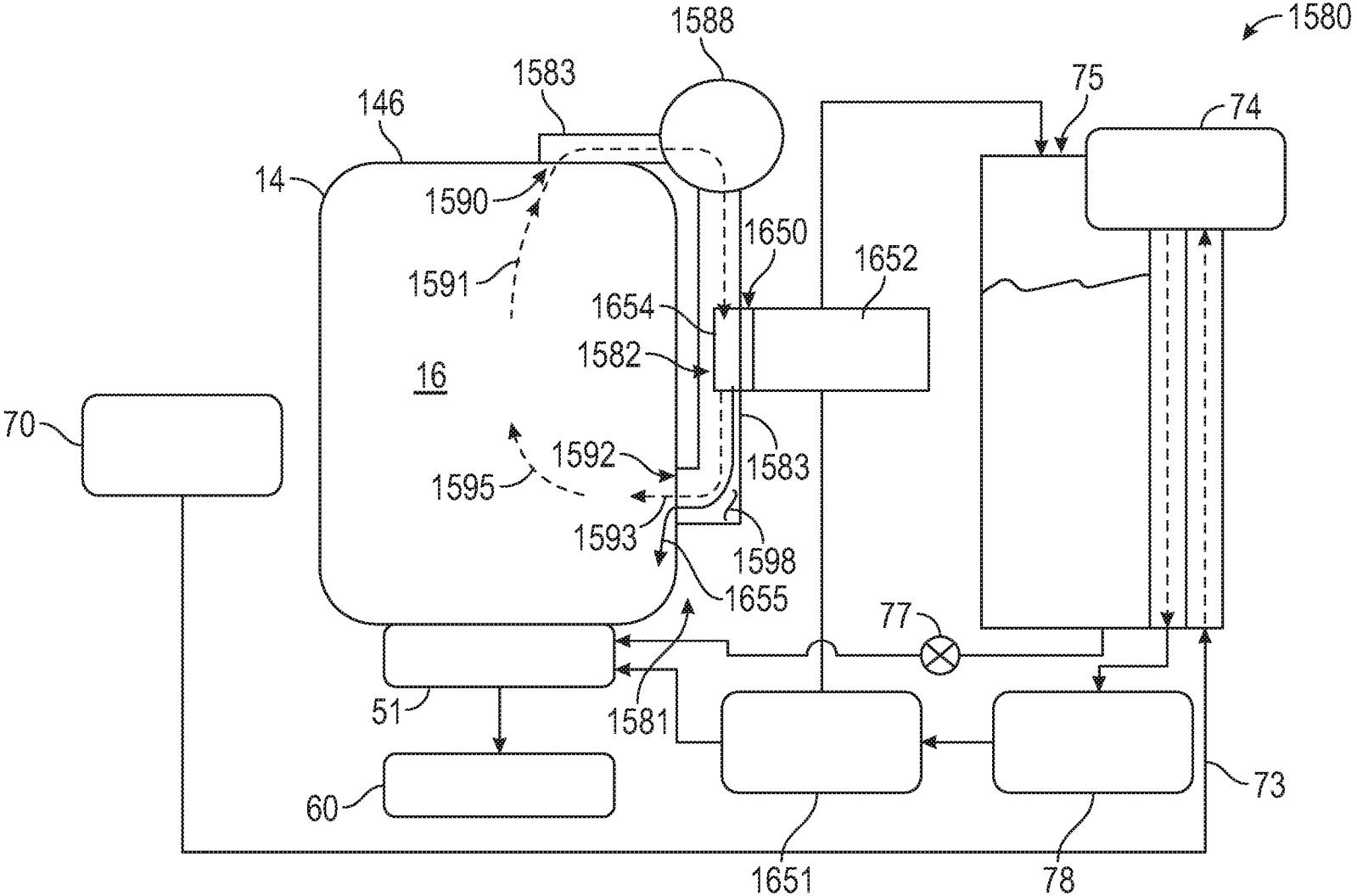
FIG. 28 is a schematic view of another example of an air supply circuit for use with the air supply system of the dishwasher of FIG. 1.

FIG. 28 illustrates another example of an air supply circuit, illustrated as an air circulation circuit 1580, for use with the air supply system 65 and the dishwasher 10 described herein that is very similar to the air circulation circuit 1480 of FIG. 27, and shares nearly all of the same features and components as the air circulation circuit 1480, but differs in the circuitry of the water supply system 70 supplying cooling water to a water-cooled radiator 1652. Therefore, elements of the air circulation circuit 1580 that are similar to those of the air circulation circuit 1480 are identified with numerals increased by 100, with it being understood that the description of the like parts of the air circulation circuit 1480 applies to the air circulation circuit 1580, unless otherwise noted. The air circulation circuit 1580 can be included within the air supply system 65 and the dishwasher 10 in addition to the previously described components of the drying system 80, without the need to replace or remove other parts of the drying system 80 as described, or the air circulation circuit 1580 can be thought of as replacing the condensing assembly 81 or as another example of a condensing assembly 1581.

The air circulation circuit 1580 is nearly identical to the air circulation circuit 1480 in almost all aspects, but differs from the air circulation circuit 1480 only in the arrangement of the components of the water supply system 70 for supplying water to the water-cooled radiator 1652. Apart from that, the arrangement and the description of the condensing assembly 1581, a condensing inlet 1590, a condensing inlet air pathway 1591, a condensing conduit 1583, an interior 1598 defining a condensing air pathway 1598, a condenser blower 1588, a condenser 1582, a condensing outlet 1592, a condensing outlet air pathway 1593, a dry air flow 1595, a condensed liquid flow 1655 to the sump 51 and the drain system 60, and the thermoelectric device 1650 having the water-cooled radiator 1652 and a cooling surface 1654 is still the same and can be provided in the same manner as in the air circulation circuit 1480.

The air circulation circuit 1580 differs from the air circulation circuit 1480 only in the circuitry of the water supply system 70 for providing the cooling water to the water-cooled radiator 1652 to flow over the water-cooled radiator 1652. The only difference in the water supply system 70 to the water-cooled radiator 1652 as compared to the water supply system 70 providing water to the water-cooled radiator 1552 of FIG. 27 is that, in the air circulation circuit 1580, the air break 74, to which the water is provided through the water supply conduit 73 from the water supply system 70, is integrated with the supply tank 75. Specifically, the air break 74 is defined within a portion of the supply tank 75, though the water flow through the air break 74 is fluidly isolated from the water that fills the supply tank 75. Apart from that, the supply of cooling water to the water-cooled radiator 1652, and subsequently to the supply tank 75 and to the sump 51, is the same as that of the air circulation circuit 1480, such that water flows from the air break 74 to the water softener 78, then to a two-position valve 1651 that can selectively supply the water to the water-cooled radiator 1652, then subsequently into the supply tank 75 to be drained from the supply tank 75 into the sump 51 under control of the controllable valve 77.

Figure 29:
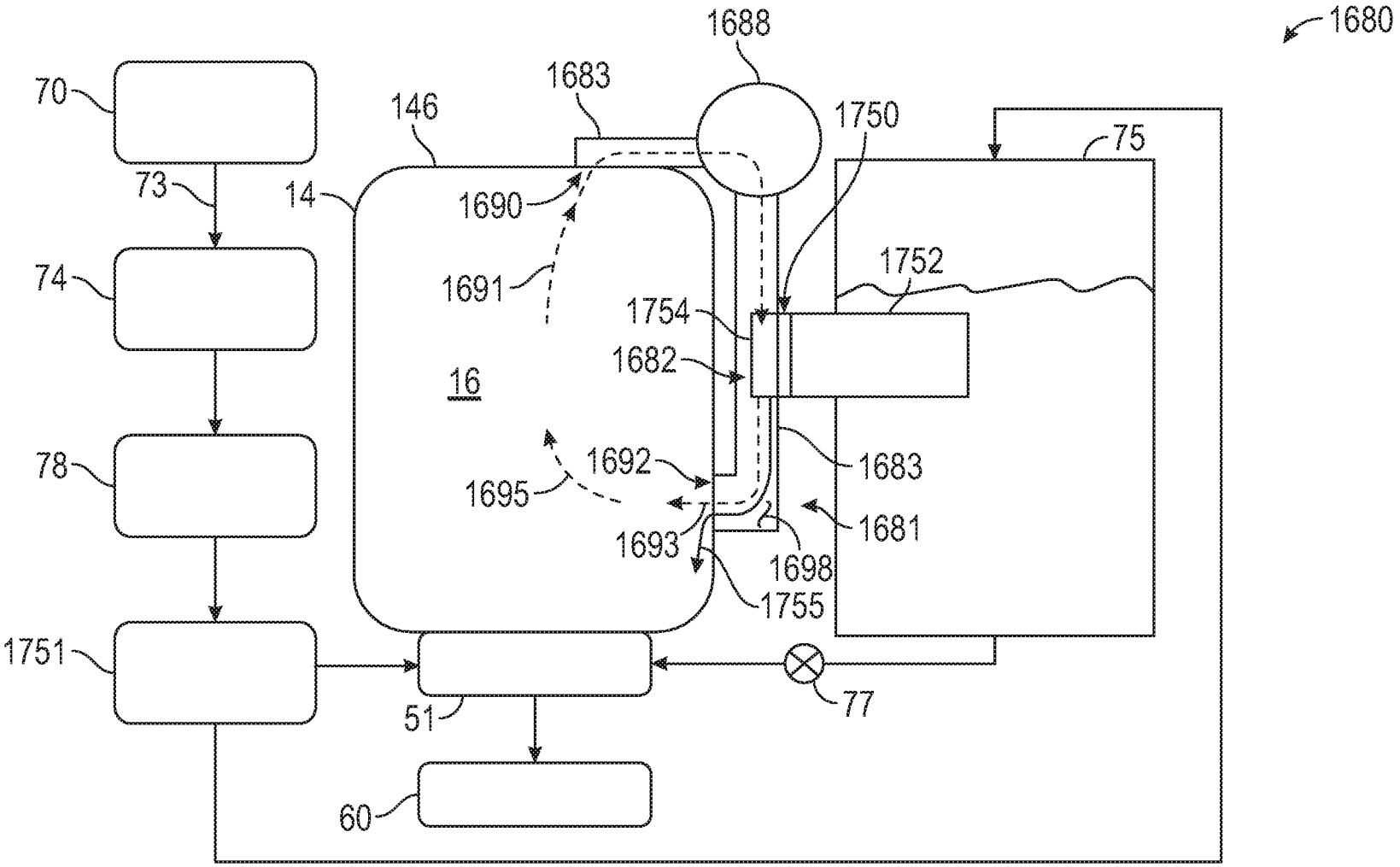
FIG. 29 is a schematic view of another example of an air supply circuit for use with the air supply system of the dishwasher of FIG. 1.

FIG. 29 illustrates another example of an air supply circuit, illustrated as an air circulation circuit 1680, for use with the air supply system 65 and the dishwasher 10 described herein that is very similar to the air circulation circuit 1480 of FIG. 27, and shares nearly all of the same features and components as the air circulation circuit 1480, but differs in the structure of a water-cooled radiator 1752 and in the circuitry of the water supply system 70 supplying cooling water to the water-cooled radiator 1752. Therefore, elements of the air circulation circuit 1680 that are similar to those of the air circulation circuit 1480 are identified with numerals increased by 200, with it being understood that the description of the like parts of the air circulation circuit 1480 applies to the air circulation circuit 1680, unless otherwise noted. The air circulation circuit 1680 can be included within the air supply system 65 and the dishwasher 10 in addition to the previously described components of the drying system 80, without the need to replace or remove other parts of the drying system 80 as described, or the air circulation circuit 1680 can be thought of as replacing the condensing assembly 81 or as another example of a condensing assembly 1681.

The air circulation circuit 1680 is nearly identical to the air circulation circuit 1480 in almost all aspects, but differs from the air circulation circuit 1480 only in the structure of the water-cooled radiator 1752 and in the arrangement of the components of the water supply system 70 for supplying water to the water-cooled radiator 1752. Apart from that, the arrangement and the description of the condensing assembly 1681, a condensing inlet 1690, a condensing inlet air pathway 1691, a condensing conduit 1683, an interior 1698 defining a condensing air pathway 1698, a condenser blower 1688, a condenser 1682, a condensing outlet 1692, a condensing outlet air pathway 1693, a dry air flow 1695, a condensed liquid flow 1755 to the sump 51 and the drain system 60, and the thermoelectric device 1750 having the water-cooled radiator 1752 and a cooling surface 1754 is still the same and can be provided in the same manner as in the air circulation circuit 1480.

The air circulation circuit 1680 differs from the air circulation circuit 1480 only in the structure of the water-cooled radiator 1752 and in the circuitry of the water supply system 70 for providing the cooling water to the water-cooled radiator 1752. While the water-cooled radiator 1552 of the air circulation circuit 1480 is fluidly coupled to the water supply system 70 to flow the cooling water through the water-cooled radiator 1552, the water-cooled radiator 1752, instead of receiving the flow of cooling water, is provided to couple with the supply tank 75 such that the water-cooled radiator 1752 can be selectively immersed within water stored in the supply tank 75 for cooling. In such an example, the heating surface 1752 can comprise a plurality of radiator fins 1752 and can be coupled to the supply tank such that the plurality of radiator fins 1752 pass through at least a portion of the supply tank 75 to extend into the supply tank 75 and provide an increased surface area for thermal coupling of the heating surface 1752 with the supply tank 75. The water-cooled radiator 1752 can be positioned relative to the supply tank 75 such that the water-cooled radiator 1752 is immersed in water when the supply tank 75 is at least partially filled. The position of the water-cooled radiator 1752 relative to the supply tank 75 is also the only difference in the water supply system 70 to the water-cooled radiator 1752 as compared to the water supply system 70 providing water to the water-cooled radiator 1552 of FIG. 27.

The operation of the air circulation circuit 1680 is nearly the same as the operation of the air circulation circuit 1480, except in the order of the water-cooled radiator 1752 and the supply tank 75 and the manner in which water is provided to the water-cooled radiator 1752. Specifically, water from the water softener 78 is provided to a two-position valve 1751. While the two-position valves 1551, 1651 of the air circulation circuits 1480, 1580, respectively, were selectively fluidly coupled with the sump 51 and the water-cooled radiator 1552, 1652, the two-position valve 1751 selectively fluidly couples to the sump 51 and the supply tank 75. When cooling of the water-cooled radiator 1752 is initiated by the controller 22, the two-position valve 1751 provides water into the supply tank 75 to at least partially fill the supply tank 75 until the water-cooled radiator 1752, and specifically the radiator fins 1752 extending into the supply tank 75, are submerged within the water in the supply tank 75. Water can remain stored within the supply tank 75 until the controller 22 operates the controllable valve 77 to release the water from the supply tank 75 to the sump 51. In this implementation of the water-cooled radiator 1752, constant cooling of the water-cooled radiator 1752 is realized as long as the supply tank 75 is filled with water, as opposed to having the need to intermittently flow water over the water-cooled radiators 1552, 1652.

The aspects described herein set forth a variety of air supply circuits that can be provided within a dishwasher to provide a variety of benefits and improvements in the performance of the dishwasher. Such air supply circuits have applicability in both closed loop and open loop dishwasher configurations. Cooling or dry air supply circuits are disclosed to provide cooling or dry air which can be used either to cool or dry air exiting the treating chamber when the door is opened or can be provided to the treating chamber to improve drying efficiency during a cycle of operation. Air supply circuits including an outlet adjacent an upper, front edge of the dishwasher, such as adjacent the upper portion of the access opening, can be provided to direct a flow of air, which can be dry air, cooling air, or uncooled air, toward the top of the dishwasher door, either from above the tub or from within the tub, in order to create an air barrier or air curtain to prevent humid, hot air from within the treating chamber from contacting a work surface above the dishwasher when the dishwasher door is opened. Air supply circuits can include a variety of cooling assemblies, condensing assemblies, heat exchangers, or thermoelectric devices in order to dry, cool, or heat air within various portions of the dishwasher to improve the efficiency of the drying phase or to otherwise improve a cycle of operation.

More specifically, some dishwashers can include an automatic door opening system that can be provided to slightly open the dishwasher door at the conclusion of a cycle of operation to provide improved dryness of the dishes. However, this can allow hot, humid air escaping through the opening of the door to flow against or along a work surface above the dishwasher, such as a countertop. Overtime, this repeated exposure of the work surface to moisture can result in wear to the work surface due to moisture retention. By including air supply circuits as disclosed herein, such as by providing cooling or dry air and/or providing an air barrier or air curtain, the work surface can be protected from as much moisture exposure while still allowing the door to be propped open for improved final drying performance. In addition, by providing cooling or dry air to mix with the hot, humid air escaping through the door opening, the overall temperature or level of relative humidity of the air escaping from the treating chamber can be reduced, meaning that the door can be opened sooner, when the temperature within the treating chamber is higher, shortening cycle times.

It will also be understood that various changes and/or modifications can be made without departing from the spirit of the present disclosure. By way of non-limiting example, although the present disclosure is described for use with a dishwasher having a door assembly pivotable about a horizontal axis, it will be recognized that the door assembly can be employed with various constructions, including door assemblies pivotable about a vertical axis and/or door assemblies for drawer-style dishwashers.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dish treating appliance comprising:

a tub having at least a top wall and a pair of opposing side walls and at least partially defining a treating chamber with an access opening;

a door movable relative to the tub between closed and opened positions to selectively close and open the access opening; and an air supply circuit comprising:

an air inlet located on one of the opposing side walls and at a lower portion of the tub, the air inlet fluidly coupled to the treating chamber and configured for drawing air from the treating chamber into the air supply circuit, an air outlet at least partially passing through the top wall near a front edge of the top wall to be located within the treating chamber, the air outlet curving slightly downward at the top wall to at least partially pass through the top wall at an acute angle and comprising an opening that faces an upper portion of the access opening and configured to direct the air toward the upper portion of the access opening at the front edge of the top wall, and an air channel fluidly coupling the air outlet to the air inlet, with at least a portion of the air channel extending along an exterior of the tub.

2. The dish treating appliance of claim 1 wherein the air supply circuit further comprises a blower fluidly coupled to the air channel.

3. The dish treating appliance of claim 1 wherein the air supply circuit further comprises a cooling assembly thermally coupled to air passing through the air supply circuit.

4. The dish treating appliance of claim 3 wherein the cooling assembly comprises at least one of a condensing pathway, an air-cooled air channel, a water-cooled air channel, a thermoelectric device, or a heat exchanger.

5. The dish treating appliance of claim 1 wherein the air supply circuit further comprises a second air outlet located at a lower portion of the treating chamber.

6. The dish treating appliance of claim 1 wherein the air inlet is located at a rear portion of the tub.

7. The dish treating appliance of claim wherein the air outlet at least partially protrudes below the level of the top wall.

8. A dish treating appliance comprising:

a tub having at least a top wall and a pair of opposing side walls and at least partially defining a treating chamber with an access opening;

a door movable relative to the tub between closed and opened positions to selectively close and open the access opening; and an air supply circuit comprising:

an air inlet located on one of the opposing side walls and at a lower portion of the tub, the air inlet fluidly coupled to the treating chamber and configured for drawing air from the treating chamber into the air supply circuit, an air outlet at least partially passing through the top wall near a front edge of the top wall to be located within the treating chamber, the air outlet curving slightly downward at the top wall to at least partially pass through the top wall at an acute angle and comprising an opening that faces an upper portion of the access opening and configured to direct the air toward the upper portion of the access opening at the front edge of the top wall, an air channel fluidly coupling the air outlet to the air inlet, with at least a portion of the air channel extending along an exterior of the tub, and a cooling assembly thermally coupled to cool air passing through the air supply circuit.

9. The dish treating appliance of claim 8 wherein the cooling assembly comprises a cooling pathway that is at least one of a condensing pathway, an air-cooled pathway, or a water-cooled pathway.

10. The dish treating appliance of claim 9 wherein at least a portion of the air channel defines the cooling pathway.

11. The dish treating appliance of claim 8 wherein the cooling assembly comprises a heat exchanger or a thermoelectric device thermally coupled to at least a portion of the air channel and having a hot side and a cold side.

12. The dish treating appliance of claim 11 wherein the hot side of the heat exchanger or the thermoelectric device is thermally coupled to the at least a portion of the air channel.

13. The dish treating appliance of claim wherein the air outlet at least partially protrudes below the level of the top wall.

* * * * *